US009962317B2

(12) United States Patent
Koike et al.

(10) Patent No.: US 9,962,317 B2
(45) **Date of Patent: *May 8, 2018**

(54) MEDICINE-SUPPLYING DEVICE AND MEDICINE-COUNTING DEVICE

(71) Applicant: YUYAMA MFG. CO., LTD., Toyonaka-shi, Osaka (JP)

(72) Inventors: Naoki Koike, Toyonaka (JP); Mitsuhiro Mitani, Toyonaka (JP); Masao Fukada, Toyonaka (JP)

(73) Assignee: YUYAMA MFG. CO, LTD., Osaka (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/438,543

(22) Filed: Feb. 21, 2017

(65) Prior Publication Data

US 2017/0224587 A1 Aug. 10, 2017

Related U.S. Application Data

(63) Continuation of application No. 14/954,864, filed on Nov. 30, 2015, now Pat. No. 9,611,084, which is a (Continued)

(30) Foreign Application Priority Data

Mar. 21, 2012 (JP) ..... 2012-064100
Sep. 25, 2012 (JP) ..... 2012-211369

(51) Int. Cl.
*G06M 1/06* (2006.01)
*A61J 7/00* (2006.01)

(Continued)

(52) U.S. Cl.
CPC ..... *A61J 7/0084* (2013.01); *A61J 7/02* (2013.01); *B65B 1/30* (2013.01); *B65B 5/103* (2013.01);

(Continued)

(58) Field of Classification Search
CPC . G06M 1/06; G06F 17/00; G06F 7/00; G06K 7/00; G06K 19/00

(Continued)

(56) References Cited

U.S. PATENT DOCUMENTS 5,369,940 A 12/1994 Soloman
5,884,408 A 3/1999 Boyer et al.

(Continued)

FOREIGN PATENT DOCUMENTS

JP 57-023516 A 2/1982
JP 01-51403 B2 11/1989
WO WO2012/099189 A1 7/2012

OTHER PUBLICATIONS

European Patent Office, Supplementary Partial European Search Report issued in European Patent Application No. EP 13 76 3592, dated Oct. 29, 2015, total 5 pages.

(Continued)

*Primary Examiner* — Edwyn Labaze
(74) *Attorney, Agent, or Firm* — Masuvalley & Partners

(57) ABSTRACT

This drug-supplying device is provided with: a rotator that discharges drugs towards the outer diameter by being rotated; a drug shape-specifying unit for specifying the shape of the drug; and a control unit that rotates the rotator at a rotational speed specified, on the basis of a speed table that correlates drug shape to rotator rotational speed, by the shape that has been specified by a drug-detecting unit.

4 Claims, 48 Drawing Sheets

Related U.S. Application Data continuation of application No. 14/386,774, filed as application No. PCT/JP2013/057154 on Mar. 14, 2013, now Pat. No. 9,233,789.

(51) Int. Cl.

| | |
|---|---|
| ***A61J 7/02*** | (2006.01) |
| ***B65D 83/04*** | (2006.01) |
| ***B65B 5/10*** | (2006.01) |
| ***B65B 1/30*** | (2006.01) |
| ***B65B 57/20*** | (2006.01) |
| ***B65B 35/06*** | (2006.01) |

(52) U.S. Cl.
CPC ..... *B65B 35/06* (2013.01); *B65B 57/20* (2013.01); *B65D 83/04* (2013.01); *A61J 2205/40* (2013.01)

(58) Field of Classification Search
USPC ..... 235/103, 375, 435, 487; 700/214–216
See application file for complete search history.

(56) References Cited

U.S. PATENT DOCUMENTS

| | | | | |
|---|---|---|---|---|
| 2003/0111484 | A1 | 6/2003 | Pearson et al. | |
| 2004/0118753 | A1 | 6/2004 | Belway et al. | |
| 2006/0167586 | A1 | 7/2006 | Kobayashi et al. | |
| 2006/0225383 | A1 | 10/2006 | Cobb et al. | |
| 2007/0043469 | A1 | 2/2007 | Draper | |
| 2008/0283540 | A1 | 11/2008 | Kulberg et al. | |
| 2010/0300041 | A1 | 12/2010 | Kim | |
| 2012/0324828 | A1* | 12/2012 | Yasunaga | B08B 7/02 53/111 R |
| 2013/0144431 | A1 | 6/2013 | Tidhar et al. | |
| 2015/0190312 | A1 | 7/2015 | Yuyama et al. | |
| 2016/0167866 | A1* | 6/2016 | Omura | B65B 35/06 221/173 |

OTHER PUBLICATIONS

International Preliminary Report on Patentability in PCT/JP2013/057154, dated Oct. 2, 2014, Authorized Officer Mineko Mohri of the International Bureau of WIPO.

* cited by examiner 41
102
a
b
101
52
c'
103
35
23 b'
52

35
c
d
23

35
c'
d
23 c'
35 c
d
35
23

41
a' c'
35

41
a
b
c'
35
52

41
a'
b'
52

102
c
d
103
35
23
101

35
23

35
23

41
a c'
35
52 c'
35

41
a
b
52

41
52

23
d
c
35
70

23
d
c
35
70

41
a
b
d
c 23
c'
35

35 c'
35

41
a
b
52

41
52 c
d
35
23
70

35
c'
23
b
52 c
d
35
23

35
23 c'
35

41
a
b
52 c
d
35
23

35
c'

23
35
c
d 35
52

MEDICINE-SUPPLYING DEVICE AND MEDICINE-COUNTING DEVICE

CROSS-REFERENCE TO RELATED APPLICATIONS

This application claims priority under 35 U.S.C. § 120 as a continuation of U.S. patent application Ser. No. 14/954,864 filed Nov. 30, 2015 entitled Medicine-Supplying Device And Medicine-Counting Device, which claims priority under 35 U.S.C. § 120 as a continuation of U.S. patent application Ser. No. 14/386,774, filed Sep. 19, 2014 entitled Medicine-Supplying Device And Medicine-Counting Device, which is a U.S. national phase application under 35 U.S.C. § 371 of International Application No. PCT/JP2013/057154, filed on Mar. 14, 2013 entitled Drug-Supplying Device And Drug-Counting Device, which claims priority under 35 U.S.C. § 119 to Japanese Patent Application No. 2012-064100, filed on Mar. 21, 2012; and Ser. No. 14/386,774 also claims priority to Japanese Patent Application No. 2012-211369, filed on Sep. 25, 2012; all of which are hereby expressly incorporated by reference in their entireties for all purposes.

BACKGROUND

1. Technical Field

The present invention relates to a medicine-supplying device capable of supplying medicines of different shapes and, sizes, such as tablets and capsules, one by one, and a medicine-counting device equipped with the medicine-supplying device.

2. Description of the Related Art

A supplying device for aligning and supplying small articles has been well known (Refer to Japanese Examined Patent Application Publication No. 1-51403, for example).

The supplying device has a disc-like first rotator rotated by a first driving means and an annular second rotator rotated by a second driving means. A first rotary shaft of the first rotator is disposed to tilt at a predetermined angle, and a second rotary shaft of the second rotator is disposed to vertically extend. The upper end of the tilted first rotator is on the same level as the inner circumference of the second rotator. A frame wall that surrounds the outer circumference of the first rotator is integral with the inner circumference of the second rotator.

In the supplying device thus configured, rotation of the first rotator causes a supplied object to move from the upper end to the second rotator. Then, a restricting body provided on the second rotator allows only a supplied object in a predetermined orientation to pass to the downstream side, and causes a supplied object in other orientations to fall from the inner circumference of the second rotator onto the first rotator. This can prevent collision between supplied objects.

However, when the conventional supplying device is used to supply medicines, two or more supplied medicines may simultaneously pass the restricting body, and be supplied to a guiding part to a discharge port abreast in the radial direction. This disadvantageously generates clogging at an inlet of the guiding part.

SUMMARY

An object of the present invention is to provide a medicine-supplying device and a medicine-counting device for discharging medicines one by one reliably and efficiently.

Means for Solving the Problems

To solve the problem, according to the present invention, a medicine-supplying device includes:

a rotator configured to discharge a medicine to an outer diameter side by rotation;

a medicine shape-specifying unit configured to specify medicine shape;

a control unit configured to rotate the rotator at a rotational speed specified based on the medicine shape specified by the medicine shape-specifying unit according to a speed table associating the medicine shape with the rotational speed of the rotator.

Even at the same rotational speed of the rotator, depending on the medicine shape, some medicines are smoothly discharged from a dispensing part, while other medicines are hardly discharged. With the configuration, by setting the rotational speed of the rotator depending on the medicine shape in consideration of variation in a conveying state by the rotator due to variation in the medicine shape, medicines can be discharged one by one reliably and efficiently.

To solve the problem, according to the present invention, a medicine-supplying device includes:

a rotator configured to discharge a medicine to an outer diameter side by rotation;

a detection unit configured to detect an interval between discharges of the medicine from the rotator;

a control unit configured to rotate the rotator at a rotational speed specified based on the medicine interval detected by the detection unit according to a speed table associating the medicine interval detected by the detection unit with the rotational speed of the rotator for setting the medicine interval to a desired value.

With this configuration, since the rotational speed of the rotator is changed depending on the medicine interval, for example, medicines of any shape can be discharged at a constant interval. Thereby, medicines can be discharged one by one reliably and efficiently.

To solve the problem, according to the present invention, a medicine-counting device includes:

a rotator configured to discharge a medicine to an outer diameter side by rotation;

a detection unit configured to detect the medicine discharged from the rotator;

a medicine shape-specifying unit configured to specify medicine shape;

a control unit configured to rotate the rotator at a rotational speed specified based on the medicine shape specified by the medicine shape-specifying unit according to a speed table associating the medicine shape with the rotational speed of the rotator, and to stop the rotator when the number of discharged medicines detected by the detection unit reaches the number of prescribed medicines in prescription data.

With this configuration, by setting the rotational speed of the rotator depending on the medicine shape, medicines can be discharged one by one reliably and efficiently. As a result, the problem that the detection unit cannot count medicines due to too large or too small interval can be prevented, achieving correct counting.

To solve the problem, according to the present invention, a medicine-counting device includes:

a rotator configured to discharge a medicine to an outer diameter side by rotation;

a detection unit configured to detect the medicine discharged from the rotator;

a control unit configured to rotate the rotator at a rotational speed specified based on an interval between the medicines detected by the detection unit according to a speed table associating the medicine interval detected by the detection unit with the rotational speed of the rotator, and to stop the rotator when the number of discharged medicines detected by the detection unit reaches the number of prescribed medicines in prescription data.

With this configuration, the rotational speed of the rotator can be controlled to directly set the suitable medicine interval on the basis of the interval between medicines detected by the detection unit. Accordingly, the detection unit can detect medicines at a desired interval at all times irrespective conditions such as the medicine shape, achieving precise and efficient counting.

Preferably, the medicine shape-specifying unit specifies the medicine shape by selecting a planar shape and a side shape of the medicine.

With this configuration, the medicine shape can be automatically specified with ease merely by selecting the shape in two directions viewed from the top and side.

A medicine volume-specifying unit configured to specify a reference volume of the medicine is further provided, and according to a medicine volume coefficient table associating the medicine shape with a medicine volume coefficient, the control unit may count the number of discharged medicines as 1 when a product of the medicine volume coefficient specified based on the shape specified by the medicine shape-specifying unit and the reference volume specified by the medicine volume-specifying unit is equal to or exceeds a medicine volume calculated based on a detection signal from the detection unit.

A medicine volume-specifying unit configured to specify a reference volume of the medicine is further provided, and according to a medicine volume coefficient table associating the rotational speed of the rotator with a medicine volume coefficient, the control unit may count the number of discharged medicines as 1 when a product of the medicine volume coefficient specified based on the rotational speed determined according to the speed table and the reference volume specified by the medicine volume-specifying unit exceeds a medicine volume calculated based on a detection signal from the detection unit.

The reference volume described herein means a volume measured by any of various publicly-known methods or a volume presented by pharmaceutical manufacturers, for a medicine. A medicine volume acquired by dispensing a medicine through rotation of the rotator, and calculating the volume of the dispensed medicine on the basis of the detection signal from the detection unit may be used. In this case, the calculated volume may be used from the second discharge of prescription onward.

With the configuration, the number of discharged medicines can be correctly detected depending on the medicine shape or the rotational speed of the rotator, preventing excessive discharging by mistake.

A medicine volume-specifying unit configured to specify a reference volume of the medicine is further provided, and according to a foreign-material volume coefficient table associating the medicine shape with a foreign-material volume coefficient, the control unit does not count the number of discharged medicines when a product of the foreign-material volume coefficient specified based on the shape specified by the medicine shape-specifying unit and the reference volume specified by the medicine volume-specifying unit exceeds a medicine volume calculated based on a detection signal from the detection unit.

A medicine volume-specifying unit configured to specify a reference volume of the medicine is further provided, and according to a foreign-material volume coefficient table associating the rotational speed of the rotator with a foreign-material volume coefficient, the control unit does not count the number of discharged medicines when a product of the foreign-material volume coefficient specified based on the rotational speed according to the speed table and the reference volume specified by the medicine volume-specifying unit exceeds a medicine volume calculated based on a detection signal from the detection unit.

With the configuration, the number of discharged medicines can be correctly detected depending on the medicine shape or the rotational speed of the rotator, preventing insufficient discharging by mistake.

Preferably, according to a slowdown table associating the medicine shape with a number of remaining medicines to be discharged, with which the rotational speed of the rotator starts to be decreased, the control unit decreases the rotational speed of the rotator when a value acquired by subtracting the number of discharged medicines from the number of prescribed medicines in the prescription data reaches the number of remaining medicines to be discharged, which is specified based on the shape specified by the medicine shape-specifying unit.

With this configuration, before discharging of the last medicine, the rotational speed of the rotator can be decreased, thereby preventing discharging of the medicine after stop of the rotator by mistake.

Preferably, the number of remaining medicines to be discharged is varied depending on the medicine shape.

The number of remaining medicines to be discharged may be varied depending on the rotational speed of the rotator.

With the configuration, the speed of the rotator can be decreased with the number of remaining medicines to be discharged, which is suitable for the medicine conveying state, thereby more suitably preventing the medicine from being discharged by mistake after stop of the rotator.

The control unit may decrease the rotational speed of the rotator in multiple stages.

With this configuration, the rotational speed of the rotator can be controlled more finely, thereby achieving efficient discharge while preventing excessive discharge.

Preferably, the control unit reversely rotates the rotator when the number of discharged medicines detected by the detection unit reaches the number of prescribed medicines in the prescription data.

With this configuration, discharge of even medicines that easily move after stop of the rotator can be reliably prevented.

Preferably, a vertically-movable height-restricting member provided above the rotator, and a medicine height-specifying unit configured to specify a reference height of the medicine are further provided, and according to a height correction table associating the medicine shape with a height correction coefficient, the control unit adjusts the position of the height-restricting member on the basis of the height correction coefficient specified based on the shape specified by the medicine shape-specifying unit and the reference height specified by the medicine height-specifying unit.

With this configuration, the medicine can be efficiently discharged by correcting the gap size while restricting the height of the medicine that can be conveyed on the rotator by using the height-restricting member.

Preferably, a width-restricting member provided on an upper face of the rotator so as to be movable in the radial direction of the rotator, and a medicine width-specifying unit configured to specify a reference width of the medicine are further provided, and according to a width correction table associating the medicine shape with a width correction coefficient, the control unit adjusts the position of the width-restricting member on the basis of the width correction coefficient specified based on the shape specified by the medicine shape-specifying unit and the reference width specified by the medicine width-specifying unit.

With this configuration, the medicine can be efficiently discharged by correcting the width while restricting the width of the medicine that can be conveyed on the rotator by using the width-restricting member.

Effect of the Invention

According to the present invention, since the rotational speed of the rotator is set depending on the specified medicine shape, the medicine can be conveyed at the speed suitable for the medicine shape, enabling precise and efficient counting of discharged medicines.

PREFERRED EMBODIMENT

An embodiment of the present invention will be described below with reference to appended figures. In following description, terms representing specific directions and positions (for example, "upper", "lower", "side", "end") are used as necessary. The terms are used to facilitate understanding of the invention with reference to figures, and do not intend to limit the technical scope of the present invention. The following description is illustrative, and does not intend to limit the present invention, and its applications and uses.

(1. Overall configuration)

Figure 1:
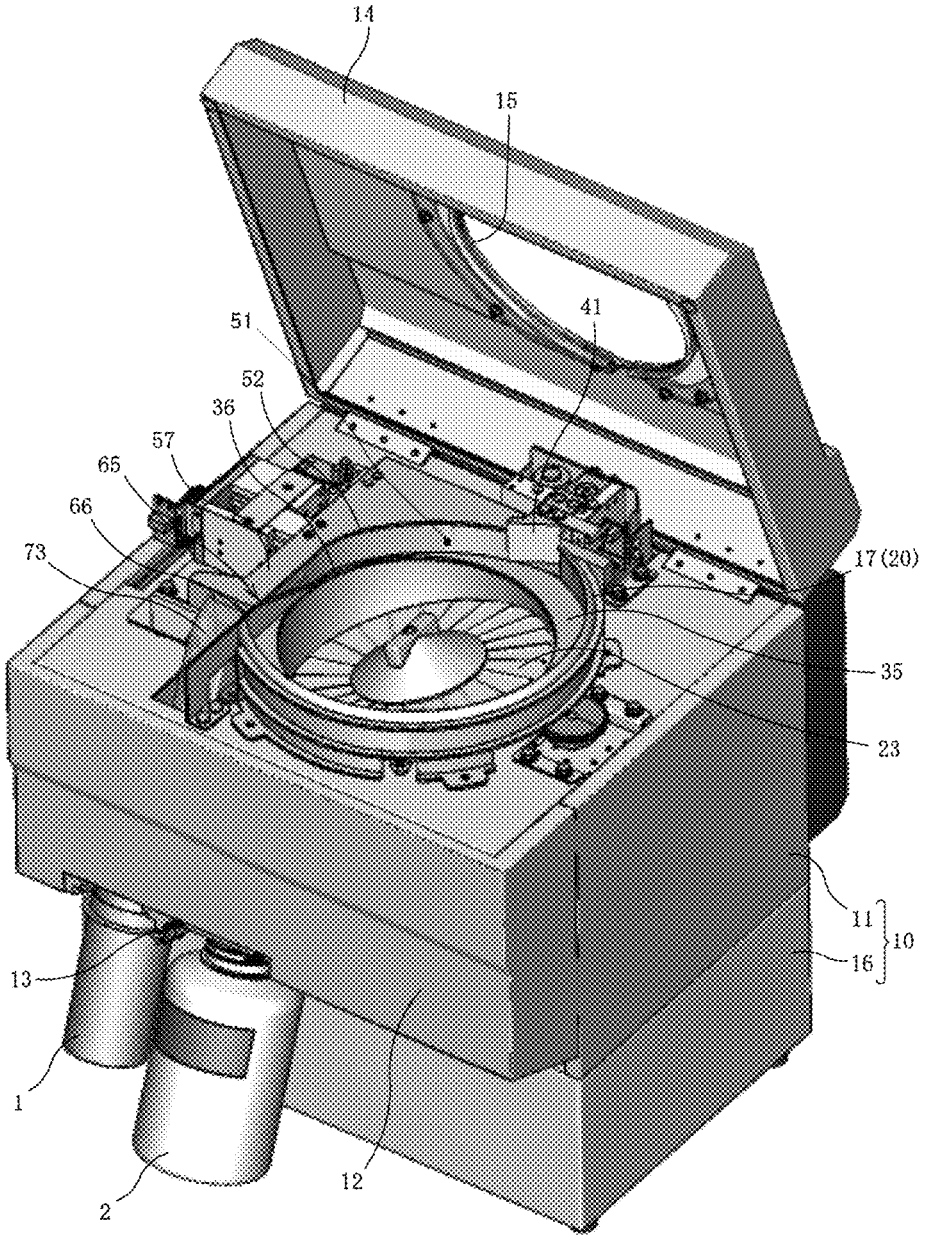
FIG. 1 is a perspective view illustrating a medicine-counting device using a medicine-supplying device according to the present invention.

FIG. 1 illustrates a medicine-counting device in accordance with this embodiment. The medicine-counting device includes a medicine-supplying device, a switch valve unit 76 (See FIG. 8), and a control unit 83 (See FIG. 13), is configured to automatically adjust the mechanism of the medicine-supplying device, supply various medicines of different shapes and sizes one by one, and count the supplied medicines.

Figure 2:
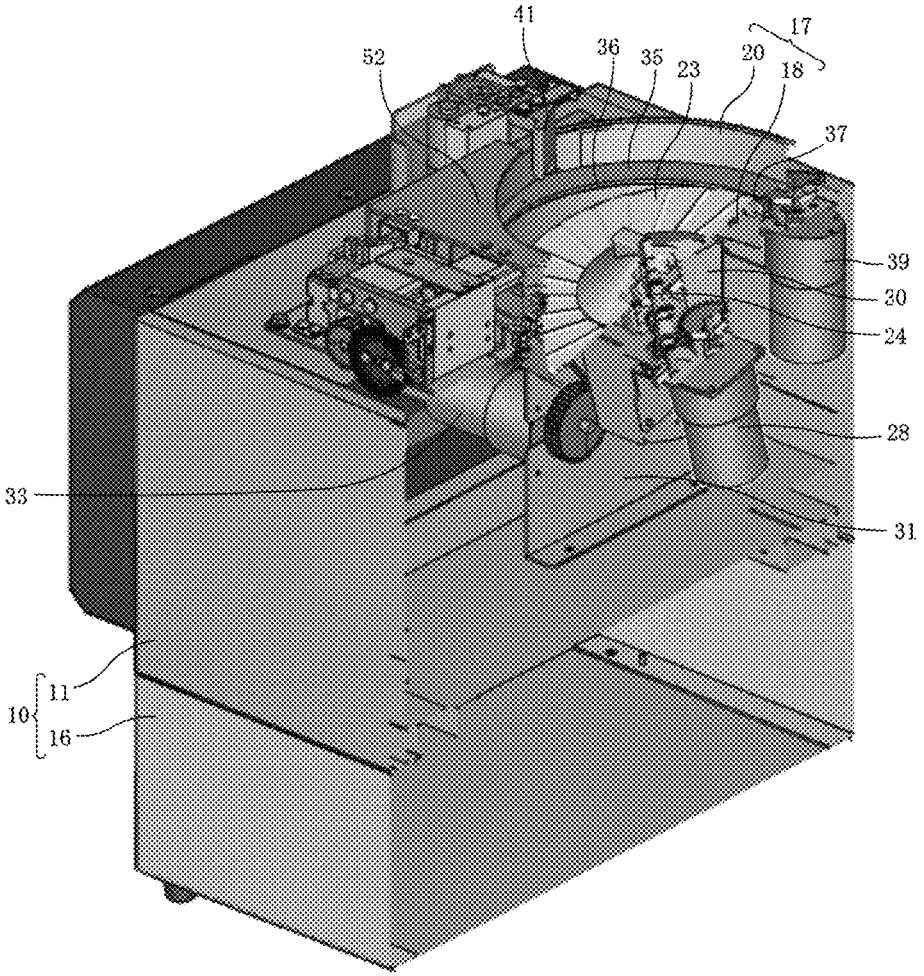
FIG. 2 is a perspective sectional view of a main section in FIG. 1.

As shown in FIG. 1 and FIG. 2, an exterior body 10 of the medicine-supplying device includes an exterior main body 11 located on the upper side and a base 16 located on the lower side. The exterior main body 11 is a housing closed in all directions, and a front cover 12 extends forward further from the base 16. The front cover 12 is provided with a medicine container 1 for the patient and a container attachment part 13 for attaching a collecting container 2 storing medicines thereto. An upper cover 14 is rotatably attached to the rear of the exterior main body 11. The upper cover 14 is provided with an insertion port 15 for exposing the inside of a below-mentioned frame 17. The base 16 is a housing having an opened upper end, on which the exterior main body 11 is placed. The base 16 is used as needed to dispose the exterior main body 11 at a predetermined height such that the containers 1 and 2 attached to the exterior main body 11 do not contact a desk or the like as a plane where the device is placed.

(1-1. Drug-Supplying Device)

Figure 3:
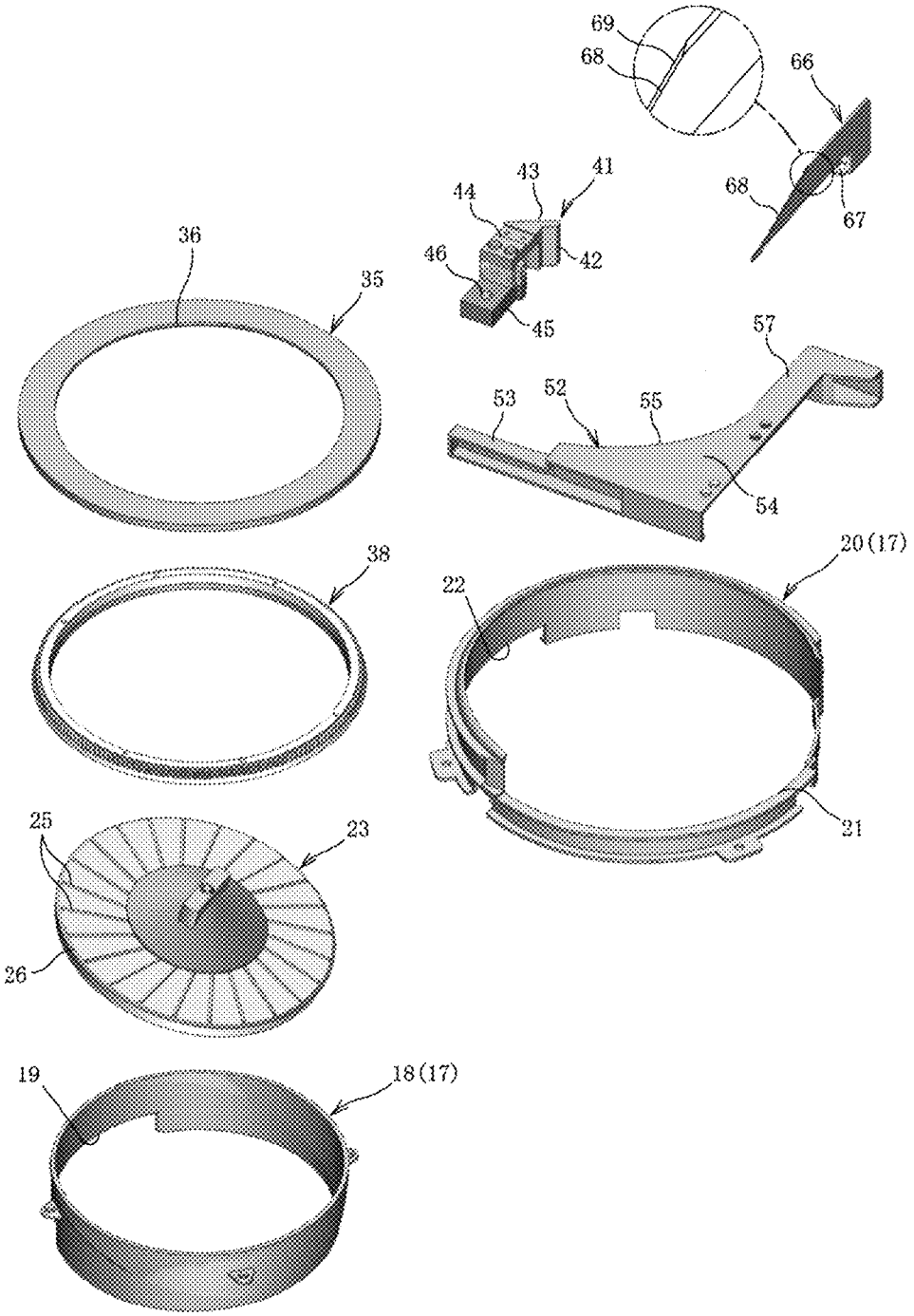
FIG. 3 is an exploded perspective view illustrating each rotator and each restricting body.

As shown in FIG. 3, the medicine-supplying device includes a substantially cylindrical frame 17, a disc-like first rotator 23, an annular second rotator 35, a height-restricting body 41 for restricting the height of supplied medicines, and a width-restricting body 52 for restricting a conveyance width of the second rotator 35. The width-restricting body 52 is a resin molded piece and is formed integral with an outer guide 57. An inner guide 66 and the outer guide 57 of the width-restricting body 52 constitute a medicine guiding part 65 (See FIG. 1).

(1-1-1. Frame)

Figure 4:
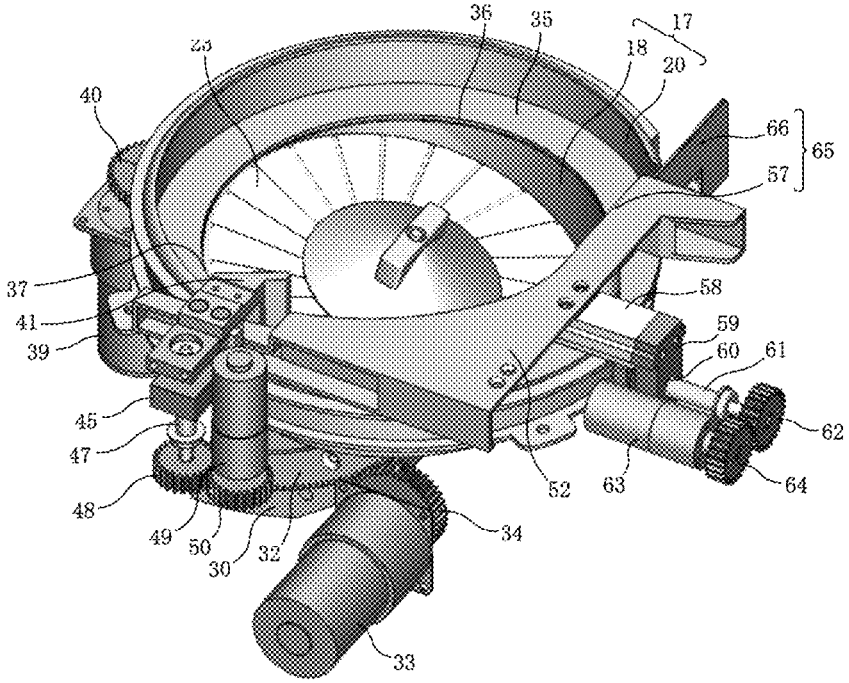
FIG. 4 is a perspective view illustrating the configuration of the medicine-supplying device.
Figure 5:
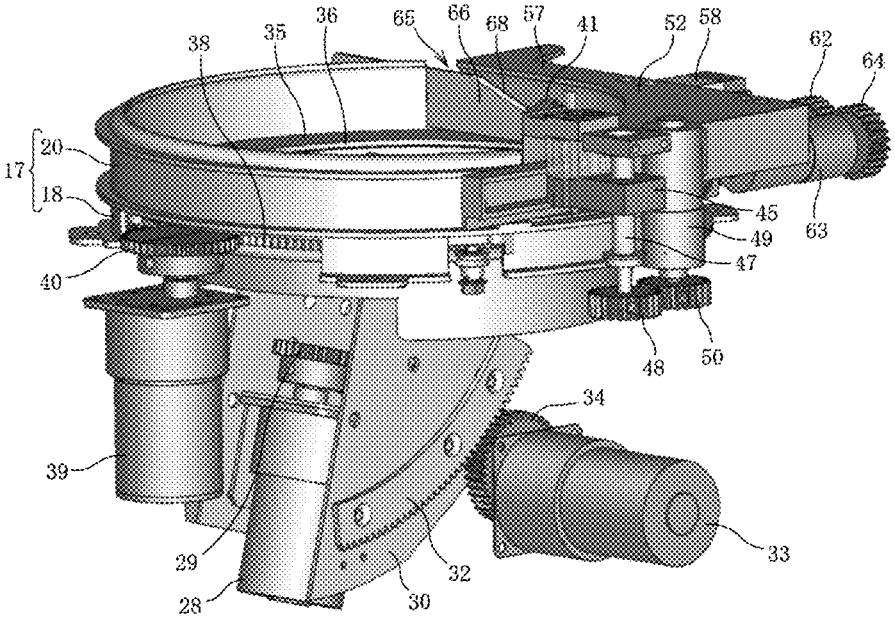
FIG. 5 is a perspective view of the medicine-supplying device when viewed from another direction.

As shown in FIG. 3, FIG. 4, and FIG. 5, the frame 17 has a partition wall 18 that covers the outer circumference of the first rotator 23 and an outer wall 20 that covers the outer circumference of the second rotator 35. These walls are fixed to the upper side and the lower side of an upper plate of the exterior main body 11. The partition wall 18 is a substantially cylindrical wall that extends from an inner circumference 36 of the second rotator 35 to the outer circumference of the first rotator 23, and serves as a partition between the circumferences. A notch 19 for preventing interference of a rotating bracket 30 that fixes a first driving motor 28 of the first rotator 23 is formed partially in a lower part of the outer circumference of the partition wall 18. The outer wall 20 is a cylindrical wall preventing drop-off of a medicine on the second rotator 35. The outer wall 20 has a first notch 21 in the upper part of the outer circumference and a second notch 22 partially in the lower part of the outer circumference. The first notch 21 serves to expose the second rotator 35 and receive the width-restricting body 52 and the medicine guiding part 65. The second notch 22 serves to expose a gear member 38 of the second rotator 35 from the side. In the frame 17, the partition wall 18 may be integral with the outer wall 20.

(1-1-2. First Rotator)

Figure 6A:
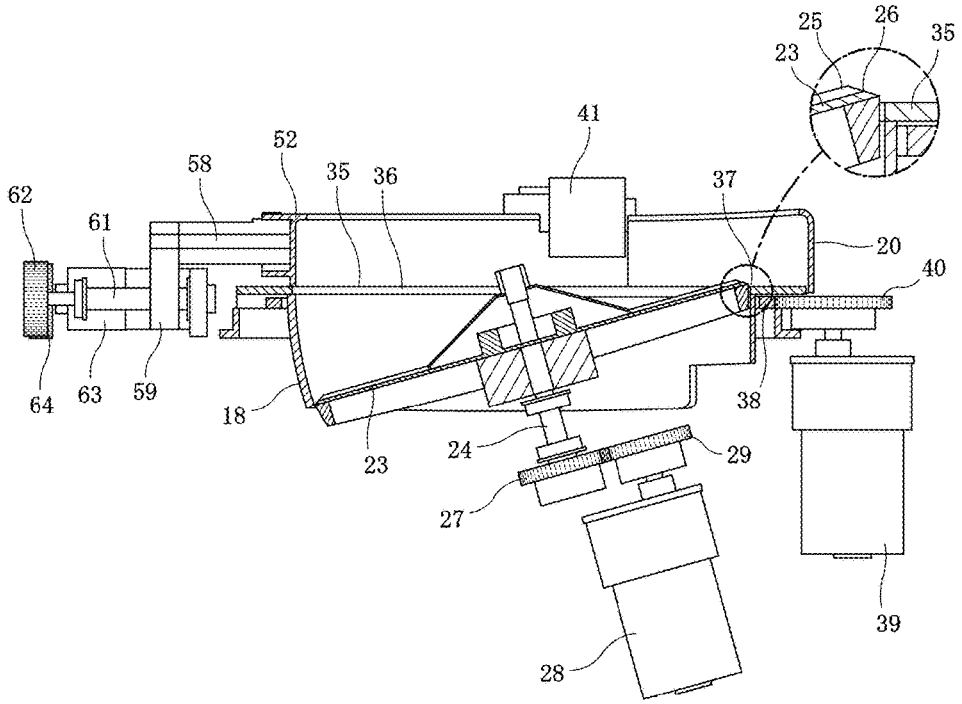
FIG. 6A is a sectional view illustrating the configuration of the medicine-supplying device.
Figure 6B:
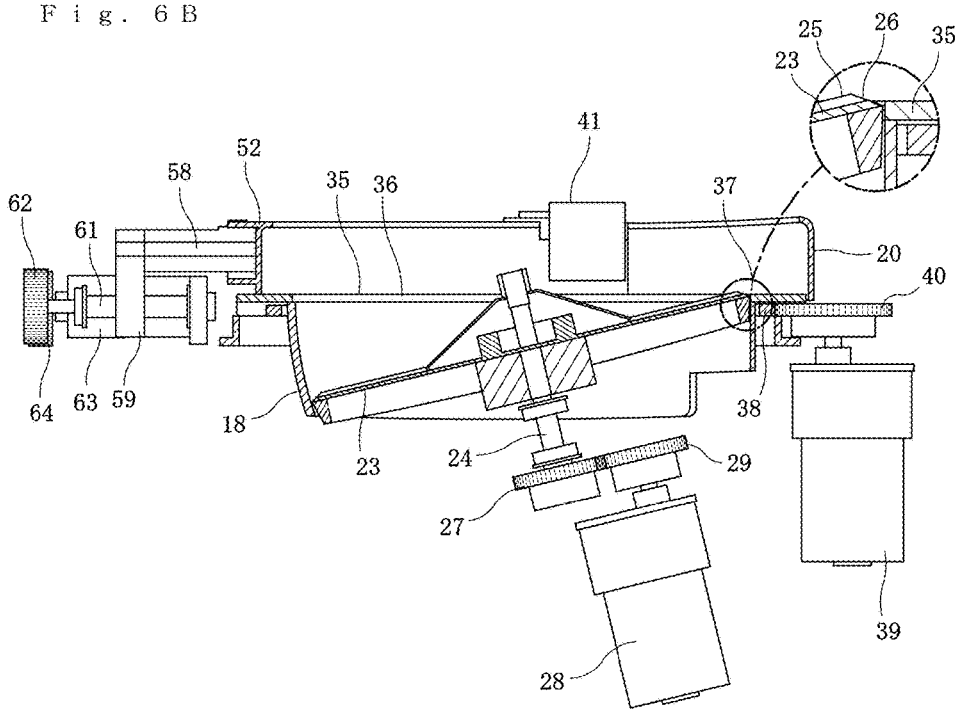
FIG. 6B is a sectional view illustrating the medicine-supplying device with each member being adjusted in position.

The first rotator 23 is disc-like, and is tilted in the partition wall 18 so as to close the bottom of the partition wall 18. That is, as shown in FIGS. 6A and 6B, the first rotary shaft 24 of the first rotator 23 is tilted at a predetermined angle relative to the vertical direction. The upper face of the first rotator 23 has a plurality of radial projections 25 for resisting movement of medicines (rolling prevention). The outer circumference of the first rotator 23 has a tilted part 26 tilted downward toward the radial outer side. The tilted part 26 is arranged at a predetermined tilt angle such that its upper inner edge is located above the second rotator 35 and its lower outer edge is located below the inner edge.

A gear 27 is coupled to the lower end of the first rotary shaft 24 of the first rotator 23. The gear 27 engages with a gear 29 coupled to an output shaft of the first driving motor 28 so as to be rotatable about the first rotary shaft 24. The first rotary shaft 24 and the first driving motor 28 are attached to the rotating bracket 30 (See FIG. 5). A bearing for a guide not shown is formed on a side face of the rotating bracket 30, and engages with a guide groove of an attachment bracket 31 fixed to the exterior main body 11 (See FIG. 2). As shown in FIG. 4 and FIG. 5, an arcuate gear piece 32 is fixed to a side face of the rotating bracket 30. The gear piece 32 engages with a gear 34 of an angle-adjusting motor 33 as an angle-adjusting means. Driving the angle-adjusting motor 33 rotates the rotating bracket 30 with respect to the attachment bracket 31. Rotating the rotating bracket 30 causes rotation of the first rotator 23 along with the first driving motor 28, adjusting the tilt angle of the first rotator 23.

(1-1-3. Second Rotator)

The annular second rotator 35 is rotatably disposed on the upper end of the partition wall 18 so as to be located above the first rotator 23. As shown in FIGS. 6A and 6B, the second rotator 35 is horizontally disposed such that a second rotary shaft not shown vertically extends. Thus, the second rotary shaft of the second rotator 35 and the first rotary shaft 24 of the first rotator 23 extend in different (non-parallel and non-identical) directions and cross each other. The angles of the rotary shafts can be relatively changed by driving the angle-adjusting motor 33 as described above. When viewed in the axial direction of the second rotary shaft, the second rotator 35 is located outside of the first rotator 23, and the first rotator 23 is located inside of the inner circumference 36. The outer circumference of the first rotator 23 is lower than the inner circumference 36 of the second rotator 35 due to the tilt of the first rotator 23, forming a predetermined step height therebetween. Because of the tilt of the first rotator 23, the step height becomes the largest at the vertically lower end on the left in the figures and becomes the smallest at the vertically upper end on the right in the figures. The part with the smallest step height constitutes a moving part 37 for moving medicines supplied to a storage space defined by the first rotator 23 and the partition wall 18 from the first rotator 23 to the second rotator 35 through rotation of the first rotator 23. The moving part 37 in this embodiment is configured such that the inner circumference 36 of the second rotator 35 and the outer circumference of the first rotator 23 have a gap therebetween dimensioned so as not to make medicines fall off, and are on the substantially same level. However, the inner circumference 36 of the second rotator 35 may be higher or lower than the outer circumference of the first rotator 23 in the moving part 37 as long as medicines can be moved from the first rotator 23 to the second rotator 35.

As shown in FIG. 3 and FIG. 5, an annular gear member 38 is fixed to the lower face of the second rotator 35. The gear member 38 engages with a gear 40 of a second driving motor 39 as a second driving means through the second notch 22 of the outer wall 20. The outer circumference of the gear member 38 is supported by a support member not shown. Thus, an upper rotating member rotates about the second rotary shaft without moving along the second rotary shaft.

(1-1-4. Height-Restricting Body)

Figure 7A:
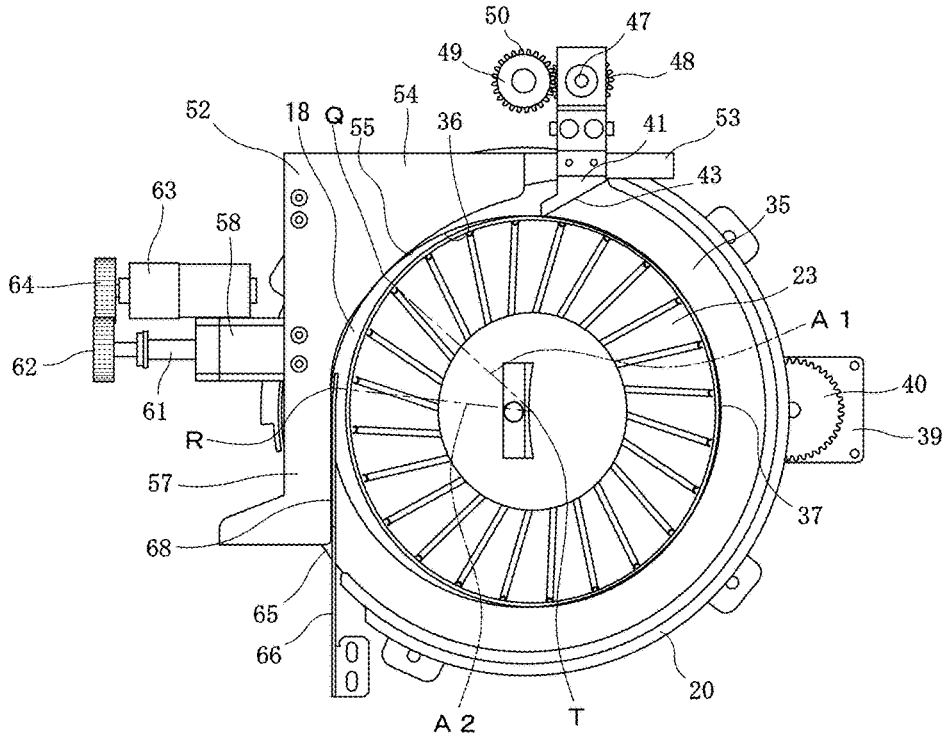
FIG. 7A is a plan view illustrating the configuration of the medicine-supplying device.
Figure 7B:
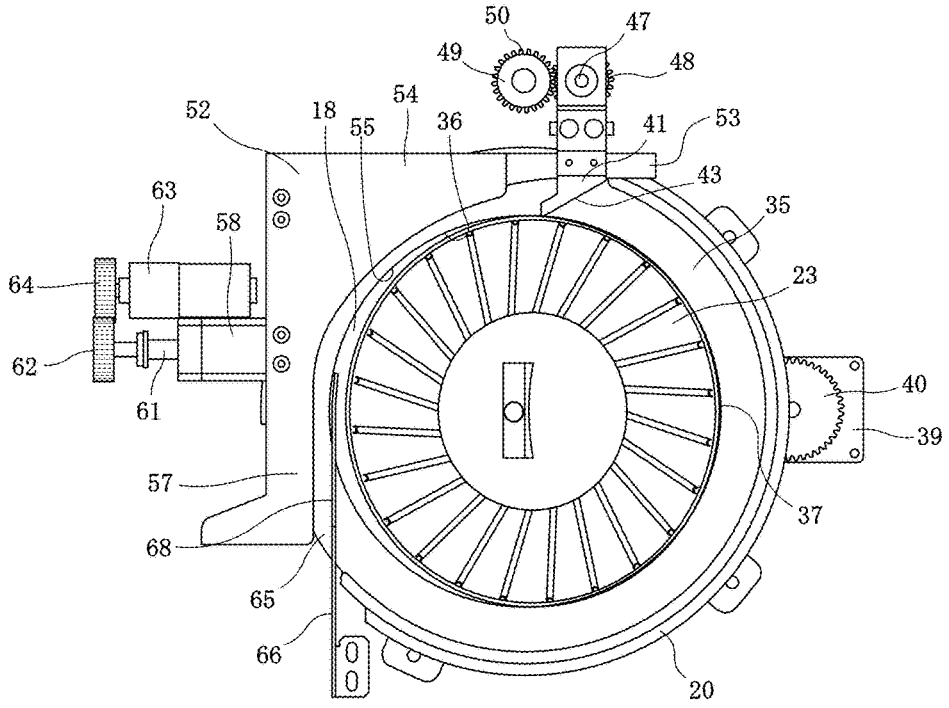
FIG. 7B is a plan view illustrating the state where the position of a width-restricting body is adjusted.

As shown in FIG. 3, the height-restricting body 41 includes a height-restricting member 42, an arranging member 44, and a power receiving member 45, and is disposed downstream from the moving part 37 of the second rotator 35 in the rotating (medicine conveying) direction and above the second rotator 35 as shown in FIGS. 7A and 7B. The height-restricting member 42 extends from the outer circumference to the inner circumference 36 of the second rotator 35, and has a guide face 43 tilted at a predetermined angle in the medicine conveying direction. The arranging member 44 is coupled to the height-restricting member 42, and causes the height-restricting member 42 to be arranged on the second rotator 35 across the width-restricting body 52. The power receiving member 45 is coupled to the arranging member 44, and receives power to vertically move the height-restricting member 42 via the arranging member 44. The power receiving member 45 has a vertically penetrating screw hole 46 for receiving power (See FIG. 3).

A screw member 47 penetrates the screw hole 46 of the height-restricting body 41. The screw member 47 is supported rotatably and unmovably in the axial direction with a bracket fixed to the upper plate of the exterior main body 11. A gear 48 is coupled to a lower end of the screw member 47. The gear 48 engages with a gear 50 of a height-adjusting motor 49 as a height-adjusting means. The height-adjusting motor 49 rotates the screw member 47, thereby height-adjusting a distance between the height-restricting body 41 and the upper face of the second rotator 35 to become about the same height as a medicine. A medicine-detecting sensor 51 for detecting medicines passing below the height-restricting body 41 is arranged downstream from the height-restricting body 41.

(1-1-5. Width-Restricting Body)

The width-restricting body 52 is disposed above the second rotator 35 downstream from the height-restricting body 41 in the medicine conveying direction. The width-restricting body 52 has a rectangular part 53 extending tangent to the outer circumference of the second rotator 35. Since the arranging member 44 of the height-restricting body 41 bypasses the rectangular part 53, the rectangular part 53 can reciprocate its longitudinal direction without interfering with the arranging member 44. In the width-restricting body 52, a width-restricting part 54 is connected to the downstream side of the rectangular part 53 in the medicine conveying direction. The width-restricting part 54 includes a first curved face 55 having a larger diameter than the inner circumference 36 of the second rotator 35. Thus, the distance between the first curved face 55 and the inner circumference 36 of the second rotator 35 partially becomes the narrowest in the circumferential direction. A width between the inner circumference 36 of the second rotator 35 and the first curved face 55, with which a medicine can pass (the narrowest width between the inner circumference 36 of the second rotator 35 and the first curved face 55) is defined as a conveyance width. In the width-restricting body 52, the outer guide 57 constituting the medicine guiding part 65 is connected to the downstream side of the width-restricting part 54 of the first curved face 55 in the medicine conveying direction. The outer guide 57 extends tangent to the first curved face 55, and extends orthogonal to the rectangular part 53.

The curvature radius of the first curved face 55 may be varied between the upstream side and the downstream side in the medicine conveying direction. Specifically, the curvature radius on the upstream side may be smaller than the curvature radius on the downstream side, and be larger than the curvature radius of the outer edge of the first rotator 23. As shown in FIG. 7A, an angle that a line segment A1 (a line segment connecting a point Q where the distance between the inner circumference 36 of the second rotator 35 and the first curved face 55 is the smallest to a rotational center T of the second rotator) forms with a line segment A2 (a line segment connecting a downstream end R of the first curved face 55 in the medicine conveying direction to the rotational center T) may be in the range of 20 degrees to 70 degrees. This enables smooth discharge of medicines.

A coupling member 58 is coupled to the width-restricting part 54 of the width-restricting body 52 to extend in parallel to the rectangular part 53. As shown in FIG. 4, like the height-restricting body 41, the coupling member 58 is coupled to a power receiving member 59. A screw member 61 penetrates a screw hole 60 of the power receiving member 59. The screw member 61 is supported rotatably and unmovably in the axial direction by a bracket fixed to the upper plate of the exterior main body 11. A gear 62 is coupled to an outer end of the screw member 47. The gear 62 engages with a gear 64 of a width-adjusting motor 63 for horizontally moving the width-restricting body 52. When the width-restricting body 52 is moved outward with respect to the second rotator 35 by using the width-adjusting motor 63, the conveyance width between the width-restricting part 54 and the inner circumference 36 of the second rotator 35 as well as the distance between the outer guide 57 and a below-mentioned inner guide 66 is increased. When the width-restricting body 52 is moved inward with respect to the second rotator 35, the conveyance width of the second rotator 35 and the distance between the guides 57 and 66 is decreased.

In this embodiment, the diameter (curvature radius) of the first curved face 55 of the width-restricting part 54 is set such that the width between the outer guide 57 and the inner guide 66 is twice (2W) as large as the conveyance width W between the width-restricting part 54 and the inner circumference 36 of the second rotator 35. The conveyance width W is set to ½ of the width of a conveyed medicine. For elliptical and oval medicines in a plan view, the medicine width is the width in the lateral direction. The conveyance width W is not limited to ½ of the medicine width, and is preferably, ½ of the medicine width or more and the medicine width or less.

The medicine guiding part 65 serves to guide medicines passing the width-restricting part 54 of the width-restricting body 52 to a below-mentioned medicine-dispensing member 73 as a medicine discharge port. As shown in FIG. 3 and FIGS. 7A and 7B, the medicine guiding part 65 is arranged above the second rotator 35 so as to be located downstream from the width-restricting part 54 of the width-restricting body 52 in the medicine conveying direction. The inner guide 66 constituting the medicine guiding part 65 is parallel to the outer guide 57 on the inner side of the second rotator 35 in the radial direction, and extends tangent of the inner circumference 36 of the second rotator 35. The inner guide 66 extends toward the medicine-dispensing member 73, and has a bracket 67 fixed to the upper plate portion of the exterior main body 11 at its end. The distance between the guides 57 and 66 constituting the medicine guiding part 65 is adjusted to be substantially same as the medicine width through driving of the width-adjusting motor 63. The inner guide 66 is provided with a tilted edge 68 tilted upward at a predetermined angle, in the step height between the first rotator 23 and the second rotator 35. An inner face of the tilted edge 68 is a downwardly-tilted tilted face 69 (tilted face 69 of the tilted edge 68 is tilted downward toward the rotary shaft of the second rotator 35).

Figure 8:
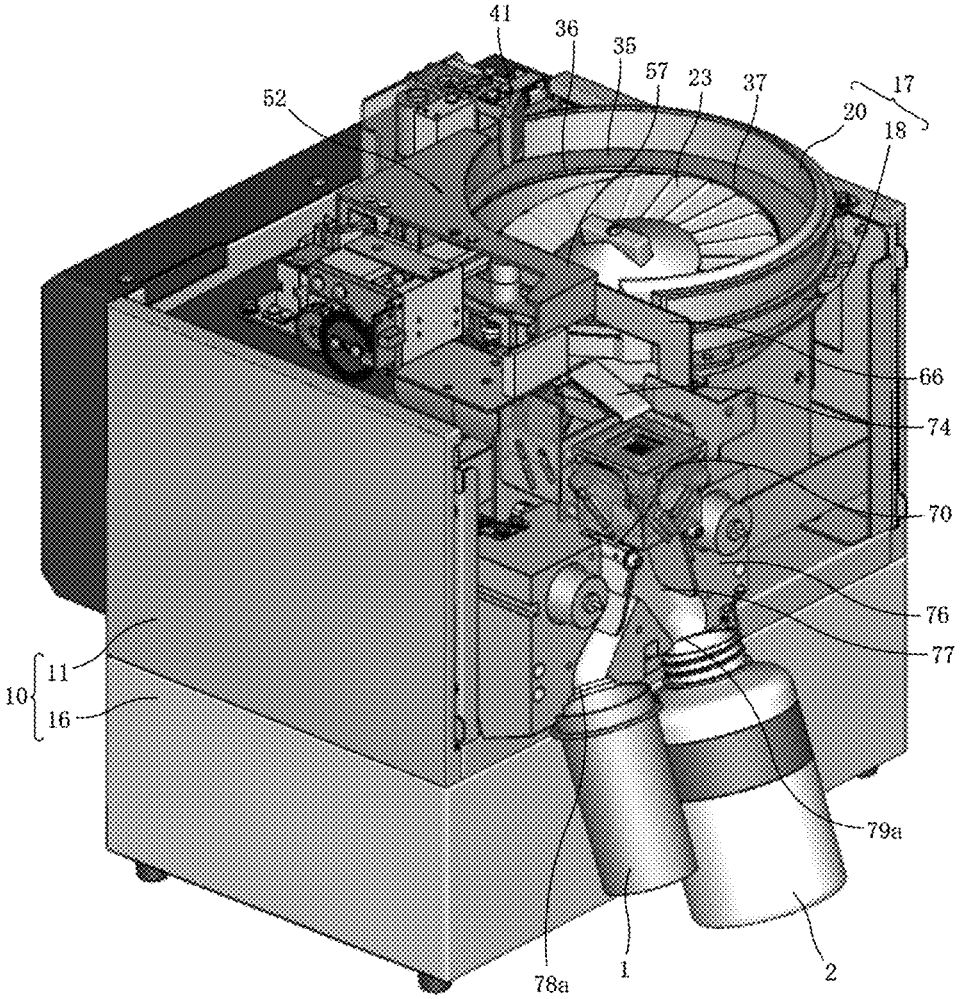
FIG. 8 is a perspective view illustrating a switch valve unit of the medicine-counting device.

In the medicine-counting device, as shown in FIG. 8, a medicine-detecting unit 70 for detecting medicines, a shutter 74 for blocking discharging of medicines to the medicine-detecting unit 70, and the switch valve unit 76 for distributing medicines passing the medicine-detecting unit 70 are arranged below the medicine-dispensing member 73 arranged at an outlet of the medicine guiding part 65. The medicine-dispensing member 73 constitutes a medicine discharge port provided outside of the second rotator 35 in the radial direction, and guides medicines discharged from the medicine guiding part 65 to the medicine-detecting unit 70.

Figure 9A:
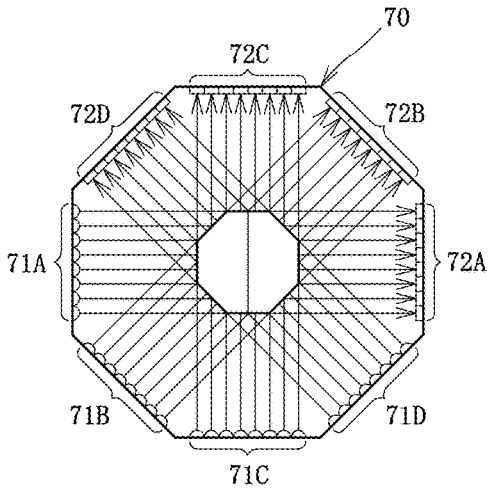
FIG. 9A is a conceptual view of a detection unit for detecting discharged medicines.
Figure 9B:
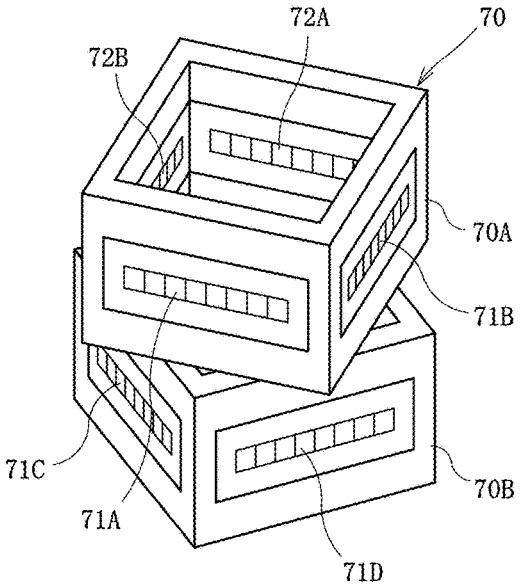
FIG. 9B is a perspective view of the detection unit for detecting the discharged medicines.

As shown in FIG. 9B, the medicine-detecting unit 70 as a second medicine detector has s pair of regular quadrangular cylindrical housings 70A and 70B. A pair of light-emitting parts 71A and 71B are arranged on adjacent faces of the upper housing 70A, and a pair of light-receiving parts 72A and 72B are arranged on opposite faces to the adjacent faces. A pair of light-emitting parts 71C and 71D are arranged on adjacent faces of the lower housing 70B, and a pair of light-receiving parts 72C and 72D are arranged on opposite faces to the adjacent faces. Pairs of opposed light-emitting part 71A and light-receiving part 72A, the opposed light-emitting part 71B and light-receiving part 72B, the opposed light-emitting part 71C and light-receiving part 72C, and the opposed light-emitting part 71D and light-receiving part 72D each constitute a set of optical sensor (line sensor). The two sets of optical sensors (four in total) in each of the two housings 70A and 70B are located at a predetermined interval in the axial direction. The housings 70A and 70B are shifted in phase from each other by 45 degrees, thereby achieving different detecting directions. As compared to a regular octagonal housing capable of including four sets of optical sensors (See FIG. 9A), the medicine-detecting unit 70 thus configured can be miniaturized in a plan view (occupied area).

The shutter 74 is disposed on the inner side of an outlet of the medicine-dispensing member 73. The shutter 74 can rotate between a horizontally-extending discharge stopping position and a downwardly-tilted discharge permitting position by a driving motor 75. At the discharge stopping position, the shutter 74 closes the outlet of the medicine-dispensing member 73 to prevent discharge of medicines into the medicine-detecting unit 70. At the discharge permitting position, the shutter 74 opens the outlet of the medicine-dispensing member 73 to permit discharge of medicines into the medicine-detecting unit 70.

(1-2. Switch Valve Unit)

Figure 10A:
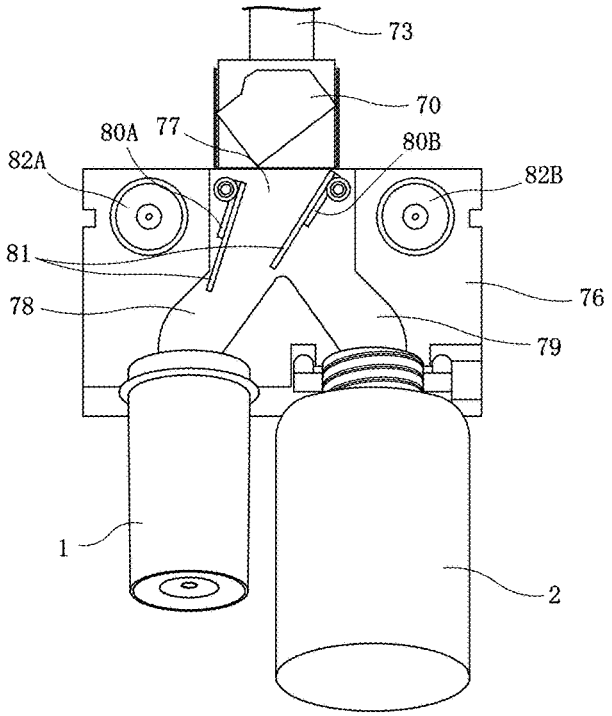
FIG. 10A is a front view illustrating the state where medicines are being dispensed into a medicine container.

As shown in FIG. 10A, the switch valve unit 76 is disposed at the container attachment part 13 of the exterior main body 11 below the medicine-detecting unit 70. A casing of the switch valve unit 76 has an inverted Y-like medicine passage 77 branching into a dispensing part 78 as a first passage and a collecting part 79 as a second passage. A switch valve for switching a discharge destination between the dispensing part 78 and the collecting part 79 is provided in the medicine passage 77. The switch valve in this embodiment has a pair of pivoting members 80A and 80B extending from an inlet of the medicine passage 77 toward the dispensing part 78 and the collecting part 79, respectively. In the figure, the left first pivoting member 80A opens and closes the dispensing part 78, and the right second pivoting member 80B opens and closes the collecting part 79. The pivoting members 80A and 80B are provided with respective elastically deformable elastic parts 81 on their opposed faces. The pivoting members 80A and 80B are independently pivoted with driving motors 82A and 82B as driving means. In this embodiment, the pivoting members can move to three positions: a medicine-dispensing position (first operating position) in FIG. 10A, a suspending position (second operating position) in FIG. 10B, and a medicine collecting position (third operating position) in FIG. 10C. At the suspending position, the pivoting members 80A and 80B are rotated such that the elastic parts 81, 81 contact with each other and elastically deform. The pivoting members 80A and 80B may be made of an elastically deformable material.

Figure 11A:
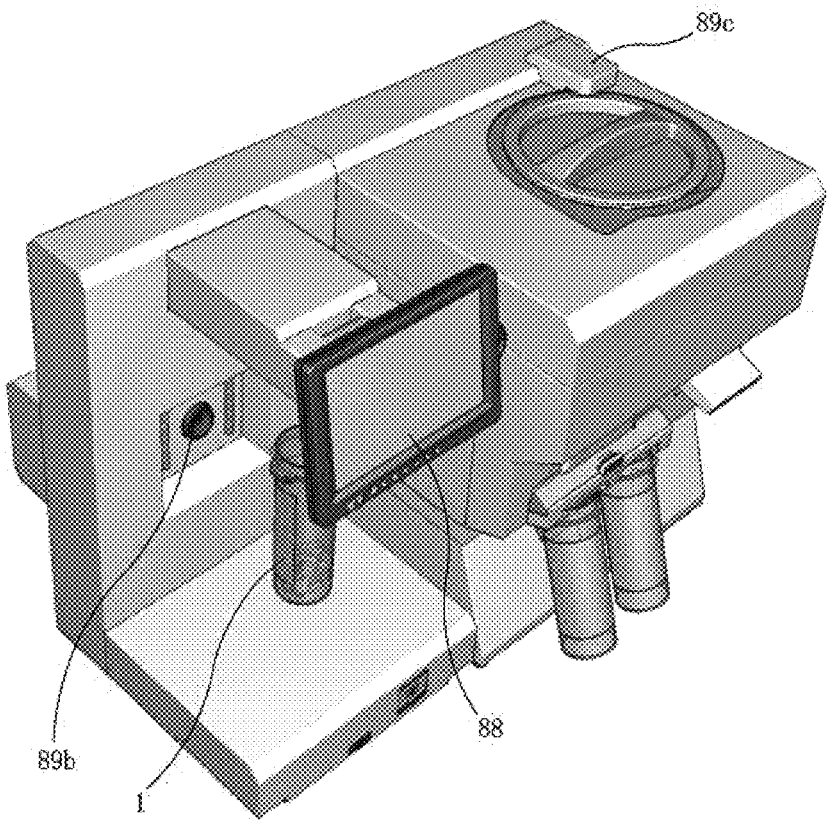
FIG. 11A is a perspective view of a medicine-counting device provided with an inspection table in a modification example when viewed from obliquely upward.
Figure 11B:
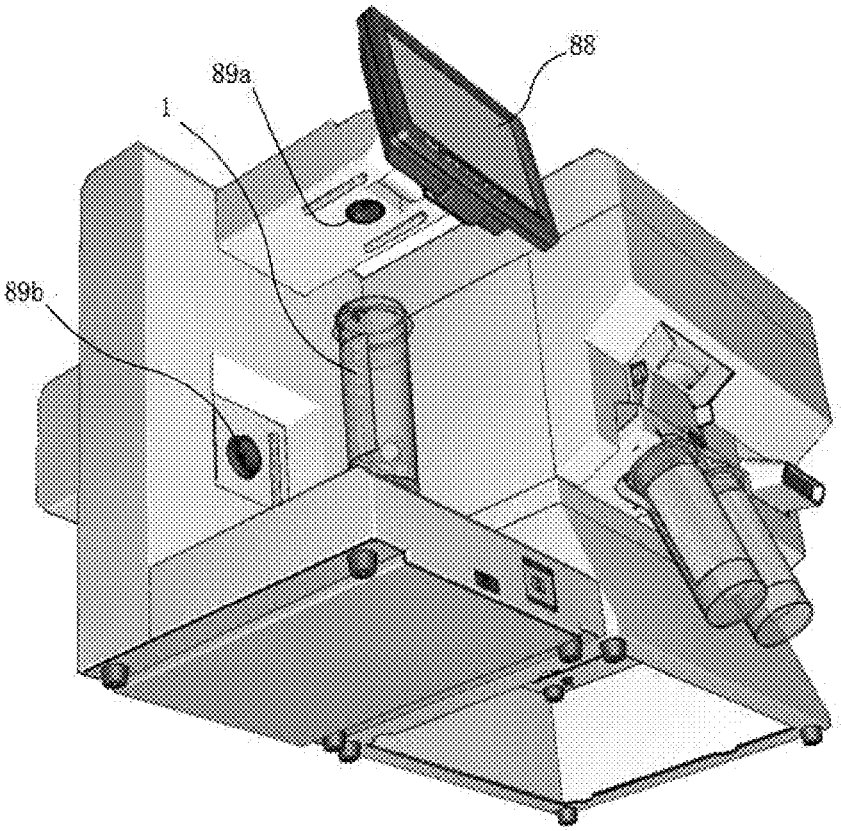
FIG. 11B is a perspective view of the medicine-counting device provided with the inspection table in a modification example when viewed from obliquely downward.

As shown in FIGS. 11A and 11B, an inspection table is added to the medicine-counting device. The inspection table is provided with a monitor 88, a first camera 89*a* for imaging inner medicines from above an opening of the medicine container 1 dispensing medicines, and a second camera 89*b* for imaging a label on a side of the medicine container 1. The monitor 88 displays an image taken with the first camera

89*a*, the second camera 89*b* and a third camera 89*c* which is provided in the vicinity of the medicine insertion port of the medicine-counting device and images the surroundings of the moving part 37 or the height-restricting body 41 from the first rotator 23 to the second rotator 35. The first camera 89*a* may be movable to perform the function of the third camera 89*c*, thereby eliminating the third camera 89*c*.

(1-3. Control Unit)

Figure 13:
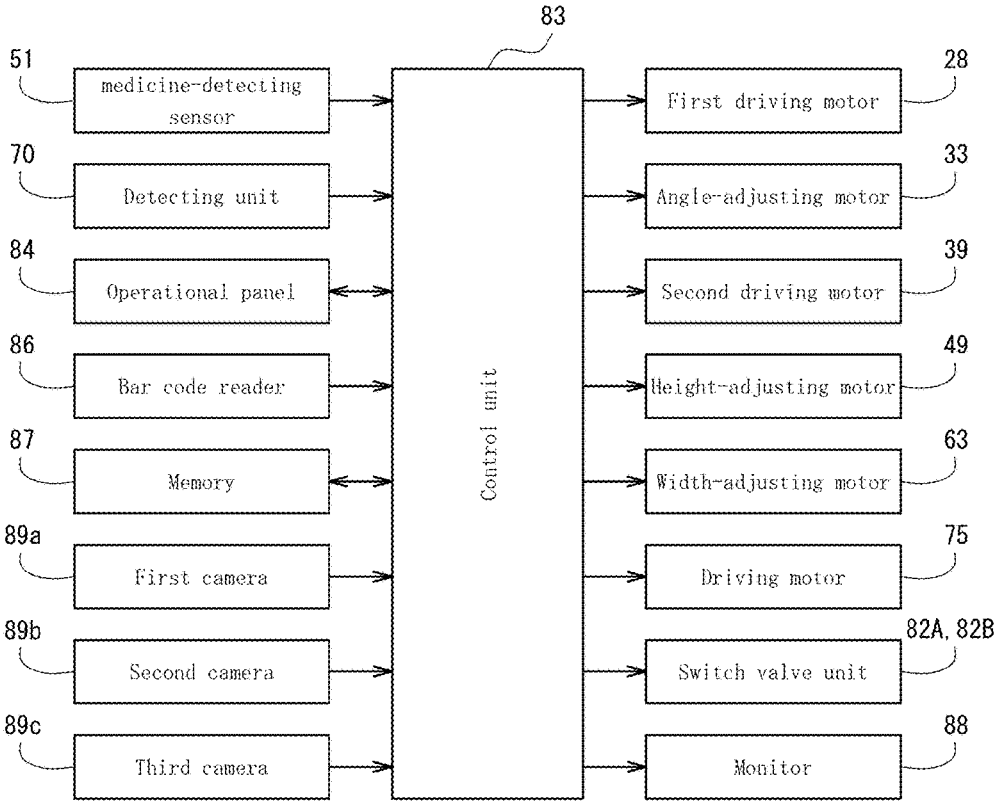
FIG. 13 is a block diagram illustrating the configuration of the medicine-counting device.

The medicine-counting device including the medicine-supplying device operates according to an instruction of the control unit 83 as shown in FIG. 13. In response to an input from an operational panel 84 (here, a touch panel) and detection signals from the medicine-detecting sensor 51 and the medicine-detecting unit 70, the control unit 83 invokes a program and data in a memory 87 and runs the program, thereby controlling driving of the switch valve units 82A and 82B and various motors 28, 33, 39, 49, 63, and 75, counting and supplying the necessary number of medicines according to prescription data. The operational panel 84 and the monitor 88 may share a touch panel, and both use the touch panel in this embodiment.

The memory 87 stores various data including prescription data issued by the doctor, medicine data (medicine name, medicine ID, effect, etc.), patient data (patient name, patient ID, etc.), and various data tables therein. Examples of the various data tables include a correction table, an SP (Speed) table, an SD (SlowDown) table, a medicine volume coefficient table, a foreign-material volume coefficient table. The various data may be stored in a storage means (hard disc, memory, or other storage medium) of any device communicably connected to the medicine-supplying device, in place of the memory 87.

Figure 44A:
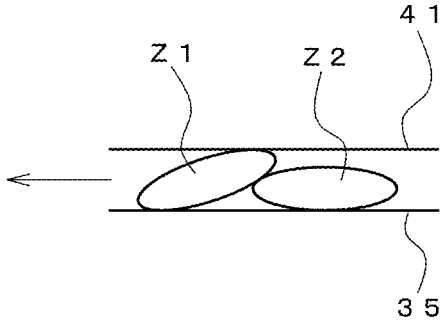
FIG. 44A and FIG. 44B are schematic views illustrating the position of medicines passing between a height-restricting body and a second rotator.
Figure 44B:
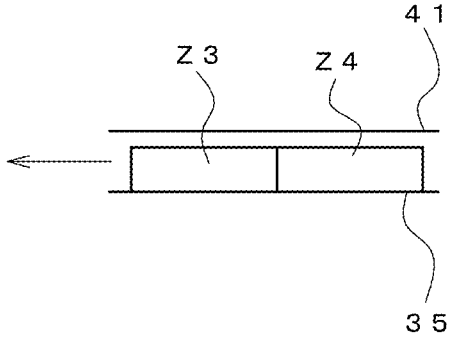

The correction table shows a correction ratio with respect to a provisional height-restricting position and a provisional width-restricting position, which is determined by below-mentioned automatic adjusting processing. The correction ratio is used to increase a gap between the height-restricting body 41 located at the provisional height-restricting position and the second rotator 35, and a gap between the outer guide 57 formed integral with the width-restricting body 52 located at the provisional width-restricting position and the inner guide 66, with respect to the medicine size, by a constant ratio, thereby providing a margin for each gap to allow the medicine to pass without any problem. The correction ratio defined in the correction table may be changed depending on the medicine shape. This is due to that even medicines having the same width and height have varying optimal gap depending on the shape. In the case where the gap between the height-restricting body 41 and the second rotator 35 or the gap between the outer guide 57 and the inner guide 66 is large, as shown in FIG. 44A, spheroidal medicines are unstable in position and thus, easily tilt during passage through the gap. For example, as shown in FIG. 44A, when a medicine Z1 on the downstream side in the medicine conveying direction tilts while a plurality of medicines are passing through a gap, an upstream medicine Z2 in the medicine conveying direction may move under the medicine Z1, resulting in that the medicine Z1 further tilts and contacts the second rotator 35 and the height-restricting body 41 to slow down. On the contrary, as shown in FIG. 44B, since box-like medicines Z3 and Z4 are stable in position, even when the gap is large, the medicines hardly tilt and slow down. For this reason, for such spheroidal medicines that are unstable in position, the correction ratio so as to make the margin for the gap small is preferably set in the correction table.

The SP table is provided for each of medicines of different shapes. As shown in Table 1, in each table, the rotational speed of the second rotator 35 is set for (associated with) an interval between medicines sequentially detected by the medicine-detecting unit 70. For medicines of certain shape, the rotational speed of the second rotator 35 may be predetermined through an experiment such that the medicine interval becomes a desired constant value. Even when the detected medicine interval is the same, different medicine shapes may be associated with different rotational speeds of the second rotator 35.

TABLE 1

| | x | |
|---|---|---|
| | | Second Rotator Rotational Speed |
| Drug Interval | K1 | S1 |
| | K2 | S2 |
| | K3 | S3 |
| | . . . | . . . |
| | . . . | . . . |

Ka (a=1, 2, . . . ): medicine interval

Sb (b=1, 2, . . . ): rotational speed of the second rotator 35 (For example, S1 is different from S2)

In the SP table, the rotational speed of the second rotator 35 is set depending on the medicine shape. However, the rotational speed of the second rotator 35 may be set such that the medicine interval detected by the medicine-detecting unit 70 becomes a desired value (range) based on differences thereof. Specifically, the rotational speed of the second rotator 35 may be increased with an increase in the medicine interval, and be set such that the medicine interval (time required from detection of one medicine to detection of a next medicine in the detecting unit 70) becomes the desired value (range) when the second rotator 35 is rotated at the rotational speed. Each value (range) may be predetermined through an experiment or the like. This can advantageously set the medicine interval directly to the desired value (range).

In the SD table, setting (associating) is performed depending on the medicine shape, and in each SD table, the number of remaining medicines to be discharged, with which the rotational speed of the second rotator 35 starts to be decreased, is set depending on the range of the interval between medicines sequentially detected by the medicine-detecting unit 70. Table 2 is an SD table in which the rotational speed of the second rotator 35 is decreased in two stages. The SD table includes the number of remaining medicines to be discharged used next time in the case where the number of actually discharged medicines (for example, may be calculated based on a measured weight of the medicine container 1 or acquired directly from a detection result of the medicine-detecting unit 70) exceeds a prescribed number contained in prescription data irrespective of the decrease in the rotational speed of the second rotator 35 at the predetermined number of remaining medicines to be discharged. That is, N(1) in Table 2 is used first time, and N(2) is used when the prescribed number does not match the actual discharged number at the first discharge, and N(3) is used when the prescribed number does not match the actual discharged number at the second discharge (The same applies hereafter).

TABLE 2

| x | | | | | | | | |
|---|---|---|---|---|---|---|---|---|
| | | Number of Remaining Drugs to be Discharged | | | | | | |
| | | N(1) | | N(2) | | N(3) | | . . . |
| Drug Interval | D1 | N(1)1-1 | N(1)1-2 | N(2)1-1 | N(2)1-2 | N(3)1-1 | N(3)1-2 | . . . . . |
| | D2 | N(1)2-1 | N(1)2-2 | N(2)2-1 | N(2)2-2 | N(3)2-1 | N(3)2-2 | . . . . . |
| | . . . | . . . | . . . | . . . | . . . | . . . | . . . | . . . . . |

Dx1 (x1=1, 2, . . . ): medicine interval (As the value of x1 is larger, the interval becomes larger). Each row represents a range of values larger than each interval. Specifically, D1 corresponds to a range of D1 or less, and D2 corresponds to a range of D1 to D2.

N(x2)x3-1, x3-2 (x2, x3=1, 2, . . . ): the number of remaining medicines to be discharged (As the value of x2, x3 is larger, the number of remaining medicines to be discharged becomes larger. The FIGS. 1, 2 connected to x3 via a hyphen means that the rotational speed of the second rotator 35 is decreased in two stages, and x3-2 is set to a slower value than the x3-1).

The SD table is set depending on the medicine shape and however, may be set depending on the rotational speed of the second rotator 35.

As shown in Table 3, in medicine volume coefficient table, setting (associating) is performed depending on the medicine shape. In detecting a medicine passing the medicine-detecting unit 70, an actually-measured value (volume of the medicine detected by the medicine-detecting unit 70) is different from the actual medicine volume. Thus, a medicine volume coefficient for correcting the difference is set (In Table 3, a right table and a left table show lists of respective medicine volume coefficients of medicines of different shapes). That is, a volume (calculated value) found by multiplying a below-mentioned medicine reference volume by the medicine volume coefficient set depending on the rotational speed of the second rotator 35 is a maximum value determined to be one medicine. For example, since it is more difficult to determine the number of medicines as the interval between the medicines passing the medicine-detecting unit 70 is smaller, a small value is adopted as the medicine volume coefficient. When the actually-measured value exceeds the calculated value found by multiplying the reference volume by the medicine volume coefficient, the number of medicines is determined to be two.

The reference volume is a value measured by the medicine-detecting unit 70 for a newly handled medicine, the volume of which is not stored in the storing unit (memory 87), and is a value stored in the storing unit (memory 87) for a previously handled medicine. In the case of using the medicine volume measured by the medicine-detecting unit 70 as the medicine volume, the medicine-detecting unit 70 and the control unit 83 that calculates the medicine volume according to the detection signal constitute a medicine volume-specifying unit of the present invention. The medicine volume may be the value measured by the medicine-detecting unit 70, as well as a medicine volume previously measured by another publicly-known detector. A medicine volume supplied from pharmaceutical manufacturers may be used. In this case, the storing unit (memory 87) storing the medicine volume and the control unit 83 invoking the related data from the storing unit constitute the medicine volume-specifying unit of the present invention.

In the medicine volume coefficient table, the medicine volume coefficient is associated depending on the medicine shape and however, may be associated depending on the rotational speed of the second rotator 35.

TABLE 3

| x | | | | | | | |
|---|---|---|---|---|---|---|---|
| | | Drug Volume Coefficient | | | | Drug Volume Coefficient | |
| Rotational Speed | S1-1 | DC1-1 | . . . Drug Interval | | S3-1 | DC3-1 | . . . |
| | S1-2 | DC1-1 | | | S3-2 | DC3-1 | |
| | S1-3 | DC1-2 | | | S3-3 | DC3-2 | |
| | . . . | . . . | | | . . . | . . . | |

Sy1-y2 (y1, y2=1, 2, . . . ): rotational speed of the second rotator (y1 depends on the medicine shape. As the value of y2 is larger, the rotational speed increases).

DCy3-y4 (y3, y4=1, 2, . . . ): medicine volume coefficient (y3 depends on the medicine shape).

As shown in Table 4, the foreign-material volume coefficient table is set (associated) depending on the medicine shape. In detecting medicines passing the medicine-detecting unit 70, to prevent external perturbations and wrong determination that a chipped medicine is regarded as one complete medicine, a foreign-material volume coefficient to be multiplied by the actual medicine volume is set. For example, the foreign-material volume coefficient of oval tablets is a maximum value, and the foreign-material volume coefficients of deformed tablets, capsules, and ellipsoidal tablets are smaller values in descending order. However, for the ellipsoidal tablets, the foreign-material volume coefficient varies according to whether the rotational speed of the second rotator 35 is large or not.

TABLE 4

| x | | | | | | | |
|---|---|---|---|---|---|---|---|
| | | Foreign-material Volume Coefficient | | | | Foreign-material Volume Coefficient | |
| Rotational Speed | S1-1 | EC1-1 | . . . Rotational Speed | | S3-1 | EC3-1 | . . . |
| | S1-2 | EC1-1 | | | S3-2 | EC3-1 | |
| | S1-3 | EC1-1 | | | S3-3 | EC3-2 | |
| | . . . | . . . | | | . . . | . . . | |

Sz1-z2 (z1, z2=1, 2, . . . ): the rotational speed of the second rotator (z1 depends on the medicine shape. As the value of z2 is larger, the rotational speed increases).

ECz3-z4 (z3, z4=1, 2, . . . ): medicine volume coefficient (z3 depends on the medicine shape).

In the foreign-material volume coefficient table, the foreign-material volume coefficient is associated depending on the medicine shape and however, as in the medicine volume coefficient table, the foreign-material volume coefficient may be associated depending on the rotational speed of the second rotator 35.

(2. Operation)

Next, operations of the medicine-counting device thus configured will be described below.

(2-1. Initial Operation)

Figure 14:
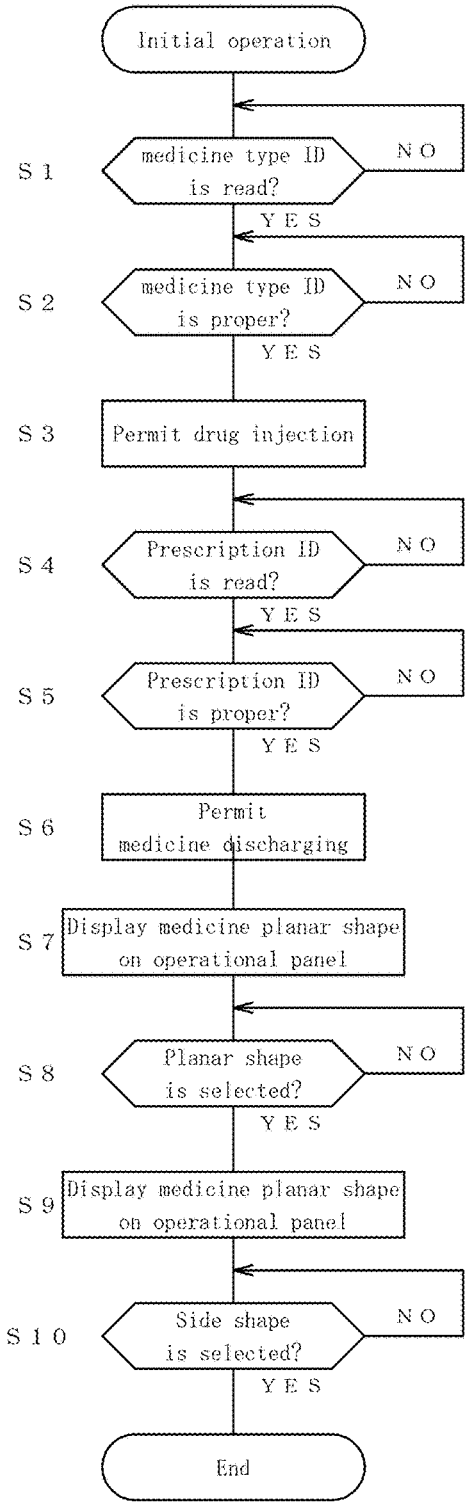
FIG. 14 is a flow chart of an initial operation performed by a control unit in FIG. 13.

As shown in flow chart of FIG. 14, in an initial operation, before injection of medicines, when the operator reads a medicine type ID (bar code) printed on a medicine bottle using a bar code reader 86 (Step S1), it is determined whether or not the medicine type ID matches a medicine indicated in prescription data (Step S2). If the medicine type ID matches the indicated medicine, injection of the medicines is permitted due to the decision of a correct medicine (Step S3). This can prevent dispense of any wrong medicine. Next, when the operator reads a prescription ID (bar code) printed on a label of the medicine container 1 that receives the medicines (Step S4), it is determined whether or not the prescription ID matches prescription ID indicated in the prescription data (Step S5). If the prescription ID matches the indicated prescription ID, dispense of the medicines is permitted (Step S6). This can prevent misidentification of the medicine container 1.

Figure 15:
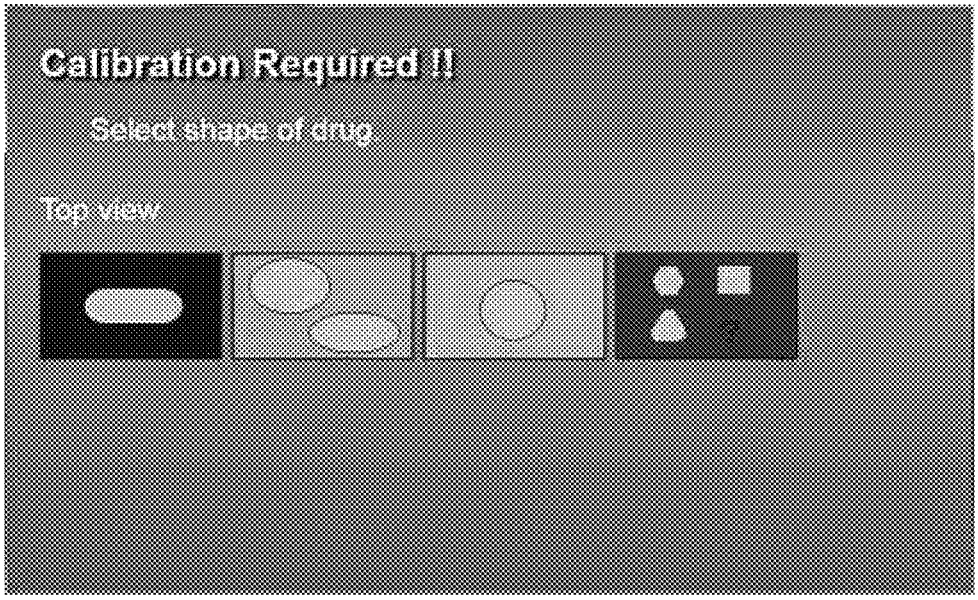
FIG. 15 illustrates a screen displaying shapes (planar shapes) of various medicines when viewed from above on an operational panel in FIG. 13.
Figure 16:
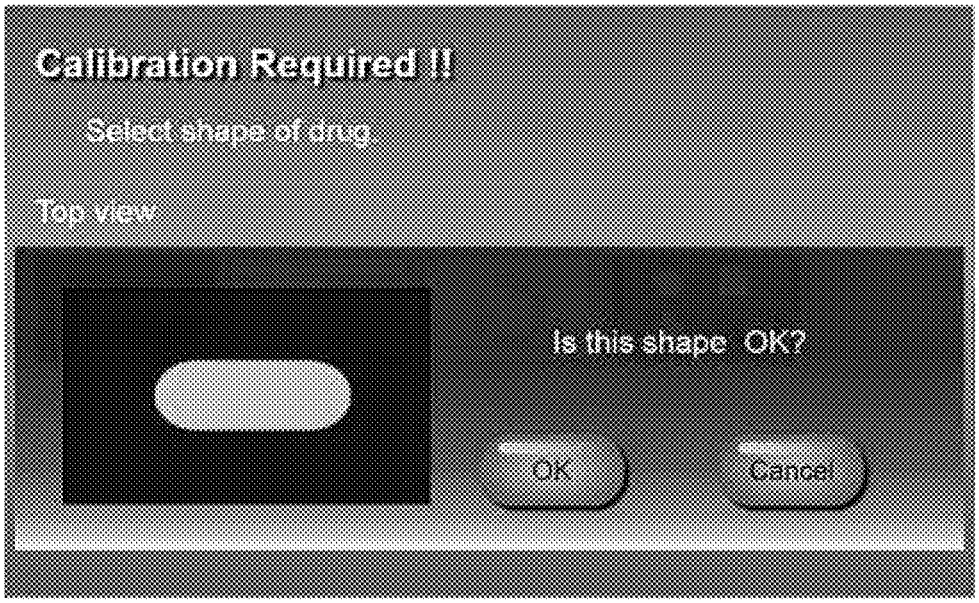
FIG. 16 illustrates a check screen displayed by selecting the planar shape in FIG. 15.
Figure 17:
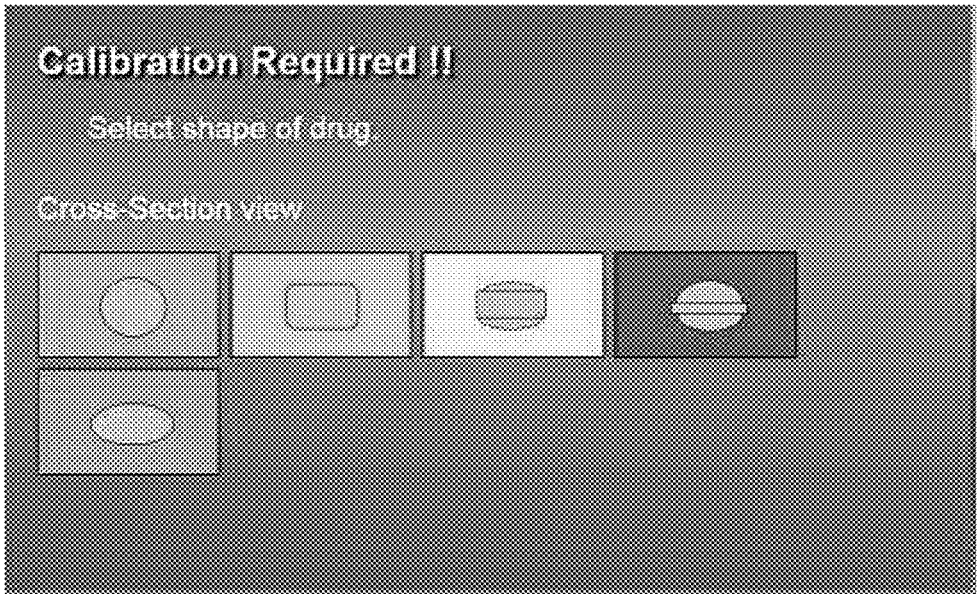
FIG. 17 illustrates a screen displaying shapes (side shapes) of various medicines when viewed from the side, which is displayed by clicking an OK button in FIG. 16.

Subsequently, the operator manipulates the operational panel 84 to specify the shape of medicines prescribed as follows. First, shapes (planar shapes) of various medicines when viewed from above are displayed on the operational panel 84 (Step S7). FIG. 15 illustrates four classes: oblong circle, ellipse, circle, and others. When any class is selected (Step S8), a check screen shown in FIG. 16 is displayed. An OK button is clicked to display shapes (side shapes) of the planer-shaped medicine selected in Step S8 when viewed from the side (Step S9). FIG. 17 illustrates five classes including a circle and a rectangle. When any side shape is selected (Step S10), the medicine shape is specified based on the side shape and the planar shape selected in the Step S8. Although a three-dimensional image can be displayed to specify the medicine shape only once, the medicine shape can be easily determined by selecting the medicine shape in the two stages as described above. Unlike the use of the three-dimensional image, since the medicine shape never varies depending on the viewing direction and the planar shape and the side shape are selected in determined directions, the medicine shape can be reliably selected. Thereby, correction and other processing in below-mentioned automatic adjusting processing can be properly executed.

When the medicine shape is specified, medicines are injected into a medicine injecting space defined by the first rotator 23 and the partition wall 18, and the number of prescribed medicines is inputted, medicine-discharging processing is started.

In this case, at injection of the medicines, the rotators 23 and 35 are previously rotated until the medicine-detecting sensor 51 detects a first medicine. This can reduce time from the injection to dispense of the medicines. A medicine-detecting sensor may be provided in front of the dispensing part 78, and medicines may be conveyed to a position in front of the place between the inner guide 66 of the medicine guiding part 65 and the outer guide 57 in the conveying direction.

(2-2. Drug-Discharging Processing)

Figure 18:
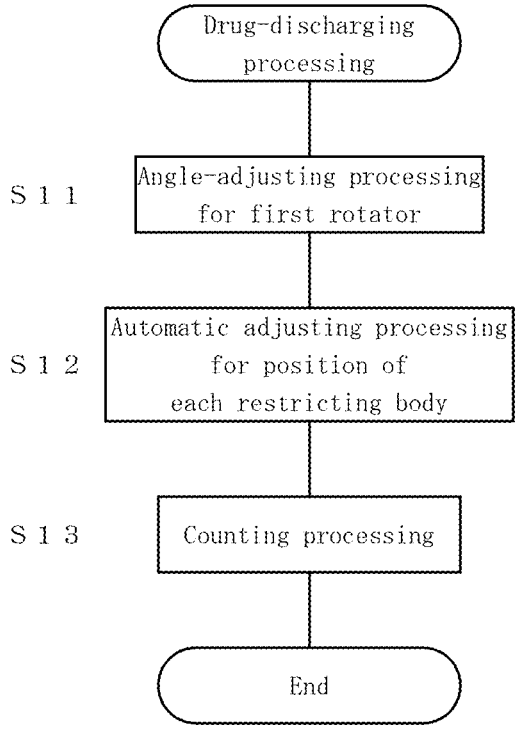
FIG. 18 is a flow chart of medicine-discharging processing executed by the control unit in FIG. 13.

In the medicine-discharging processing, as shown in FIG. 18, angle-adjusting processing for the first rotator 23 is executed (Step S11), and the control unit 83 executes automatic adjusting (auto-calibration) processing for the restricting bodies 41 and 52 according to medicines (Step S12) and counting processing of actually counting the medicines (Step S13). Since the medicine-discharging processing is executed even during the automatic adjusting processing, the medicines passing the medicine-detecting unit 70 are reliably counted in the automatic adjusting processing.

(2-2-1. Angle-Adjusting Processing for First Rotator)

The angle-adjusting processing for the first rotator 23 is executed depending on the number, size, and shape of injected medicines. That is, the angle of the first rotator 23 is adjusted according to the number and shape of the medicines, such that the medicines can smoothly move from the first rotator 23 to the second rotator 35. Specifically, in the case where the number of injected medicines is large, the tilt angle of the first rotator 23 is set sharp (near vertical) such that the storage space between the partition wall 18 and the first rotator 23 and the second rotator 35 becomes large. In the case of round medicines that roll (rotate) on the upper face of the first rotator 23, and do not move to the second rotator 35 even when the first rotator 23 is rotated, the tilt angle of the first rotator 23 is set obtuse (near horizontal).

In the angle-adjusting processing, a medicine detector may be disposed on the moving part 37 of the second rotator 35 or another place to automatically adjust the angle. In this case, the angle-adjusting processing may be executed in a first stage of the automatic adjusting processing. The tilt angle may be adjusted to be decreased when it is determined that no medicine is present on the second rotator 35.

(2-2-2. Automatic Adjusting Processing)

In the automatic adjusting processing, for medicines that has not been counted, such as new medicines, the memory 87 has not stored volume data on the medicines. Thus, the medicine volume is measured as follows. The interval between medicines passing the medicine-detecting unit 70 is measured, the rotational speed of the second rotator 35 and the control method are decided, and they are associated with data on the medicines (here, medicine ID) and stored in the memory 87.

Figure 19A:
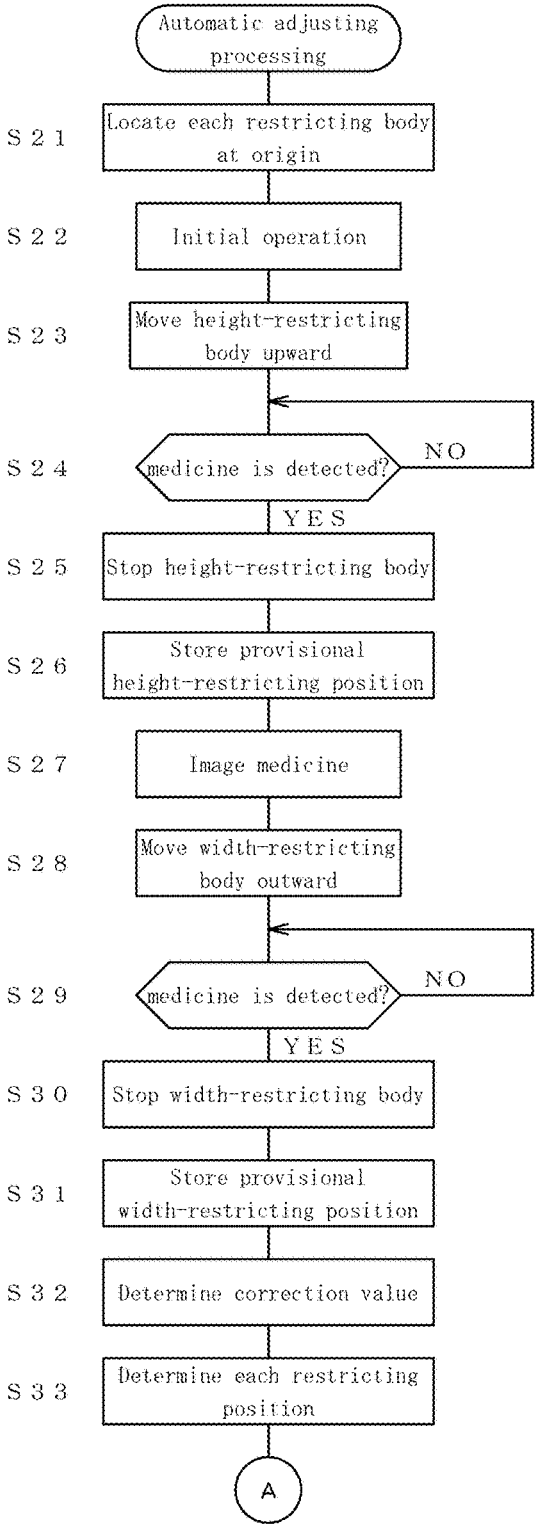
FIG. 19A is a flow chart of automatic adjusting processing executed by the control unit in FIG. 13.

As shown in FIG. 19A, first, the height-restricting body 41 and the width-restricting body 52 are moved to an origin (Step S21). That is, the height-restricting body 41 is lowered to the lowest position. The width-restricting body 52 is moved inward such that the width of the medicine conveying portion of the upper face of the second rotator 35 becomes substantially zero. As a result, even when the rotators 23 and 35 are rotated, no medicine is discharged.

In this state, as shown in FIG. 10A, an initial operation of rotating the pivoting members 80A and 80B of the switch valve unit 76 toward the dispensing part 78 to open the dispensing part 78 and close the collecting part 79, and rotating the rotators 23 and 35 is performed (Step S22). The rotational speed of the first rotator 23 can be set to any of two different stages, and the rotational speed of the second rotator 35 can be set to any of seven different stages. Here, the second rotator 35 is rotated at a constant speed 3 (reference speed).

Then, the height-restricting body 41 is gradually moved upward (Step S23). When the medicine-detecting sensor 51 detects a medicine passing the height-restricting body 41 (Step S24), the movement of the height-restricting body 41 is stopped (Step S25), and this position is defined as the provisional height-restricting position (restricting height). Then, the provisional height-restricting position is stored in the memory 87 (Step S26). Simultaneously, an image of medicines near the height-restricting body 41 is taken with the third camera 89*c* (Step S27).

Subsequently, the width-restricting body 52 is moved outward to gradually extend (Step S28). When the sensor or the medicine-detecting unit 70 provided downstream from the width-restricting body 52 detects a medicine (Step S29), the movement of the width-restricting body 52 is stopped (Step S30), and the position is defined as the provisional width-restricting position (provisional conveyance width). Then, the provisional width-restricting position is stored in the memory 87 (Step S31). In this case, the provisional height-restricting position of the height-restricting body 41 and the provisional width-restricting position of the width-restricting body 52 are stored in association with the medicine 1D read with the bar code reader.

Next, a correction value with respect to the provisional height-restricting position and the provisional width-restricting position are determined based on the medicine shape specified in the initial operation according to the correction table (Step S32). Then, the height-restricting position and the width-restricting position are determined by adjusting the provisional height-restricting position and the provisional width-restricting position on the basis of the determined correction value (Step S33). By providing the gap through which the medicine passes with a slight margin in this manner, the medicine can be smoothly discharged.

Figure 19B:
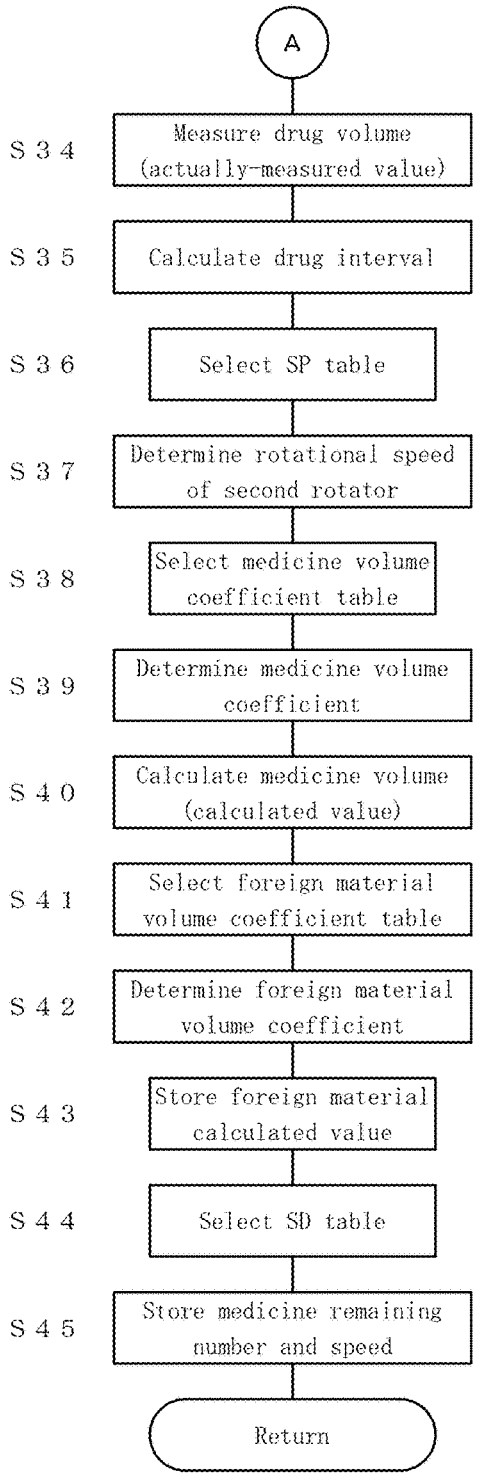
FIG. 19B is a flow chart of automatic adjusting processing executed by the control unit in FIG. 13.

When the positions of the height-restricting body 41 and the width-restricting body 52 are determined in this manner, as shown in FIG. 19B, the volume of the sequentially dispensed medicine is measured by the medicine-detecting unit 70 while keeping the rotational speed of the second rotator 35 uniform as described above (Step S34).

That is, the line sensors (71A, 72A) to (71D, 72D) of the medicine-detecting unit 70 detect the medicine falling due to its self-weight (constant speed) in four different directions. Then, the volume including width and height of the passing medicine is determined on the basis of input values of the light-receiving parts 72A to 72D. Specifically, the width of the medicine is determined in the four different directions on the basis of the inputs of the light-receiving elements of the light-receiving parts 72A to 72D. Since the vertical height of the light-receiving parts 72A and 72B of the upper housing 70A is different from that of the light-receiving parts 72C and 72D of the lower housing 70B, in consideration of a detecting time difference due to falling, the horizontal cross-sectional shape of the falling medicine can be correctly determined based on the width determined by the light-receiving parts 72A to 72D. By repeating this determination every predetermined time, the horizontal cross-sectional shape every predetermined time can be determined. After that, the volume (three-dimensional shape) including the shape of the falling medicine is calculated based on the horizontal cross-sectional shape every predetermined time.

In this case, since the second rotator 35 is rotated at the constant low speed 3 (reference speed), it is hard to cause a failure that stacked medicines are discharged by mistake. For this reason, below-mentioned processing for preventing wrong detection is not executed. When all medicines are dispensed, an average value of the measured medicine volume (actually-measured values) is calculated and defined as the medicine reference volume, and this medicine reference volume is stored in the memory 87 in association with the medicine ID. However, it is preferred that the reference volume is stored in the memory 87 when the number of dispensed medicines exceeds a certain value such as 30. The small number of dispensed medicines is susceptible to a detection error. When the number of dispensed medicines exceeds a certain value such as 30, by calculating the average value of the actually-measured values, the detection error can be prevented to achieve correct determination. A threshold may be calculated by multiplying the largest calculated volume by the medicine volume coefficient.

The interval of medicines sequentially passing the medicine-detecting unit 70 is found (Step S35).

That is, time required to start detection of a next medicine after no falling medicine is detected by the medicine-detecting unit 70 is calculated.

After the calculation of the medicine volume and the interval, the SP table is selected according to the medicine shape determined in the initial operation (Step S36). Then, with reference to the selected SP table, the rotational speed of the second rotator 35 is determined based on the calculated medicine interval (Step S37). When the interval between medicines passing the medicine-detecting unit 70 is larger than a preset reference range (which can be found through an experiment and so on), the rotational speed is set to a large value so as to reduce medicine counting time. On the contrary, when the interval is smaller than the reference range, the rotational speed is set to a small value so as to prevent wrong medicine counting. The rotational speed thus determined is stored in the memory 87 in association with the medicine ID.

The medicine volume coefficient table is selected depending on the medicine shape determined in the initial operation (Step S38). In this case, if in the medicine volume coefficient table, the medicine volume coefficient is set depending on the rotational speed of the second rotator 35, the medicine volume coefficient table may be selected depending on the changed rotational speed of the second rotator 35.

Then, with reference to the selected medicine volume coefficient table, the medicine volume coefficient for determining one medicine is determined based on the rotational speed of the second rotator 35 (Step S39). When the medicine volume coefficient is determined in this manner, the medicine reference volume is multiplied by the medicine volume coefficient to find the volume determined to be one medicine (medicine calculated value) (Step S40), and the calculated value is stored in the memory 87 in association with the medicine ID.

Further, the foreign-material volume coefficient table is selected according to the medicine shape determined in the initial operation (Step S41). In this case, if in the foreign-material volume coefficient table, the foreign-material volume coefficient is set depending on the rotational speed of the second rotator 35, the foreign-material volume coefficient table may be selected based on the changed rotational speed of the second rotator 35.

Then, with reference to the selected foreign-material volume coefficient table, the foreign-material volume coefficient for determining a foreign material such as debris is determined based on the calculated medicine interval (Step S42). When the foreign-material volume coefficient is determined as described above, the medicine reference volume is multiplied by the foreign-material volume coefficient to find the volume determined to be the foreign material (foreign material calculated value), and this value is stored in the memory 87 in association with the medicine ID (Step S43).

Further, the SD table is selected according to the medicine shape determined in the initial operation (Step S44). In this case, if the SD table is selected according to the rotational speed of the second rotator 35, the SD table may be selected based on the changed rotational speed of the second rotator 35.

Then, according to the selected SD table, the number of medicines (the number of remaining medicines to be discharged), with which the rotational speed of the second rotator 35 starts to be decreased, is determined in two stages (first remaining number and second remaining number) on the basis of the detected medicine interval, and the number of remaining medicines to be discharged is stored in the memory 87 in association with the medicine ID (Step S45). That is, the number of remaining medicines to be discharged becomes the determined first remaining number, thereby setting the medicine-discharging speed of the medicine guiding part 65 to a first speed. After that, the number of remaining medicines to be discharged becomes the determined second remaining number, thereby setting the medicine-discharging speed to a second speed that is slower than the first speed.

The memory 87 stores volume data on the medicines that has been counted. Thus, the medicine ID (bar code) printed on the medicine bottle is read with the bar code reader 88, and the restricting height of the height-restricting body 41 and the conveyance width of the width-restricting body 52, which are associated with medicines corresponding to the ID, are invoked from the memory 87. Then, positions of the height-restricting body 41 and the width-restricting body 52 are adjusted to the values.

Stored information of the restricting height and the conveyance width may be displayed on the monitor 89 to be viewable by the operator, and may be fine-tuned as needed, and the fine-tuned restricting height and conveyance width may be overwritten.

(2-2-3. Counting Processing)

Figure 20:
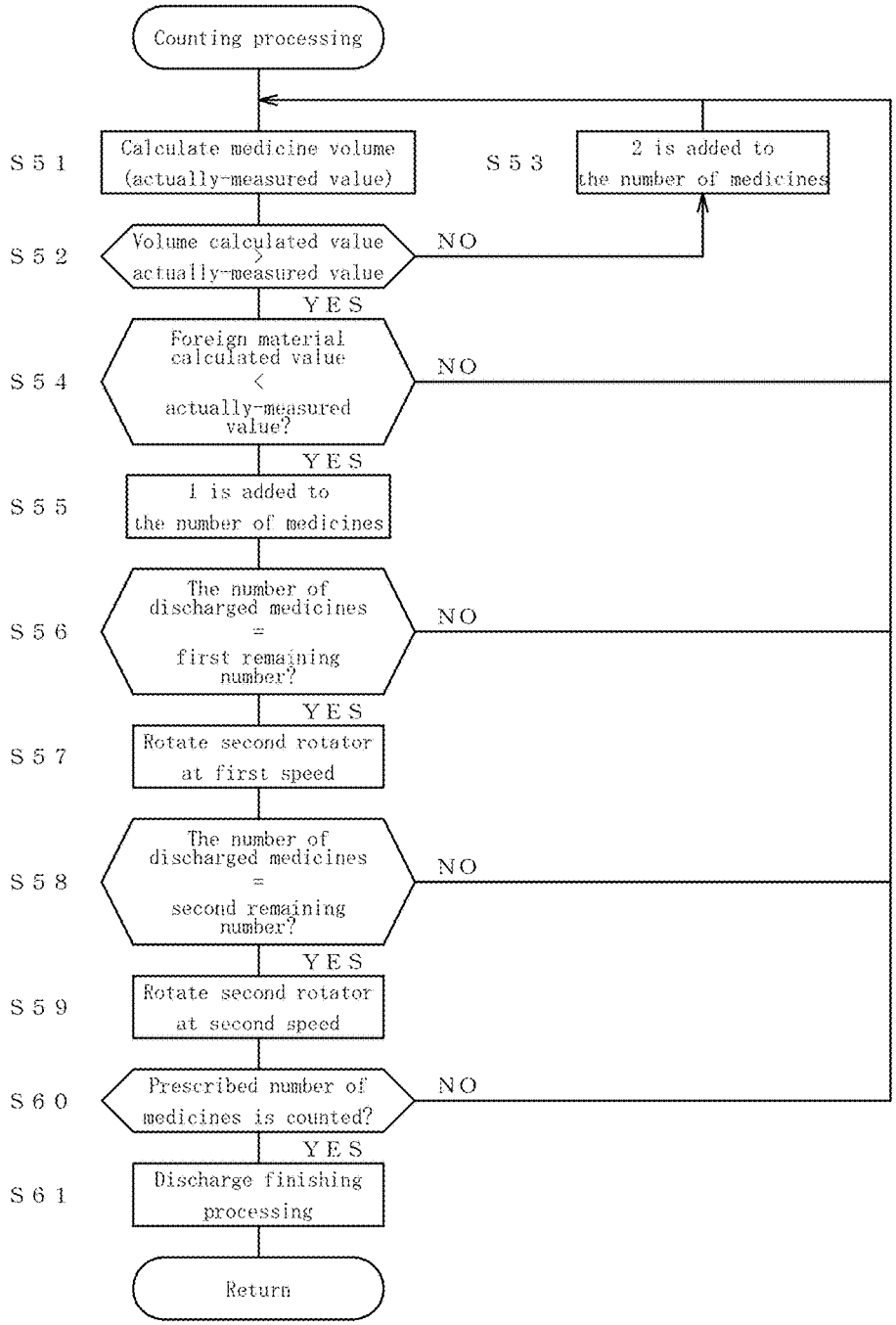
FIG. 20 is a flow chart of counting processing executed by the control unit in FIG. 13.

For firstly counted medicines such as new medicines and previously counted medicines, as shown in flow chart of FIG. 20, first, the medicine volume (actually-measured value) is calculated based on the detection signal from the medicine-detecting unit 70 (Step S51). Then, the actually-measured value is compared with the medicine calculated value stored in the memory 87 (Step S52). When the actually-measured value is the medicine calculated value or more (Step S52: NO), it is determined that two medicines are discharged by mistake and two is counted (Step S53).

When the actually-measured value is smaller than the medicine calculated value (Step S52: YES), the actually-measured value is compared with the foreign material calculated value stored in the memory 87 (Step S54). When the actually-measured value is the foreign material calculated value or less (Step S54: NO), it is determined that the detected material is a foreign material, counting is not performed. This can prevent wrong detection of external perturbations and foreign material (including chipped medicine). When the actually-measured value is larger than the foreign material calculated value (Step S54: YES), it is determined that one medicine passes the medicine-detecting unit 70, and 1 is added to the number of discharged medicines (Step S55).

When the number of remaining medicines to be discharged reaches the first remaining number stored in the memory 87 (Step S56), the discharge speed of the medicine guiding part 65, that is, the rotational speed of the second rotator 35 is decreased to the first speed (Step S57). After that, when the number of remaining medicines to be discharged reaches the second remaining number (Step S58), the rotational speed is decreased to the second speed that is slower than the first speed (Step S59). This is set in consideration with the rolling amount of the medicine at stop of the second rotator 35, which varies depending on the medicine shape. For example, for round medicines, the movement immediately after stop of rotation of the second rotator 35 is large and thus, an unplanned medicine may be discharged by mistake. Such wrong detection can be prevented by starting to decrease the rotational speed earlier. For box-like medicines, since the movement immediately after stop of rotation of the second rotator 35 is small, the medicines can be efficiently discharged by deferring the time to start to decrease the rotational speed. By decreasing the discharge speed in two stages, medicines can be discharged at a relatively high speed until the last medicine is discharged, thereby further increasing the discharge efficiency.

In this case, by changing the volume to be determined as one medicine with the decrease in the rotational speed according to the medicine volume coefficient table, highly accurate detection can be achieved at all times.

The discharge speed is decreased in the two stages and however, may be decreased in one stage or three or more stages.

When the number of actually discharged medicines is larger than a prescribed number, the number of medicines with which the rotational speed of the second rotator 35 is started to be decreased (the number of remaining medicines to be discharged) is changed according to the SD table. That is, the initial N(0)1-1, 1-2 is changed to N(1)1-1, 1-2 next time. Similarly, the number of remaining medicines to be discharged may be sequentially changed such that the actual discharged number matches the prescribed number. Thereby, as the counting processing is executed, wrong discharge (more than the prescribed number) can be reliably prevented next.

The variation in the medicine-counting device may be considered. That is, the rotational speed of the second rotator 35 of even the medicine-counting devices of the same model slightly varies due to a processing error or an assembling error of each component. In this case, values in each of the data tables may be previously determined in the medicine-counting device through an experiment or the like, and may be used. Values in each of the data tables, which are determined for a certain medicine-counting device, are defined as reference data, and deviation from the reference data in other medicine-counting devices may be calculated.

When the remaining number of prescribed medicines reaches a predetermined value, the height restricted by the height-restricting body 41 and the conveyance width restricted by the width-restricting body 52 are slightly increased. Preferably, the height and the conveyance width are changed with a decrease in the rotational speed of the second rotator 35. This can prevent slow-down of the rotation of the second rotator 35 to lower the medicine discharge efficiency. However, the increase ratio of the height and the conveyance width is previously set to be a smaller value as two medicines are discharged more easily depending on the medicine shape.

For rollable round medicines (it is determined whether or not medicines are rollable on the basis of the selected medicine shape), when the number of prescribed medicines (prescribed number) is counted, the second rotator 35 may be reversely rotated for a predetermined time. This can reliably prevent wrong medicine discharge. The reverse rotation may be performed before the number of discharged medicines reaches the prescribed number, for example, when medicines less than the prescribed number of medicines by n are dispensed.

In the case where no detection signal is inputted from the medicine-detecting sensor 51 and the medicine-detecting unit 70 during discharge of medicines due to entrapment of medicines and so on, the rotational speed of the second rotator 35 may be increased until a detection signal is re-inputted, or the second rotator 35 may be reversely rotated and then, positively rotated again.

After that, when the prescribed number of discharged medicines is counted (Step S60), discharge finishing processing is executed as follows (Step S61).

Figure 10B:
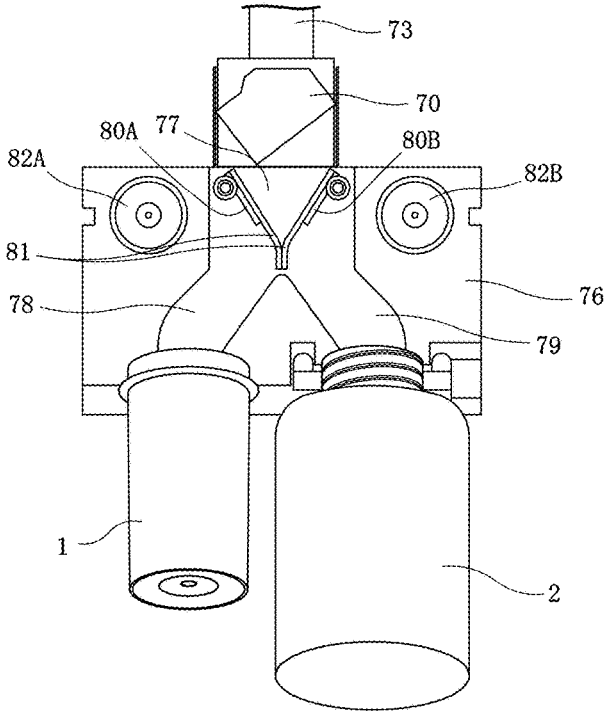
FIG. 10B is a front view illustrating the state where dispensing is finished.
Figure 10C:
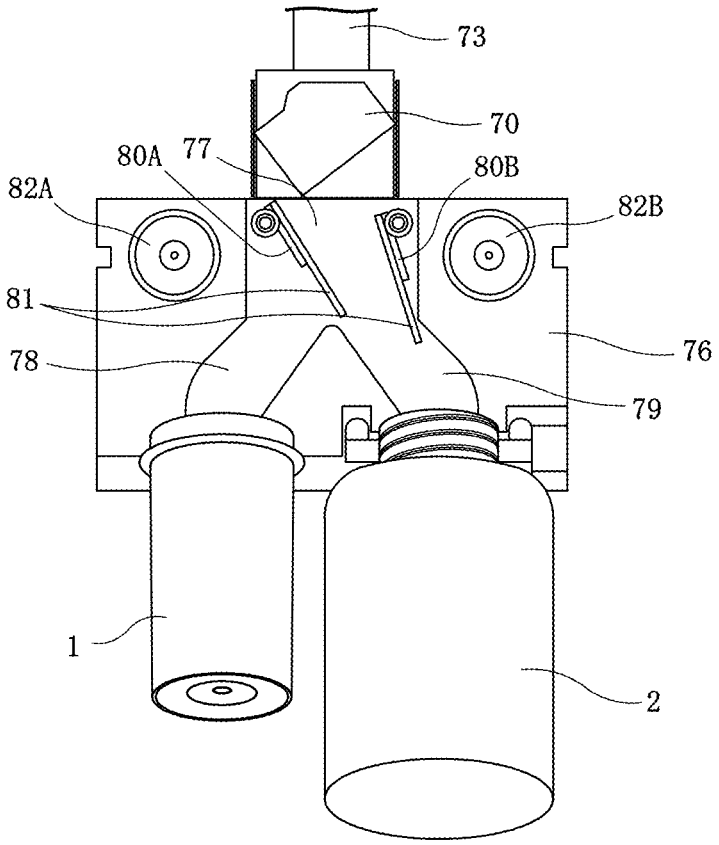
FIG. 10C is a front view illustrating the state where medicines are collected into a collecting container.

That is, as shown in FIG. 10B, the pivoting member 80A located on the side of the dispensing part 78 is rotated toward the collecting part 79 to close both of the dispensing part 78 and the collecting part 79. At the suspending position, the elastic parts 81, 81 are elastically deformed by contact pressure. In this state, dispensed medicines are temporarily held upstream from the pair of pivoting members 80A and 80B. Next, as shown in FIG. 10C, the pivoting member 80B located on the side of the collecting part 79 is rotated to the side of the pivoting member to open the collecting part 79. The medicines temporarily stored upstream from the pair of pivoting members 80A and 80B are flicked toward the collecting part 79 through elastic deformation of the elastic part 81 on the side of the dispensing part 78. This can reliably prevent extra medicines from being dispensed toward the dispensing part 78. Finally, the rotational speed of the rotators 23 and 35 is increased to discharge all medicines in the frame 17 to the collecting container 2.

Figure 12A:
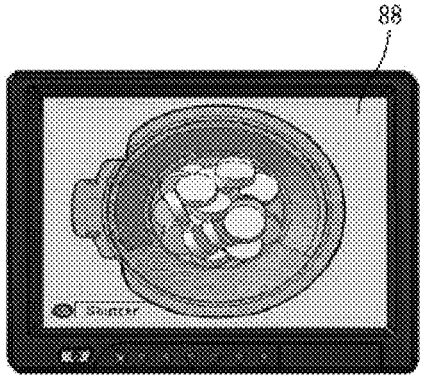
FIG. 12A illustrates an image of medicines dispensed into a medicine container, which is taken with a first camera and displayed on a monitor.
Figure 12B:
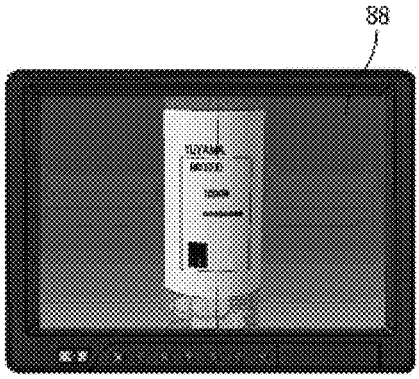
FIG. 12B illustrates an image of prescription data on a side face of the medicine container, which is taken with a second camera and displayed on the monitor.
Figure 12C:
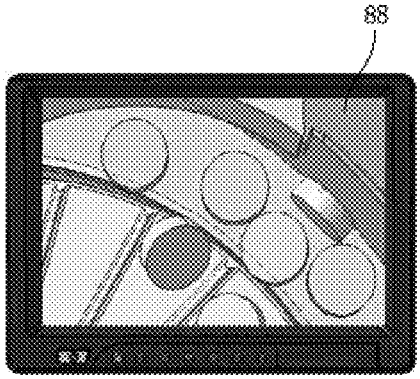
FIG. 12C illustrates an image of medicines being discharged, which is taken with a third camera and displayed on the monitor.

When dispensing of medicines is finished, the medicine container 1 is placed on the inspection table. At this time, as shown in FIGS. 12A and 12B, the opening of the medicine container 1 is oriented to the first camera 89*a*, and the label on the side face is positioned with respect to the second camera 89*b* and imaged with the cameras 89*a* and 89*b*. Then, medicines dispensed into the medicine container 1 (See FIG. 12A), the label stuck to the side face of the medicine container 1 (prescription ID printed on the label: See FIG. 12B), and an image of medicines during dispense, which is taken with the third camera (See FIG. 12C) are simultaneously displayed on the monitor 88 so as to inspect whether or not medicines are dispensed according to the prescription data.

Figure 12D:
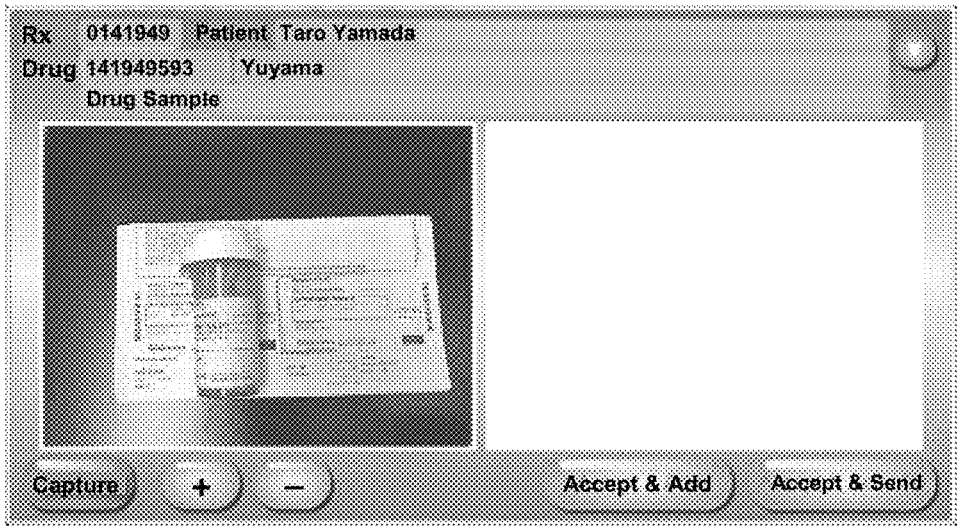
FIG. 12D illustrates an image taken for storage after collection of medicines into the medicine container.

At this time, as shown in FIG. 12D, it is preferred that the entire patient medicine container 1 storing medicines along with a prescription are imaged such that the label is viewable, digital watermarking is applied to the image to prevent falsification, and then, the image with the digital watermarking is saved. Through this processing, it can be checked later whether or not medicines are properly prescribed. In this case, the counting result actually displayed on the monitor 88 can be integrated with the image, realizing more reliable data.

(2-2-4. Conveying Operation of Disc-Like Tablet X)

Next, an operation of conveying a disc-like tablet X as a type of medicine by use of the medicine-supplying device will be specifically described. The operation of conveying the disc-like tablet X also applies to round medicines.

Figure 21A:
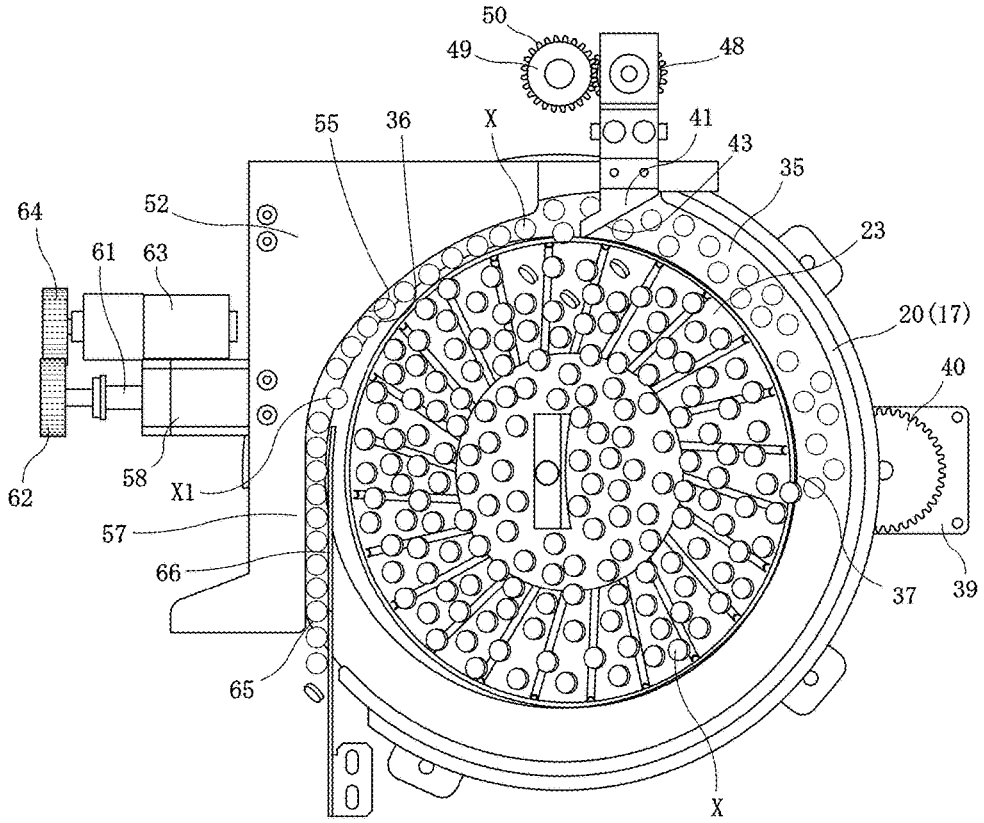
FIG. 21A is a plan view illustrating the supplying state of tablets as medicines.
Figure 21B:
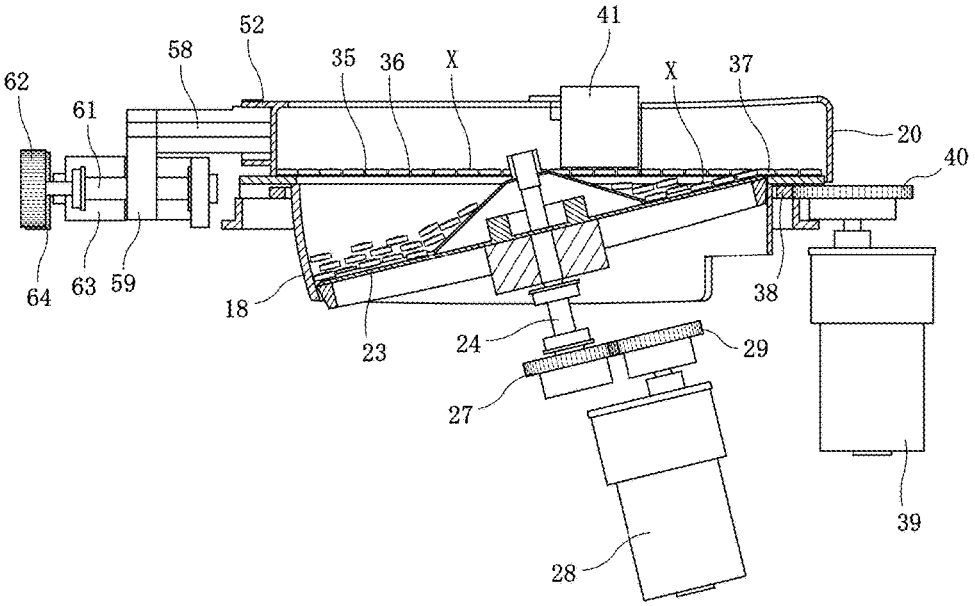
FIG. 21B is a sectional view of FIG. 20A.

As shown in FIGS. 21A and 21B, when the first rotator 23 rotates, the tablets X are also rotated on the upper face of the rotator, and are radially moved outward by the centrifugal force. Then, the tablets X on the first rotator 23 are moved onto the second rotator 35 via the moving part 37 located on the substantially same level as the second rotator 35.

The tablets X moved onto the second rotator 35 are moved toward the medicine guiding part 65, and are restricted their movement to the downstream side by the height-restricting body 41. For example, an upper tablet of moving tablets X in a vertically stacked state contacts the guide face 43 of the height-restricting body 41 to fall onto the second rotator 35 or fall from the inner circumference 36 onto the first rotator 23.

The tablets X passing the height-restricting body 41 contact the first curved face 55 of the width-restricting body 52 that restricts the conveyance width, thereby moving toward the inner circumference 36 of the second rotator 35. Since the conveyance width of the second rotator 35 is ½ of the medicine width due to the presence of the first curved face 55 of the width-restricting body 52, only the tablets X in contact with the width-restricting body 52 can pass from the width-restricting body 52 to the downstream side. That is, in the case where two tablets X are conveyed side by side in the radial direction, the inner tablet X is pressed by the outer tablet X in contact with the width-restricting body 52, and falls from the inner circumference 36 of the second rotator 35 onto the first rotator 23. Even when the tablets X are not aligned in the radial direction, the tablet X having the gravity center located inside of the inner circumference 36 of the second rotator 35 falls from the inner circumference 36 onto the first rotator 23. For this reason, other tablet X that is not in contact with the width-restricting body 52 is not conveyed to the downstream side.

The tablets X passing the first curved face 55 of the width-restricting body 52 are stably conveyed in a second curved face 56 having a larger conveyance width. Then, the tablets are conveyed to between the inner guide 66 of the medicine guiding part 65 and the outer guide 57, aligned and moved to the outlet and then, discharged to the medicine-detecting unit 70. At this time, the tablets X1 protruding inward from the inner circumference 36 of the second rotator 35 contact the end of the inner guide 66 to be guided between the inner guide and the outer guide 57 or fall from the inner circumference 36 on to the first rotator 23. Only the tablets X passing the medicine guiding part 65 are supplied to the medicine-detecting unit 70 through the medicine-dispensing member 73 as the medicine discharge port.

(2-2-5. Conveying Operation of Capsule Y)

Next, an operation of conveying a capsule Y that is different from the disc-like tablet X in shape and size will be specifically described. The operation of conveying the capsule Y also applies to non-round tablets such as ellipsoidal tablets.

Figure 22A:
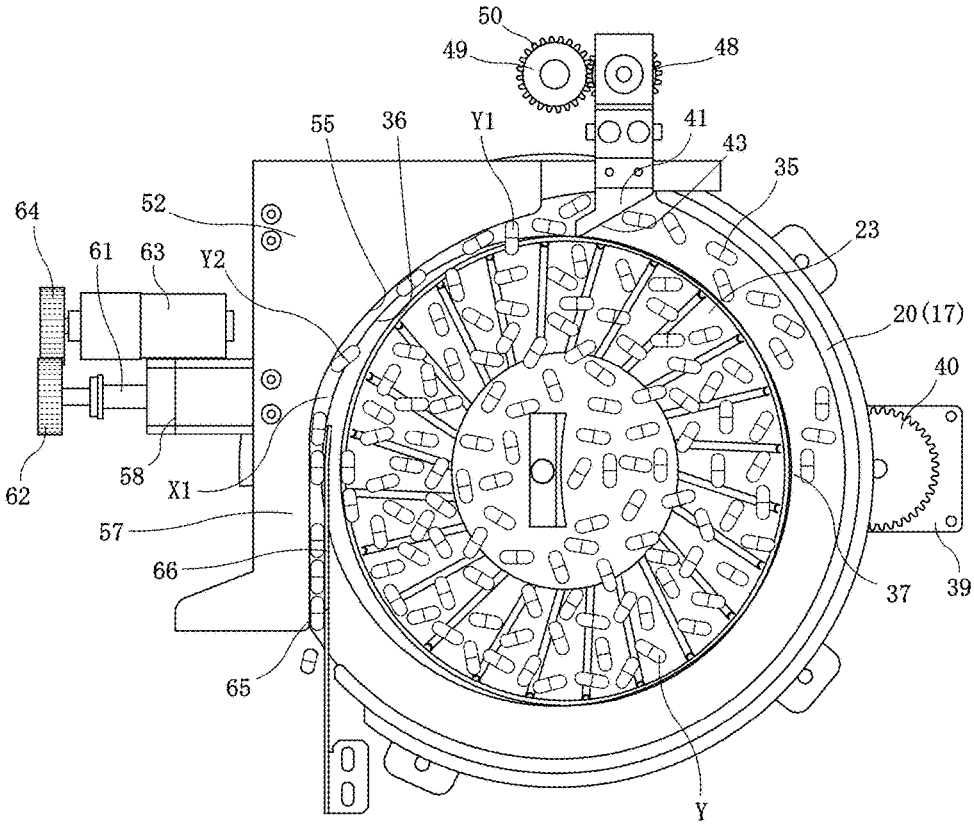
FIG. 22A is a plan view illustrating the supplying state of capsules as medicines.
Figure 22B:
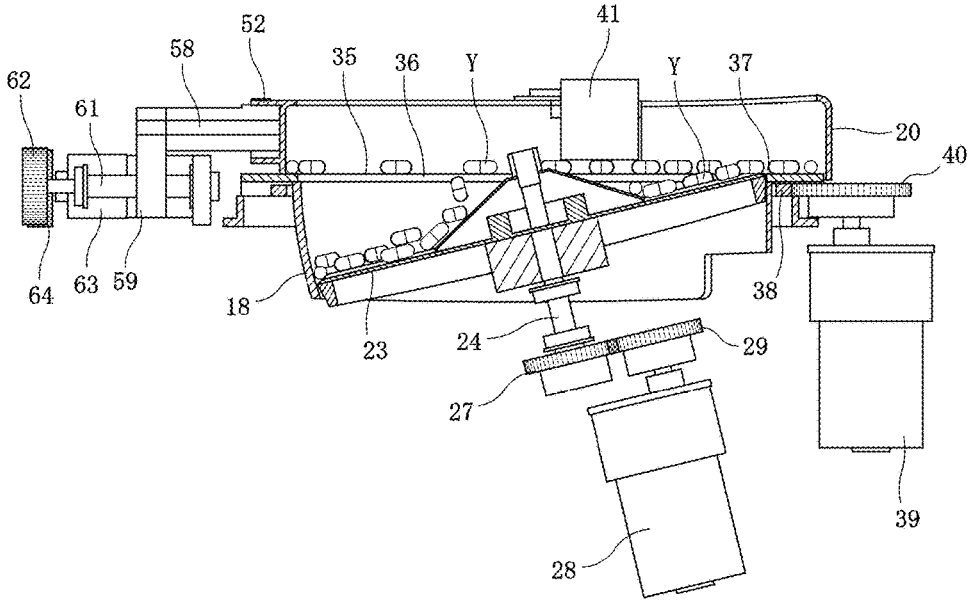
FIG. 22B is a plan view of FIG. 21A.

As shown in FIGS. 22A and 22B, when the first rotator 23 rotates, the capsules Y are rotated on the upper face of the first rotator, and are radially moved outward by the centrifugal force. Then, the capsules Y on the first rotator 23 move onto the second rotator 35 via the moving part 37 located on the same level as the second rotator 35.

The capsules Y moved onto the second rotator 35 move toward the medicine guiding part 65, and are restricted in their movement to the downstream side by the height-restricting body 41, and moving capsules Y in a vertically stacked state fall onto the second rotator 35 or fall from the inner circumference 36 onto the first rotator 23.

The capsules Y passing the height-restricting body 41 contact the first curved face 55 of the width-restricting body 52 that restricts the conveyance width, are moved toward the inner circumference 36 of the second rotator 35, and corrected in position such that the longitudinal sides extend in the medicine conveying direction. Then, only the capsules Y in contact with the width-restricting body 52 pass from the width-restricting body 52 to the downstream, and the capsules Y that are not in contact with the width-restricting body 52 fall from the inner circumference 36 of the second rotator 35 onto the first rotator 23. Since the conveyance width of the second rotator 35 is about ½ of the width of the capsule Y1, the gravity center of the capsule Y1 that cannot be corrected in position by contact with the first curved face 55 is located inside of the inner circumference 36 of the second rotator 35 and therefore, the capsule Y1 cannot keep its balance and falls from the inner circumference 36 of the second rotator 35 onto the first rotator 23.

The capsules Y passing the first curved face 55 of the width-restricting body 52 are stably conveyed in the second curved face 56 having the larger conveyance width. Then, the capsules Y are conveyed to between the inner guide 66 of the medicine guiding part 65 and the outer guide 57, aligned and moved to the outlet one by one, and discharged to the medicine-detecting unit 70. At this time, the capsule Y2 that cannot be corrected in position contacts the end of the inner guide 66, thereby being corrected in position and guided to between the inner guide and the outer guide 57 or falling from the inner circumference 36 onto the first rotator 23. Only the capsules Y passing the medicine guiding part 65 are supplied to the medicine-detecting unit 70 through the medicine-dispensing member 73 as the medicine discharge port.

Figure 23A:
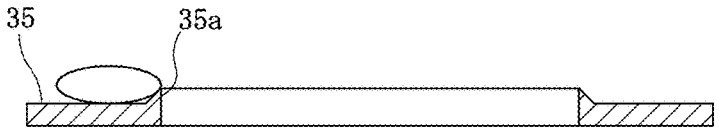
FIG. 23A is a sectional view illustrating a second rotator provided with a rib in a modification example.
Figure 23B:
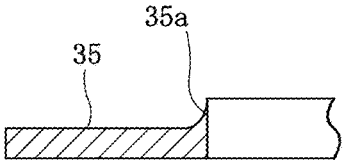
FIG. 23B is an enlarged partial sectional view of FIG. 23A.
Figure 23C:
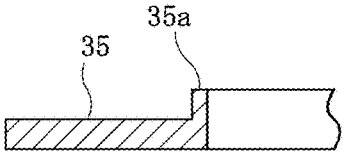
FIG. 23C is an enlarged partial sectional view illustrating a second rotator provided with a rib in another modification example.

Unlike the disc-like tablet X, the capsules Y are not flat and thus, are in point-contact or line-contact with the second rotator 35 and easily rotate while moving on the second rotator 35. Accordingly, after passing the width-restricting body 52, such non-flat medicines as the capsules Y may change their orientation on the second rotator 35 before reaching a medicine guiding part 65, and fall onto the first rotator 23. Thus, as shown in FIGS. 23A to 23C, it is preferable to form an upwardly-protruding annular rib 35*a* on the inner edge of the second rotator 35. The rib 35*a* may have an inner circumferential face that is flush with the inner circumferential face of the second rotator 35, a sharp pointed upper end, and an linearly-tilted outer circumferential face to form a triangular cross section in the radial direction as shown in FIG. 23A, may have an inwardly-curved outer circumferential face as shown in FIG. 23B, or may have an inner circumferential face that is flush with the inner circumferential face of the second rotator 35, a flat upper end, and a vertical outer circumferential face to form a rectangular cross section in the radial direction as shown in FIG. 23C. By providing such rib 35*a*, the non-flat tablet contacts the upper face of the second rotator 35 and the rib 35*a* as shown in FIG. 23A and thus, hardly rotates on the second rotator 35, being prevented from falling onto the first rotator 23.

As described above, in the medicine-supplying device of the present invention, since medicines can be aligned one by one using the height-restricting body 41 and the width-restricting body 52 and supplied to the medicine guiding part 65, the medicines can be reliably passed through the medicine guiding part 65 one by one, and discharged from the medicine-dispensing member 73 to the outside without causing any problem such as clogging. Since the many conveyed medicines are not held back by the restricting bodies 41, 52 and the medicine guiding part 65, but fall onto the first rotator 23, clogging at the restricting bodies 41, 52 as well as collision between the medicines can be reliably prevented. This can also prevent chipping of medicines. Especially since the conveyance width of the second rotator 35 is restricted to ½ of the medicine width by the width-restricting body 52, non-circular medicines in a plan view cannot pass there unless the longitudinal side extends in the medicine conveying direction. Therefore, clogging at the inlet of the medicine guiding part 65 can be reliably prevented.

Since the height-restricting body 41 can adjust the restricting height, and the width-restricting body 52 can adjust the conveyance width of the second rotator 35, various medicines of different shapes and sizes can be supplied. Further, since the width-restricting body 52 and the outer guide 57 of the medicine guiding part 65 are integrated with each other and can be simultaneously adjusted, it is possible to improve the workability in adjustment and reduce the number of parts. Moreover, since the restricting bodies 41 and 52 can be automatically adjusted in this embodiment, the convenience can be greatly enhanced without requiring any operator's adjustment.

Further, since the inner guide 66 of the medicine guiding part 65 has the upwardly-inclined tilted edge 68, the medicine moved in the state protruded inward from the inner circumference 36 of the second rotator 35 can be reliably prevented from being clogged at the inlet of the medicine guiding part 65. With this configuration, when non-circular medicines in a plan view are conveyed in a slightly-tilted state, the medicines can be corrected in position or allowed to fall onto the first rotator 23, which is especially effective. Further, since the tilt angle of the first rotary shaft 24 of the first rotator 23 can be adjusted, medicines can be reliably conveyed to the moving part 37 by rotation of the first rotator 23, and moved onto the second rotator 35.

In the medicine-counting device using the medicine-supplying device, medicines of different shapes and sizes can be reliably discharged to the outside one by one, and the discharged medicines can be detected by the medicine-detecting unit 70 and counted by the control unit 83. As a result, a predetermined number of medicines can be reliably dispensed and prescribed to the patient. The switch valve unit 76 disposed at the container attachment part 13 has the dispensing part 78 connected to the medicine container 1 for the patient and the collecting part 79 connected to the collecting container 2, improving workability in prescription. Moreover, the pivoting members 80A and 80B as switch valves cause both the dispensing part 78 and the collecting part 79 to close at the suspending position when the number of prescribed medicines are counted, thereby preventing extra medicines from being dispensed to the medicine container 1. When the pivoting members 80A and 80B are located at the collecting position for the collecting container 2 later, medicines held upstream from the pair of pivoting members 80A and 80B can be flicked to the collecting part 79 by elastic restoration of the elastic parts 81, thereby reliably preventing excessive dispensing of medicines to the medicine container 1 through the dispensing part 78.

The third camera 89*c* provided along with the height-restricting body 41 in the exterior body 10 blocks the movement of the height-restricting body 41. For this reason, as shown in FIG. 11A, the third camera is preferably provided on the upper cover 14 rather than in the exterior body 10.

Similarly, the height-restricting body 41 may be provided on the upper cover 14 rather than in the exterior body 10. With this configuration, when the upper cover 14 is opened relative to the exterior body 10 to clean the upper faces of the first rotator 23 and the second rotator 35, the height-restricting body 41 moves with the upper cover 14. Thus, even when the width-restricting body 52 is moved outside of the second rotator 35 in the radial direction, the width-restricting body 52 does not interfere with the height-restricting body 41. Accordingly, the width-restricting body 52 never hits against the height-restricting body 41 to break the height-restricting body 41. Preferably, the height-restricting body 41 is integrated with an elastic material such as rubber on the side of the second rotator 35. With this configuration, at closing of the upper cover 14 relative to the exterior main body 11, even when the user's hand is present between the height-restricting body 41 and the second rotator 35, or a medicine is present on the second rotator 35, it is possible to prevent a failure that the height-restricting body 41 inflicts a wound on the user's hand or breaks the medicine.

The present invention is not limited to the configuration described in the embodiment, and may be variously modified. For example, in the embodiment, the medicine volume is measured based on the detection signal from the medicine-detecting unit 70 and however, the medicine volume may be previously measured using other publicly-known measuring means, or may be the volume provided from pharmaceutical manufacturers.

In the embodiment, the medicine-detecting sensor 51 for detecting medicines passing the height-restricting body 41 and the medicine-detecting sensor for detecting medicines in front of the dispensing part 78 are provided and however, these medicine-detecting sensors may be provided at following positions.

Preferably, the medicine-detecting sensor is provided at each of a first position on the second rotator 35 restricted by the width-restricting body 52, a second position downstream from the height-restricting body 41 in the rotating direction of the second rotator 35, and a third position upstream from the second position in the rotating direction of the second rotator. Hereinafter, the medicine-detecting sensor at the first position is described as a first sensor 101, the medicine-detecting sensor at the second position is described as a second sensor 102, and the medicine-detecting sensor at the third position is described as a third sensor 103 (See FIG. 38A-FIG. 38H).

Figure 34:
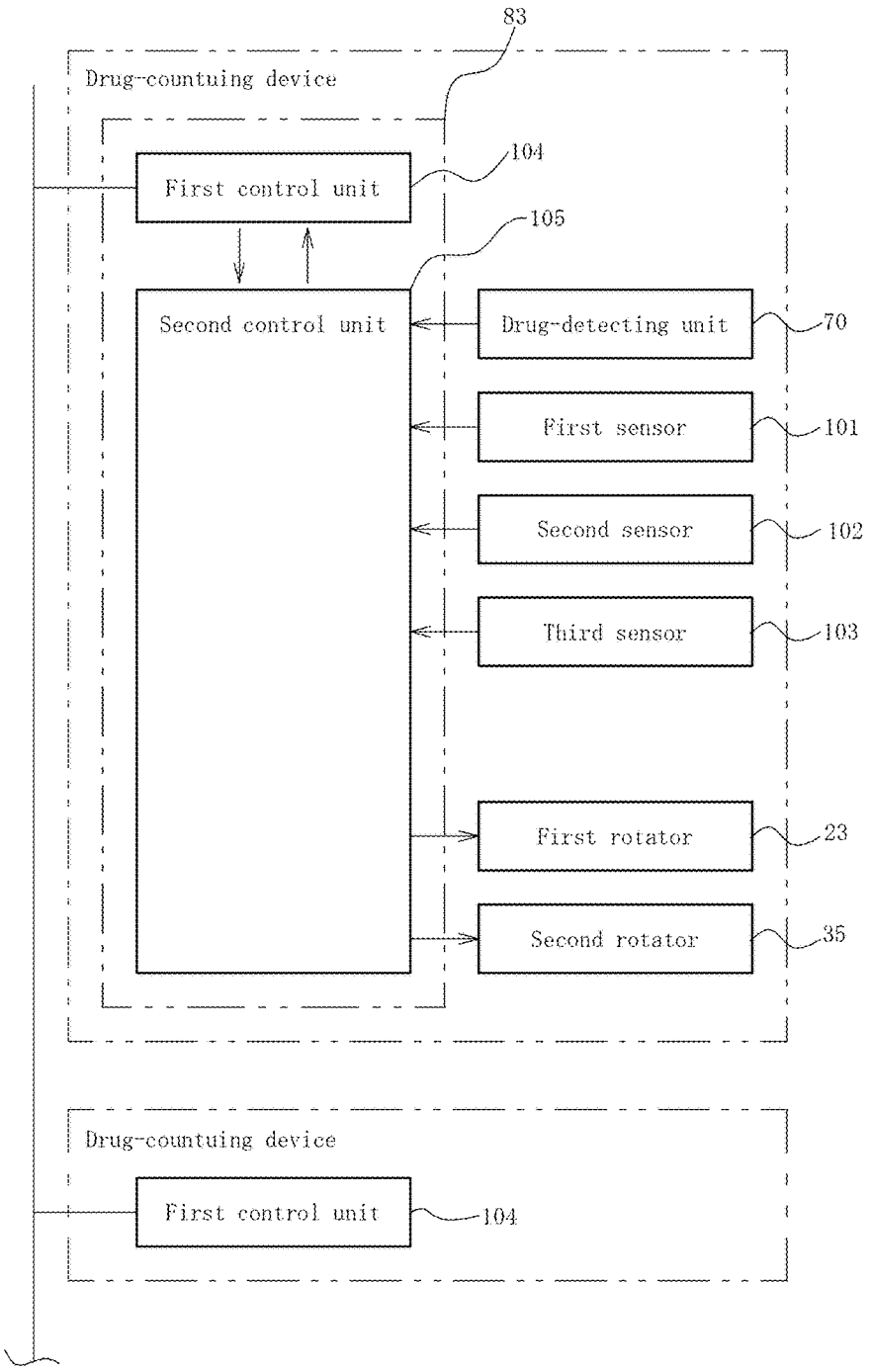
FIG. 34 is a block diagram of a medicine-counting device in accordance with another embodiment.

In the embodiment, the control unit 83 controls driving of each member and however, as shown in FIG. 34, the control unit 83 may be configured of a first control unit 104 and a second control unit 105. That is, to communicate with another device via a network, the first control unit 104 may perform communication, or issue a command to the second control unit 105 or receive a detection value. The second control unit 105 may acquire detection data of the medicine-detecting unit 70 and the first to third sensors 101 to 103, and control driving of each driving member (first rotator 23, second rotator 35, etc.).

Figure 24:
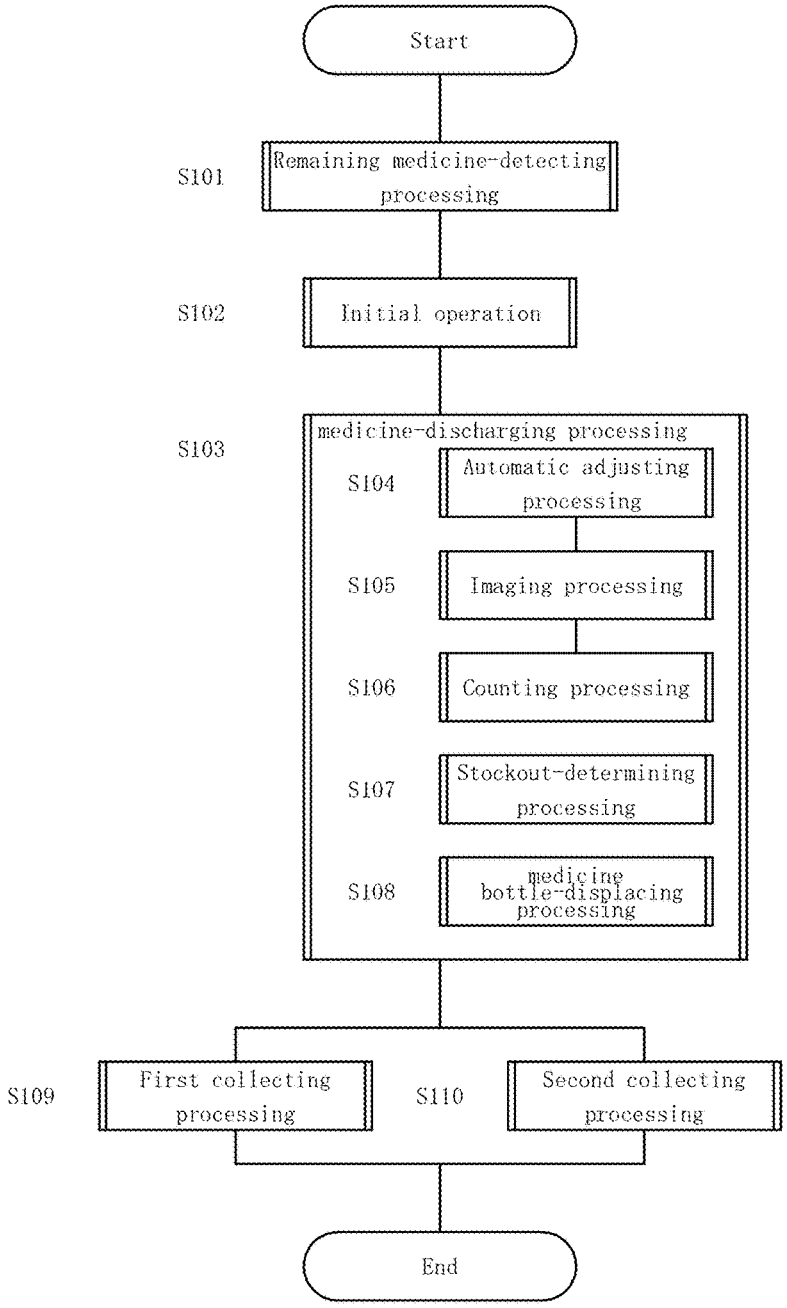
FIG. 24 is a flow chart illustrating overall processing of the medicine-counting device in accordance of another embodiment

In the embodiment, after the initial operation, the medicine-discharging processing including the automatic adjusting processing and the counting processing is executed and however, as shown in FIG. 24, following processing may be added. That is, remaining medicine-detecting processing (Step S101) is executed, and after the initial operation (Step S102), the medicine-discharging processing (Step S103) may be executed. In the medicine-discharging processing, in addition to the automatic adjusting processing (Step S104) and the counting processing (Step S106), imaging processing (Step S105), stockout-determining processing (Step S107) or medicine bottle-dispensing processing (Step S108) may be executed. The sequence of the automatic adjusting processing and the imaging processing may be changed. After the medicine-discharging processing, first collecting processing (Step S109) or second collecting processing (Step S110) may be executed.

(Remaining Medicine-Detecting Processing)

Figure 25:
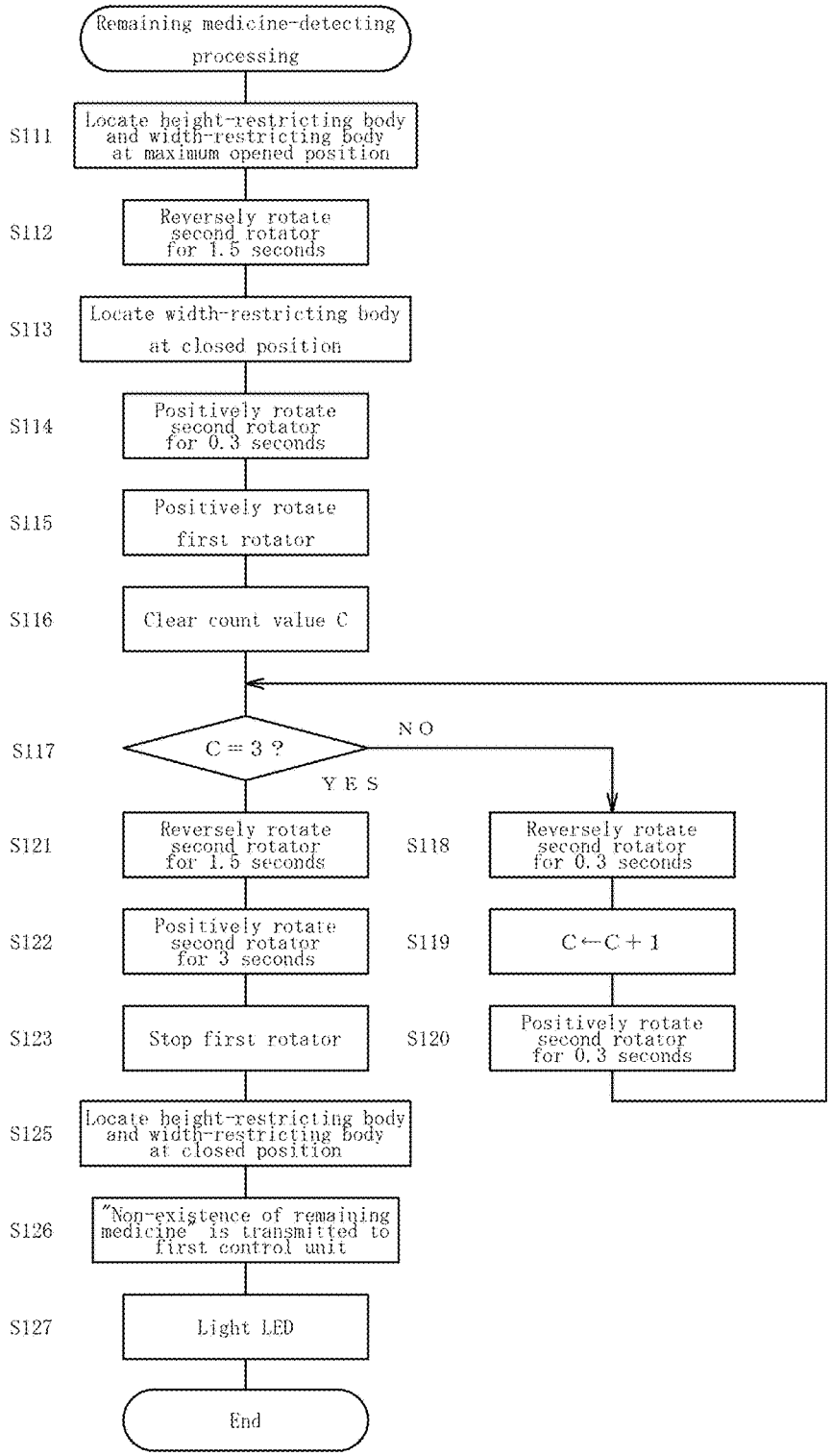
FIG. 25 is a flow chart illustrating remaining medicine-detecting processing in the medicine-counting device.
Figure 26:
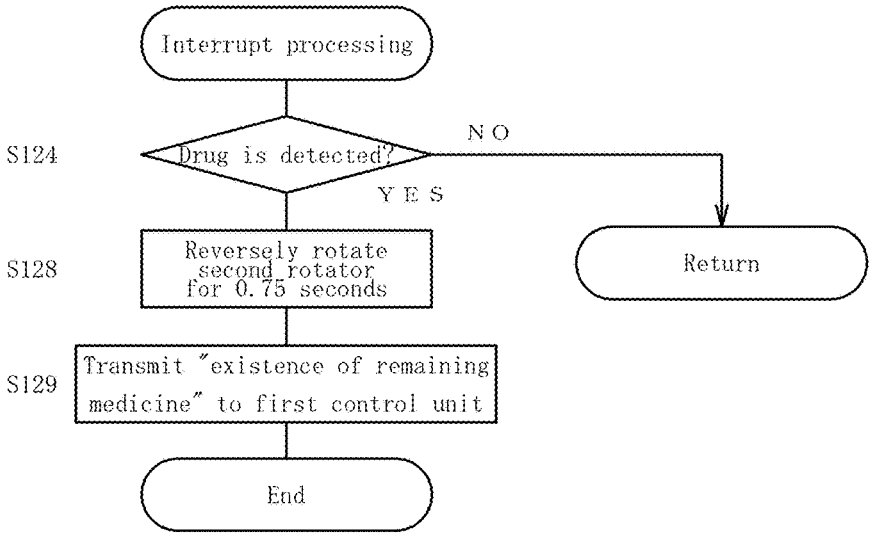
FIG. 26 is a flow chart illustrating interrupt processing in the remaining medicine-detecting processing in FIG. 25.

The remaining medicine-detecting processing may be executed before the initial operation. The remaining medicine-detecting processing will be described below with reference to flow charts of FIG. 25 and FIG. 26.

Figures 38A, 38B, 38C, 38D, 38E, 38F, 38G, 38H:
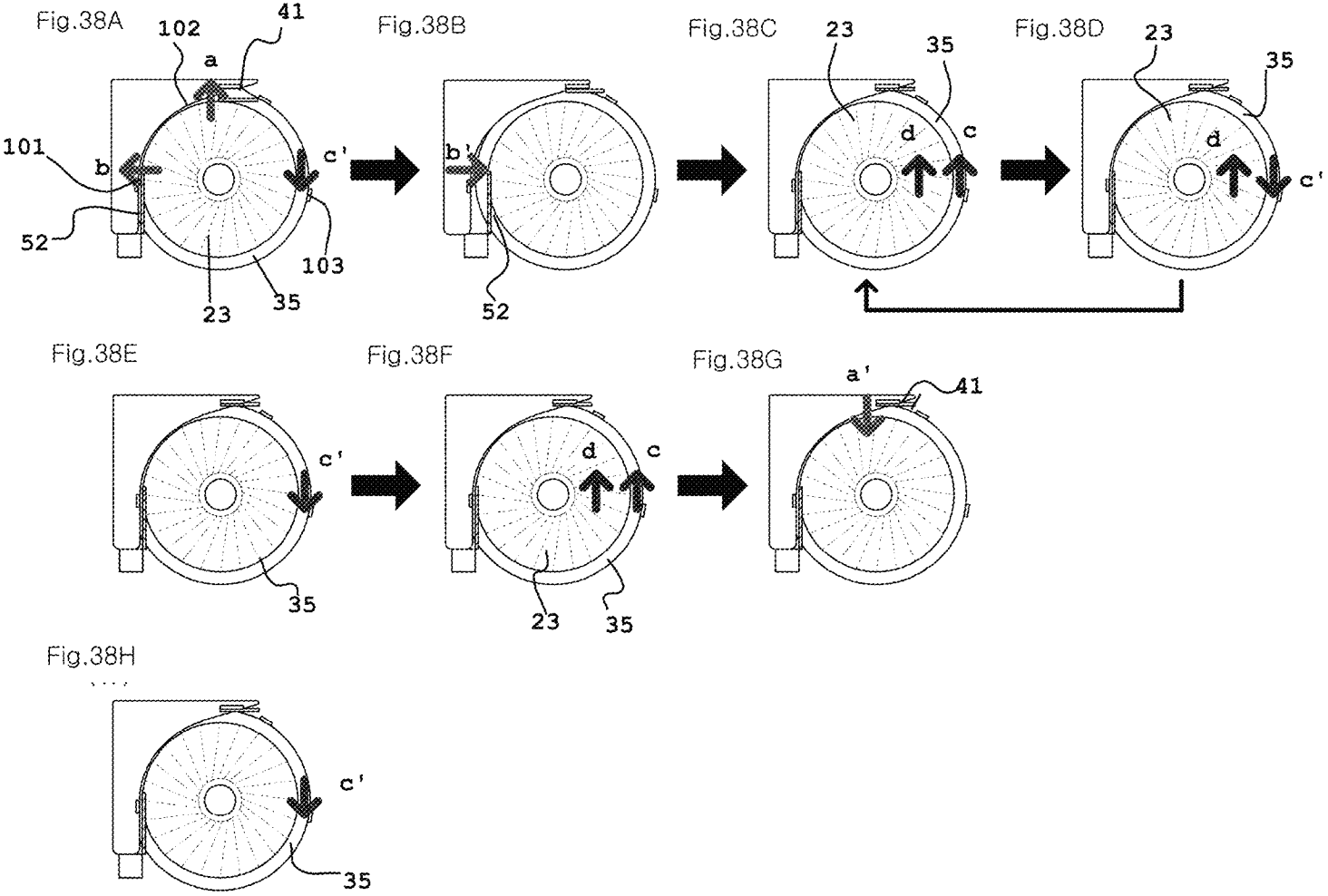
FIG. 38A through FIG. 38H are schematic views illustrating the operation of the rotator and so on in the remaining medicine-detecting processing in FIG. 25 and FIG. 26.

In the remaining medicine-detecting processing, when power is turned on to activate the medicine-counting device, as shown in FIG. 38A, the height-restricting body 41 and the width-restricting body 52 are moved in directions of arrows a and b (in the figure, the direction of the arrow a is an upward direction, but is actually a direction orthogonal to the sheet. The same applies hereinafter), and are located at respective maximum opened positions (Step S111). The maximum opened position means a position where the height or width formed by the height-restricting body 41 or the width-restricting body 52, with which a medicine can pass on the second rotator 35 (a gap above the second rotator 35 or a radial gap above the second rotator 35) becomes maximum. Then, in the state where the height-restricting body 41 and the width-restricting body 52 are moved to the respective maximum opened positions, the second rotator 35 is reversely rotated in a direction of an arrow c' at a maximum speed for a predetermined time (here, 1.5 seconds) (Step S112). This can move remaining medicines on the second rotator 35 in the opposite direction to the discharge direction.

Subsequently, as shown in FIG. 38B, the width-restricting body 52 is moved in a direction of an arrow b', and is located at a closed position (Step S113). The closed position means a position where the height or width formed by the height-restricting body 41 or the width-restricting body 52, with which a medicine can pass on the second rotator 35 (a gap above the second rotator 35 or a radial gap above the second rotator 35) becomes "0". Then, as shown in FIG. 38C, the second rotator 35 is positively rotated in a direction of an arrow c at the maximum speed for a predetermined time (here, 0.3 seconds) (Step S114), and the first rotator 23 is positively rotated in a direction of an arrow d' at the maximum speed (Step S115). This can move remaining medicines on the first rotator 23 onto the second rotator 35.

Here, a count value C of a repeat counter is cleared (Step S116), and when the second rotator 35 stops, it is determined whether or not the count value C is 3 (Step S117). When the count value is not 3, as shown in FIG. 38D, the second rotator 35 is reversely rotated in the direction of the arrow c' at the maximum speed for a predetermined time (here, 0.3 seconds) (Step S118). When the second rotator 35 stops, 1 is added to the count value C (Step S119), and as shown in FIG. 38C, the second rotator 35 is positively rotated in the direction of the arrow c at the maximum speed for a predetermined time (here, 0.3 seconds) (Step S120). The rotation of the first rotator 23 is kept during the period, and any medicine on the first rotator 23 is conveyed onto the second rotator 35.

The second rotator 35 repeats its positive rotation and reverse rotation, medicines can be moved to the outer circumference without being accumulated at the rib 35*a* (See FIGS. 23A to 23C) on the inner edge of the second rotator 35. For this reason, a range that can be detected by the second sensor 102 or the third sensor 103 does not need to extend up to the inner circumference of the second rotator 35, and only needs to extend to the outer circumference of the second rotator 35: When the range that can be detected by the second sensor 102 or the third sensor 103 is extended, the rib 35*a* of the second rotator 35 may be wrongly detected as a medicine, which is prevented in this embodiment.

After that, when the count value C becomes 3 (Step S117: YES), as shown in FIG. 38E, the second rotator 35 is reversely rotated in the direction of the arrow c' at the maximum speed for a predetermined time (here, 1 second) (Step S121). When the second rotator 35 stops, as shown in FIG. 38F, the second rotator 35 is positively rotated in the direction of the arrow c at the maximum speed for a predetermined time (here, 3 seconds) (Step S122). When the second rotator 35 stops, the first rotator 23 is stopped (Step S123). At this time, as shown in FIG. 38G, the height-restricting body 35 is moved in a direction of an arrow a' (in the figure, the direction of the arrow a is a downward direction, but is actually a rearward direction orthogonal to the sheet. The same applies hereinafter), and is located at the closed position.

During the processing in each of Steps S118 to S123, it is determined whether or not the second sensor 102 detects any medicine at all times (Step S124).

When no medicine is detected (non-existence of remaining medicine), Steps S118 to S123 are continued, and after completion of Step S123, the height-restricting body 41 and the width-restricting body 52 are moved to the respective closed positions (Step S125) and then, "non-existence of remaining medicine" is transmitted to the first control unit 104 (Step S126). As shown in below-mentioned FIG. 35, a dispensing display LED 107*a* and a collecting display LED 107*b* of an operation display part 107 are lighted (Step S127) to finish the remaining medicine-detecting processing.

On the contrary, when the medicine is detected (existence of remaining medicine), as shown in FIG. 38H, the second rotator 35 is reversely rotated in the direction of the arrow c' at the maximum speed for a predetermined time (here, 0.75 seconds) (Step S128), and after stop of the rotation, "existence of remaining medicine" is transmitted to the first control unit (Step S129) to finish the remaining medicine-detecting processing.

As described above, the medicine-supplying device capable of executing the remaining medicine-detecting processing has following features.

That is, the medicine-supplying device includes:

a first rotator configured to positively rotate about a first rotary shaft to convey a medicine in a circumferential direction and an outer diameter direction;

a second rotator located on the outer circumferential side of the first rotator, the second rotator positively and reversely rotating about a second rotary shaft to convey the medicine in the circumferential direction;

a dispensing part disposed on the outer diameter side of the second rotator, the dispensing part discharging the conveyed medicine;

a height-restricting body disposed upstream from the dispensing part in the rotational direction of the second rotator, the height-restricting body having an adjustable distance from an upper face of the second rotator;

a width-restricting body disposed between the dispensing part and the height-restricting body, the width-restricting body having an adjustable distance from an inner edge of the second rotator; and a control unit configured to move the height-restricting body and the width-restricting body to respective maximum opened positions before a counting processing, and to execute remaining medicine-detecting processing of reversely rotating the second rotator to move the width-restricting body to a closed position and then, positively rotating the width-restricting body.

With this configuration, medicine clogging, if occurs, can be eliminated by reversely rotating the second rotator in the state where the height-restricting body and the width-restricting body are moved to the respective maximum opened positions. In the case where the second rotator is positively rotated, the width-restricting body may be moved to the closed position to detect possible remaining medicines.

(Imaging Processing)

The second control unit 105 enables imaging processing of causing a medicine camera 106 (corresponding to the third camera 89*c* in the embodiment) to take an image of medicines after the automatic adjusting processing, and storing the image.

Figure 27:
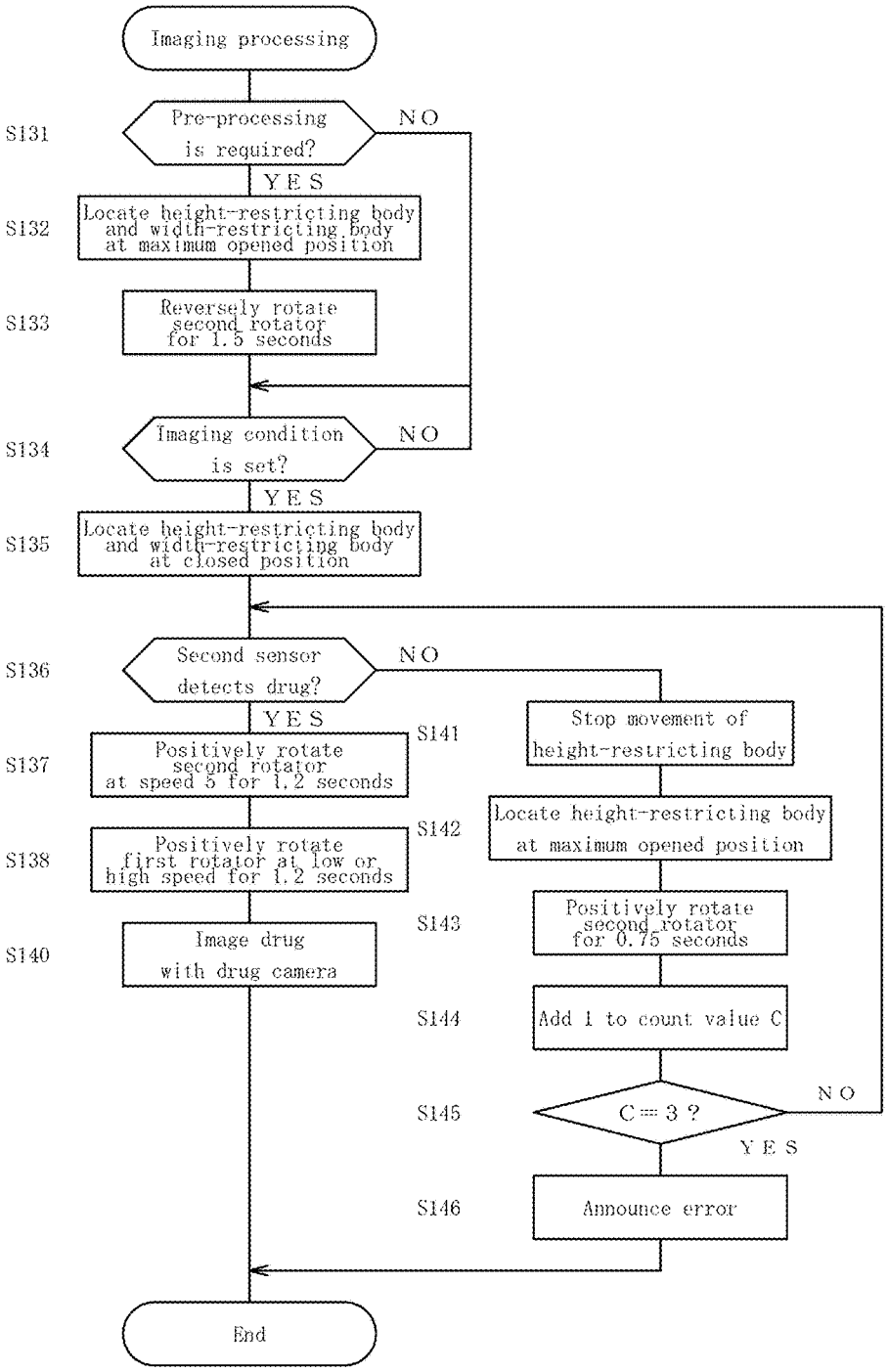
FIG. 27 is a flow chart illustrating imaging processing in the medicine-counting device.
Figures 39A, 39B, 39C, 39D, 39E, 39F, 39G:
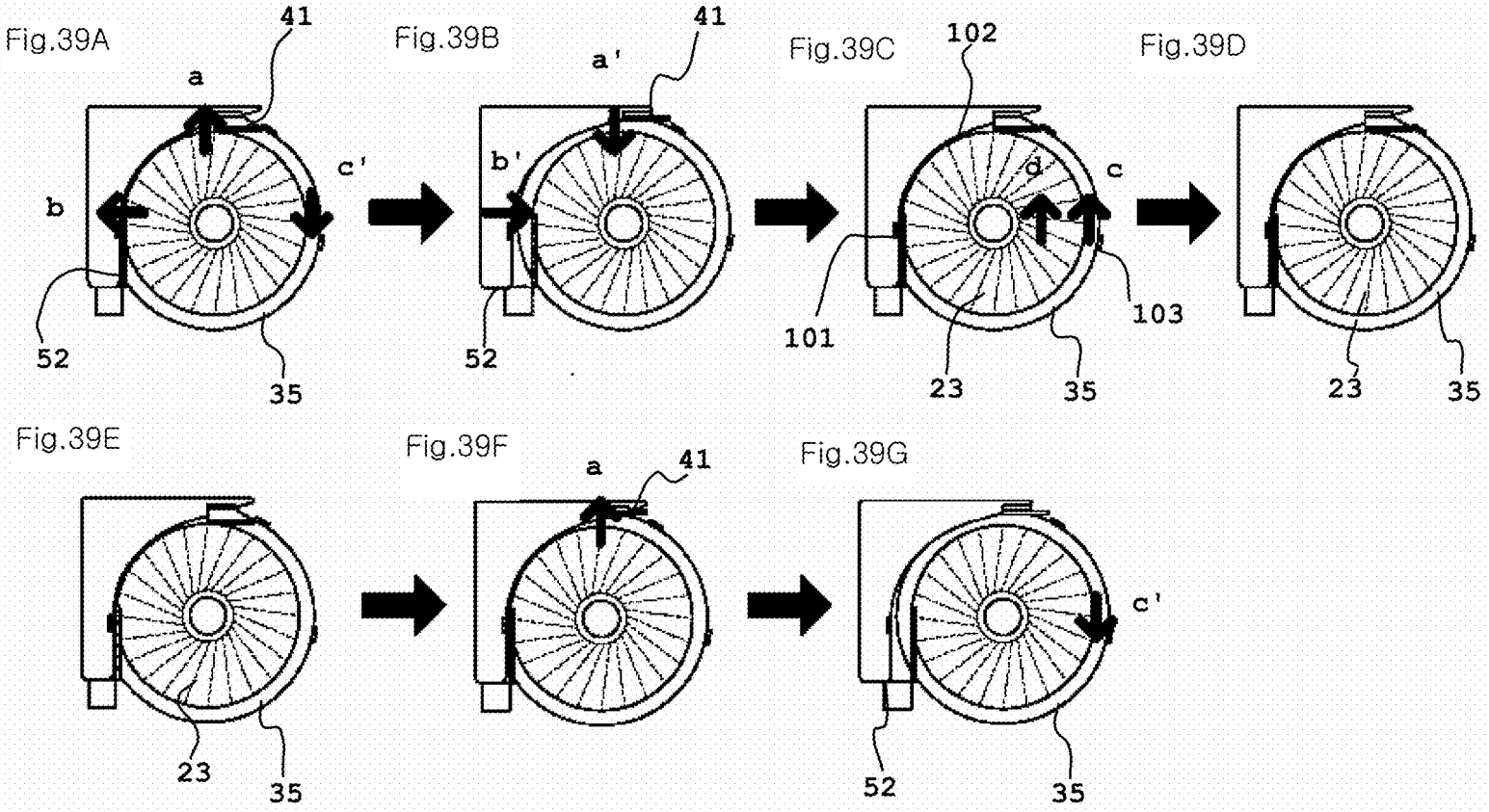
FIG. 39A through FIG. 39G are schematic views illustrating the operation of the rotator and so on in the imaging processing in FIG. 27.

In the imaging processing, as shown in flow chart of FIG. 27, before starting of imaging with the medicine camera 106, when pre-processing is required according to notification from the first control unit 104 (Step S131: YES), as shown in FIG. 39A, the width-restricting body 52 and the height-restricting body 41 are moved in the directions of the arrows b and a, respectively, and are located at the respective maximum opened positions (Step S132). Then, the second rotator 35 is reversely rotated in the direction of the arrow c' at the maximum speed for a predetermined time (here, 1.5 seconds) (Step S133). When no pre-processing is required (Step S131: NO), Steps S132 and S133 are not performed, and the flow proceeds to Step S134.

Subsequently, it is determined whether or not an imaging condition (as described later, selection of a lighting member to be used from a plurality of lighting members, or adjustment of focus of the camera) in an imaging region is set (Step S134). When the imaging condition is set, as shown in FIG. 39B, the width-restricting body 52 and the height-restricting body 41 are moved in the directions of the arrows b' and a, respectively, and are located at the respective closed positions (Step S135).

Figure 43:
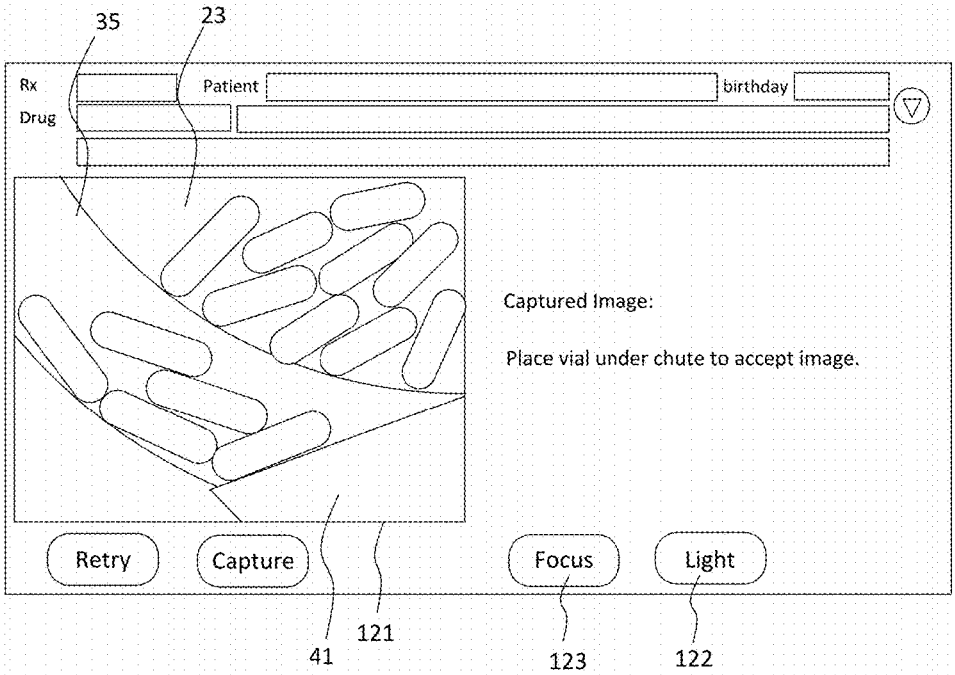
FIG. 43 is a view illustrating an image adjusting screen displayed on the monitor in FIG. 36.

After that, it is determined whether or not the second sensor 102 detects a medicine (Step S136). When no medicine is detected (Step S136: NO), it is determined as a normal state, and as shown in FIG. 39C, the second rotator 35 is positively rotated in the direction of the arrow c at a speed 5 (5 in 7 stages, maximum speed of 7) for a predetermined time (here, 1.2 seconds) (Step S137). Simultaneously, the first rotator 23 is positively rotated in a direction of an arrow d at a low or high speed for a predetermined time (here, 1.2 seconds) (Step S138). In this case, the first rotator 23 may be positively rotated at the high speed when the third sensor 103 does not detect the medicine and may be positively rotated at the low speed when the third sensor 103 detects the medicine, for the predetermined time. Through the positive rotation of the first rotator 23 and the second rotator 35, medicines on the first rotator 23 are moved onto the second rotator 35, and medicines on the second rotator 35 are moved to the predetermined region (imaging region) upstream from the height-restricting body 41 in the rotational direction of the second rotator 35. In this state, as shown in FIG. 39D, the first rotator 23 and the second rotator 35 are stopped, and the medicine camera 106 takes an image (Step S140). A resultant of imaging is displayed on the monitor 88 as shown in FIG. 43.

On the contrary, when the second sensor 102 detects a medicine in Step S136, it is determined as an abnormal state where the medicine is present at an improper position and as shown in FIG. 39E, the movement of the height-restricting body 41 is stopped (Step S141). Then, as shown in FIG. 39F, the height-restricting body 41 is moved in the direction of the arrow a, and is located at the maximum opened position (Step S142). Further, as shown in FIG. 39G, the second rotator 35 is reversely rotated in the direction of the arrow c' for a predetermined time (here, 0.75 seconds) (Step S143). 1 is added to the count value (Step S144), and the flow returns to Step S136 to repeat the above processing until the count value reaches a predetermined number of times (here, three) (Step S145). Even during the repeated processing, when the second sensor 102 detects a medicine, it is determined as abnormal, and an error is announced (Step S146).

In Step S134, the imaging condition can be set as follows.

For example, the imaging condition is set by selecting among a plurality of lighting members (for example, LEDs not shown) for lighting the region that can be imaged with the medicine camera 106 (imaging region). The plurality of lighting members are vertically aligned in a part of the outer wall 20 upstream from the height-restricting body 41 in the rotational direction of the second rotator 35. Imaging conditions can be freely set by the user. Here, an image adjusting screen including an image 121 taken with the medicine camera 106 as shown in FIG. 43 is displayed on the monitor 88, and one of "top", "middle", "bottom", and "off" can be selected by operating a "light" button 122 (one of lighting with the top lighting member, lighting with the middle lighting member, lighting with the bottom lighting member, and no lighting is selected). This can light medicines in an optimum imaging state depending on the medicine shape, and the orientation and number of the medicines. The number of the lighting members may be one. In the case of single lighting member, the imaging condition can be set by selecting either lighting or non-lighting.

The medicine camera 106 may have an autofocus function, or may set a focal length for each medicine in consideration with an effect of the medicine thickness. Preferably, the focal length may be manually set for each medicine type at first imaging, and thereafter automatically set. The focal length set once may be stored in association with the medicine, and the stored data may be used at next imaging. At this time, by operating a "focus" button 123 on the image identifying screen to select either "high" or "low", the focal position can be placed on an upper side or lower side.

As described above, the medicine-supplying device capable of executing the imaging processing has following features.

That is, the medicine-supplying device includes:

a first rotator configured to positively rotate about a first rotary shaft to convey a medicine in a circumferential direction and an outer diameter direction;

a second rotator located on the outer circumferential side of the first rotator, the second rotator positively rotating about a second rotary shaft to convey the medicine in the circumferential direction;

a dispensing part disposed on the outer diameter side of the second rotator, the dispensing part discharging the conveyed medicine;

a restricting body disposed upstream from the dispensing part in a positive rotational direction of the second rotator, the restricting body being configured to restrict passage of the medicine;

an imaging unit configured to image an imaging region located upstream from the restricting body in the positive rotational direction of the second rotator; and a control unit configured to cause the restricting body to restrict movement of the medicine and positively rotate the second rotator, thereby causing the imaging unit to take an image of the imaging region in the state where the medicine is located in the imaging region.

With this configuration, the imaging unit can reliably image the medicine in the state where the medicine is located in the imaging region.

Preferably, the control unit executes the clog-eliminating processing of moving the restricting body to the maximum opened position and reversely rotating the second rotator and then, executing the imaging processing.

Preferably, the control unit executes the clog-eliminating processing plural times.

With the configuration, since medicines can be imaged after elimination of clogging of medicines, the medicines can be imaged in a more suitable state, and the flow can be smoothly shifted to subsequent medicine-dispensing processing.

Irradiating units for irradiating the imaging region are preferably provided.

Preferably, an irradiating condition can be set by selecting the irradiating unit to be used out of a plurality of the irradiating units, and the control unit causes the selected imaging unit to take an image according to the set irradiating condition.

With this configuration, the irradiating unit can irradiate the imaging region according to the irradiating condition suitable for imaging medicines using the imaging unit.

(Imaging Omitting Mode)

The imaging processing may be omitted unless mandated by law.

(Counting Processing)

Figure 28:
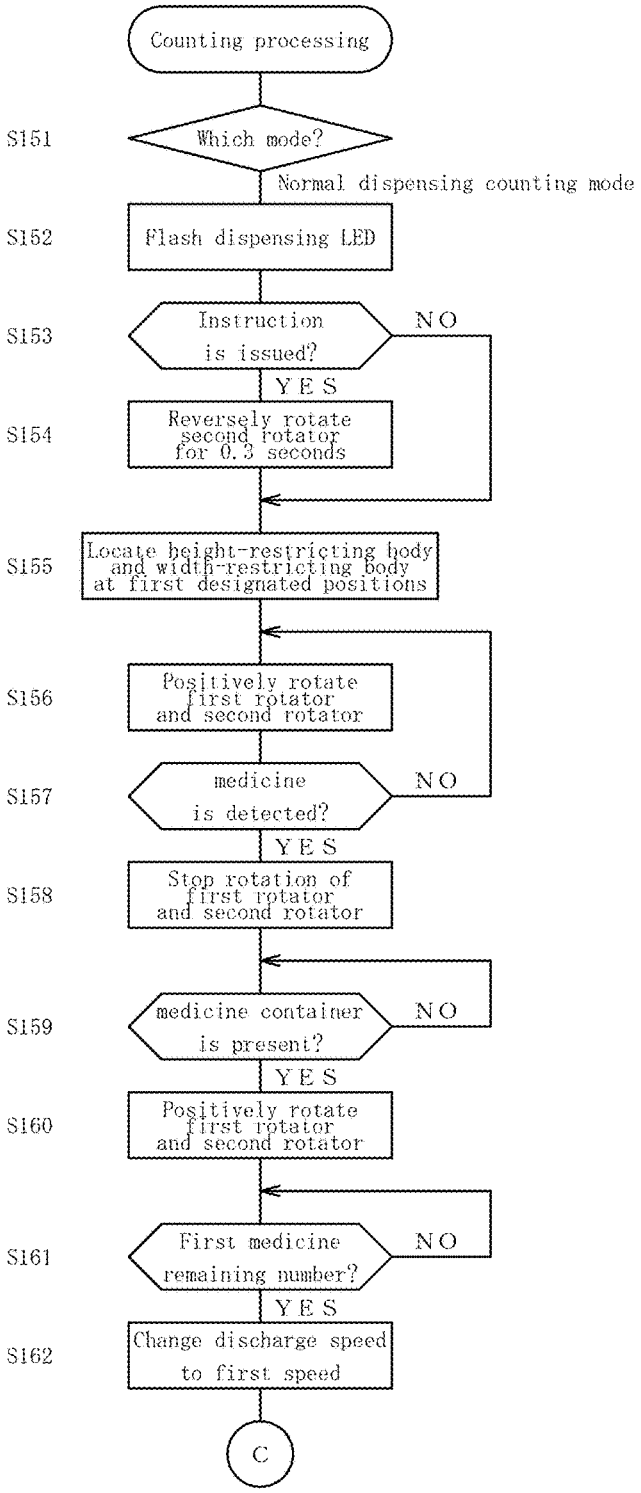
FIG. 28 is a flow chart illustrating medicine-discharging processing in the medicine-counting device.
Figure 29:
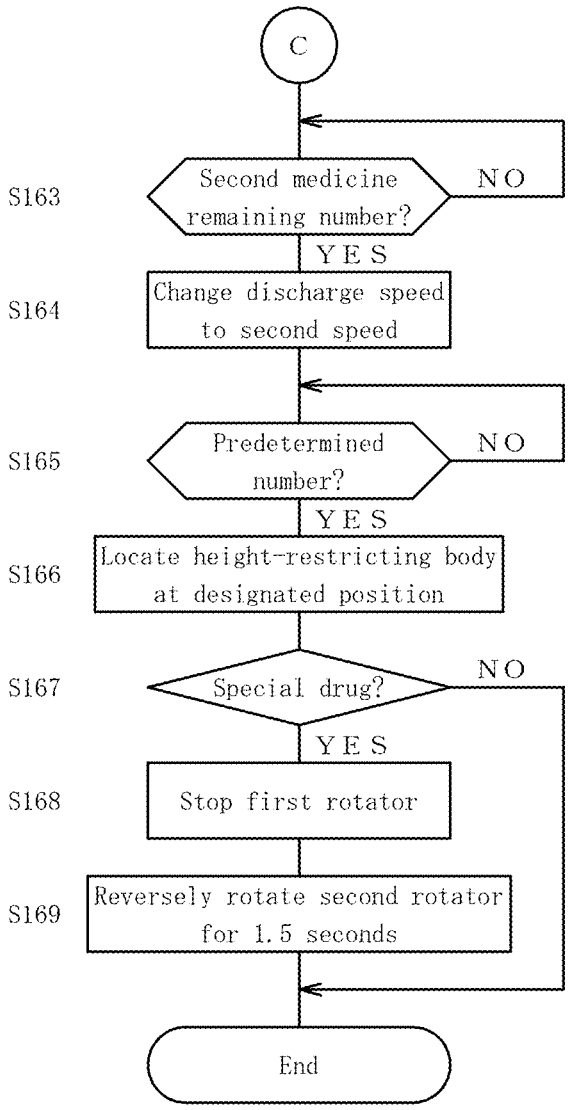
FIG. 29 is a flow chart illustrating medicine-discharging processing in the medicine-counting device.

The counting processing may have a plurality of modes as described below. That is, as shown in flow charts of FIG. 28 and FIG. 29, first, it is determined in which mode medicines are dispensed and counted (Step S151). For example, one of following modes (1) to (3) may be determined by reading a bar code of a prescription, the medicine container 1, or a medicine bottle with the bar code reader and entering an inquiry into a server (Specifically, the mode (1) is performed when the bar code of the prescription is read, the mode (2) is performed when the bar code of the medicine container 1 is read, and the mode (3) is performed when the bar code of the medicine bottle is read).

(1) A normal dispensing count mode of dispensing a predetermined number of medicines supplied from the medicine bottle to the medicine-counting device according to the prescription into the medicine container 1 for the patient.

(2) A recount mode of reconfirming the number of medicines dispensed into the medicine container 1 in the normal dispensing count mode by using another medicine-counting device (3) A stock count mode of counting the number of all medicines supplied from the medicine bottle to the medicine-counting device, and confirming the stock stored in the medicine bottle.

The normal dispensing count mode will be described below.

Figures 40A, 40B, 40C, 40D, 40E, 40F, 40G, 40H:
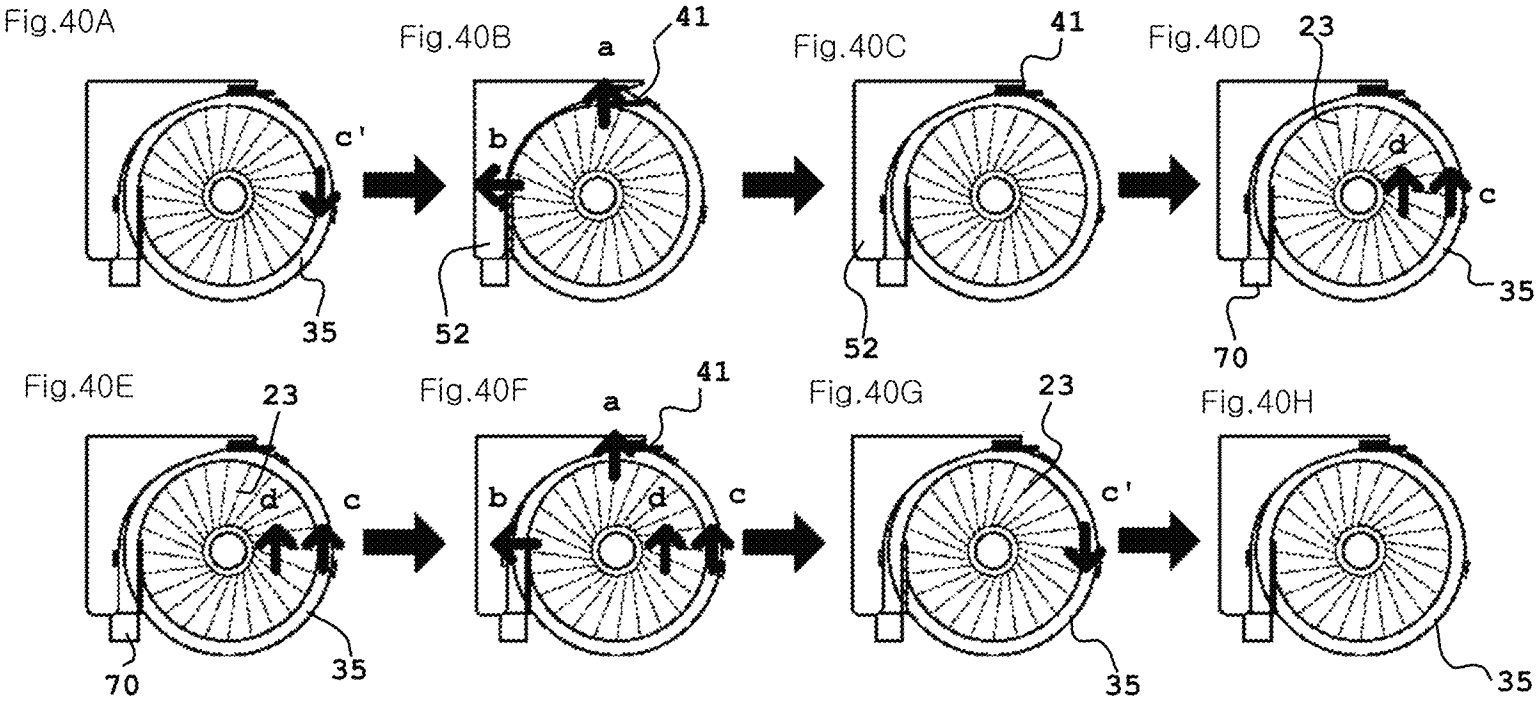
FIG. 40A through FIG. 40H are schematic views illustrating the operation of the rotator and so on in the medicine-discharging processing in FIG. 28 and FIG. 29.

That is, in the normal dispensing count mode, first, the dispensing display LED 107*a* of the operation display part is flashed (Step S152). When an instruction is made from the first control unit 104 (Step S153: YES), as shown in FIG. 40A, the second rotator 35 is reversely rotated in the direction of the arrow c' at the maximum speed for a predetermined time (here, 0.3 seconds) (Step S154). Subsequently, as shown in FIG. 40B, the height-restricting body 41 and the width-restricting body 52 are moved in the directions of the arrows a and b, respectively, and each are located at a first designated position (Step S155). The first designated position means the position determined in the automatic adjusting processing, that is, the position at which the medicine can pass according to the measured medicine size (the height-restricting position and the width-restricting position). When no instruction is made from the first control unit 104 (Step S153: NO), Step S155 is performed by bypassing Step S154. The above-mentioned instruction from the first control unit 104 means an instruction to omit the clog-eliminating processing in Step S154 when it is determined that no remaining is present immediately after the collecting processing.

As shown in FIG. 40C, when the movement of the height-restricting body 41 and the width-restricting body 52 are finished, as shown in FIG. 40D, the first rotator 23 and the second rotator 35 are positively rotated in the directions of the arrows d and c, respectively (Step S156). When the first sensor 101 detects a medicine (Step S157), the positive rotation of the first rotator 23 and the second rotator 35 is stopped (Step S158). This completes preparation for medicine-dispensing. By moving medicines at the position just in front of a discharge port and positively rotating the first rotator 23 and the second rotator 35, medicine dispense can be immediately started without any time-lag.

Subsequently, it is determined whether or not the medicine container 1 is disposed at a medicine-dispensing position (Step S159), when the medicine container 1 is disposed at the position, as shown in FIG. 40E, the first rotator 23 and the second rotator 35 are positively rotated in the directions of the arrows d and c, respectively (Step S160). The first rotator 23 is positively rotated at a preset constant speed, and the second rotator 35 is positively rotated at a designated speed set by the first control unit 104. The designated speed is set for each medicine type. Thereby; the medicine-detecting unit 70 detects a medicine to start medicine counting. When the count value of medicines reaches a predetermined first set value, as in Steps S56 to S59 in the embodiment, slowdown processing of controlling the rotational speed of the second rotator 35 is executed.

That is, when the number of remaining medicines to be discharged reaches the first remaining number stored in the memory 87 (Step S161), the discharge speed (rotational speed of the second rotator 35) of the medicine guiding part 65 is lowered to the first speed (Step S162). After that, when the number of remaining medicines to be discharged reaches the second remaining number (Step S163), the discharge speed is lowered to the second speed that is slower than the first speed (Step S164).

When the number of discharged medicines reaches a predetermined number before reaching the scheduled number of dispensed medicines (Step S165), as shown in FIG. 40F, the height-restricting body 41 is moved in the direction of the arrow a, and is located at a second designated position (Step S166). The second designated position is designated from the first control unit 104, and is extended from the first designated position in Step S155 so as to facilitate passage of remaining medicines.

It is determined whether or not medicines are special medicines (Step S167). That is, in the case of rollable medicines such as round medicines, as shown in FIG. 40G, the first rotator 23 is stopped (Step S168), and the second rotator 35 is reversely rotated in the direction of the arrow c' for a predetermined time (here, 1.5 seconds) (Step S169). This can reliably prevent more special medicines than required from being discharged. When medicine dispense is completed, as shown in FIG. 40H, the reverse rotation of the second rotator 35 is stopped.

In the recount mode, the second rotator 35 is positively rotated at a constant speed to the end without executing the slowdown processing of the second rotator 35 in Steps S161 to S164. Since the recount mode is performed to recount the number of counted medicines for confirmation, and there is no possibility that an extra medicine is dispensed at the last dispense as in the normal dispensing count mode, a high priority is given to reduction in counting time.

Also in the stock count mode like the recount mode, the second rotator 35 is positively rotated at the constant speed to the end without executing the slowdown processing of the second rotator 35 in Steps S161 to S164. However, in the stock count mode, below-mentioned stockout-determining processing is not executed.

As described above, the medicine-supplying device capable of executing one of the above-mentioned three modes has following features.

That is, the medicine-supplying device includes:

a rotator configured to positively rotate about a rotary shaft to convey a medicine in a circumferential direction;

a dispensing part disposed on the outer diameter side of the rotator;

a counting unit configured to count the number of medicines dispensed from the dispensing part; and a control unit configured to positively rotate the rotator on the basis of prescription data, and to execute a normal dispensing mode of lowering the rotational speed of the rotator when a count value of the counting unit reaches a predetermined value, and stopping the positive rotation of the rotator when the count value reaches a prescribed number in the prescription data.

With this configuration, medicines can be automatically dispensed based on the number of prescribed medicines in the prescription data. Since the rotational speed of the rotator is lowered before the count value reaches the prescribed number, dispensing of medicines more than the number of prescribed medicines can be prevented.

Preferably, the control unit further performs the recount mode of positively rotating the rotator at a constant speed, counting all medicines discharged from the dispensing part with the counting unit, and determining whether or not the count value matches the prescribed number in the prescription data.

With this configuration, since the rotational speed of the rotator is not lowered, the number of dispensed medicines can be confirmed at high speed.

Preferably, the control unit further performs the stock count mode of positively rotating the rotator at a constant speed, and counting all medicines discharged from the dispensing part with the counting unit.

Preferably, an imaging unit capable of imaging the prescription and a standing medicine solution bottle that stores liquid medicine, and a storing unit are further provided, and the control unit further performs a liquid medicine mode of storing the image taken with the imaging unit along with information for specifying the liquid medicine in the storing unit.

With this configuration, since the medicine solution bottle in the standing position is imaged, the level of the liquid medicine can be captured as image data. Further, since the prescription is also imaged, the prescription and the liquid medicine are associated with each other in the image.

Preferably, in the counting processing, a soiled state of a count sensor of the medicine-detecting unit 70 is first checked.

That is, a maximum A/D value of the count sensor is detected, and it is determined whether or not the maximum A/D value exceeds a soil detecting level. When the maximum A/D value exceeds the soil detecting level, it is determined that the count sensor becomes soiled, and a warning is issued to the first control unit 104. After cleaning of the count sensor, release processing (for example, operation of a release button) is executed, and in response to a release command from the first control unit 104, the maximum A/D value of the count sensor is detected again. Then, it is determined whether or not the maximum A/D value exceeds a soil release level set to be a smaller value than the soil detecting level. The warning is issued again when the maximum A/D value does not fall below the soil release level, and warning release is performed when the maximum A/D value falls below the soil release level. By providing a difference between the soil detecting level and the soil release level, frequent switching between the warning issuance and the warning release can be prevented.

Figure 36:
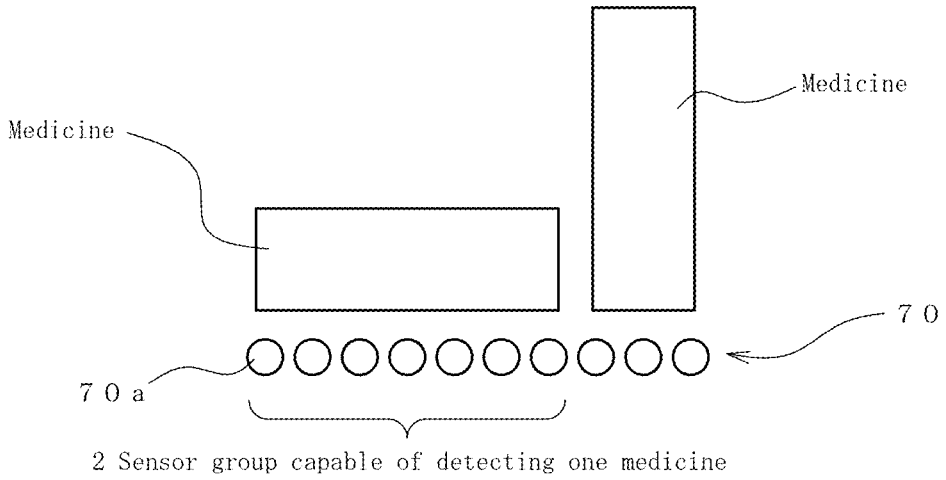
FIG. 36 is a schematic view illustrating the medicine-detecting state in a detection unit of the medicine-counting device in FIG. 34.

In the counting processing, the medicine-detecting unit 70 detects the medicine volume. At this time, for example, as shown in FIG. 36, two medicines may partially overlap each other. In this case, each medicine is associated with the number of sensors 70*a* (sensor group) that can detect the medicine on the basis of the medicine size, and the associated medicine and number of the sensors 70*a* are registered in a medicine master. When the medicine is simultaneously detected by more sensors 70*a* than the number of sensors 70*a*, it is determined that two or more medicines are dispensed. Each medicine is associated with a period during which the sensors are kept ON due to passage of the medicine, and the associated medicine and time are registered in the medicine master. When the sensors are kept ON for a period exceeding the associated period, it is determined that two or more medicines are dispensed. In this manner, it can be detected that two or more medicines are dispensed by mistake, preventing wrong dispensing.

(Stockout-Determining Processing)

Figure 30:
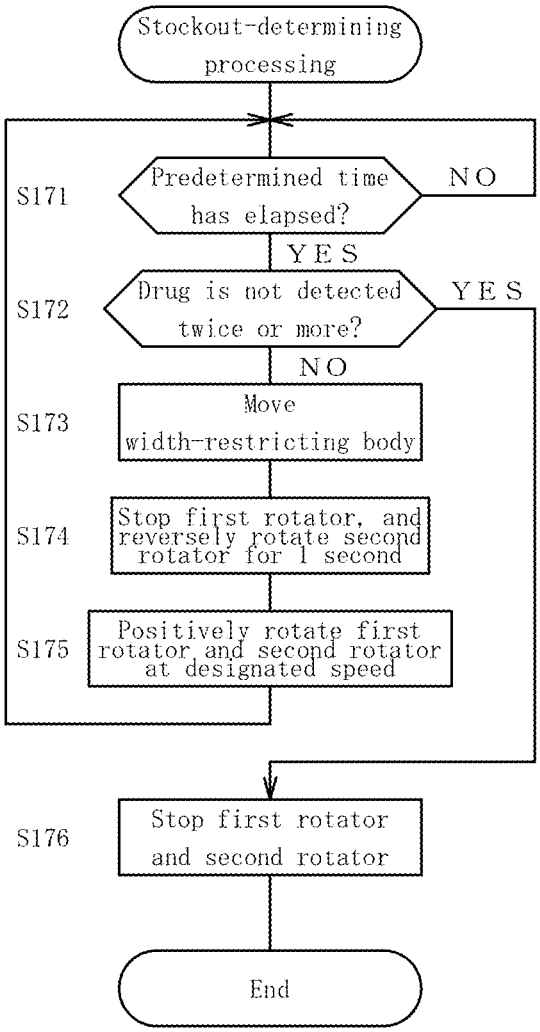
FIG. 30 is a flow chart illustrating stockout-determining processing in the medicine-counting device.

In the stockout-determining processing, as shown in flow chart of FIG. 30, when the medicine-detecting unit 70 cannot detect any medicine for a predetermined time (here, 3 seconds) during the normal dispensing count mode or the recount mode (Step S171), it is determined whether or not the number of times that the medicine-detecting unit 70 does detect the medicine is two or more (Step S172).

When the number of times that the medicine-detecting unit 70 does not detect the medicine is not two or more, the width-restricting body 52 is moved to increase the width (here, 1.2 times) (Step S173). Then, the first rotator 23 is stopped, and the second rotator 35 is reversely rotated at the maximum speed for a predetermined time (here, 1 second) (Step S174). Further, the first rotator 23 and the second rotator 35 are positively rotated at the speed designated by the first control unit 104 (Step S175). This can eliminate the failure that a remaining medicine cannot be discharged due to clogging or the like.

When the number of times that the medicine-detecting unit 70 does detect the medicine is two or more (Step S172: YES), it is determined as stockout, and the first rotator 23 and the second rotator 35 are stopped (Step S176). In this case, the stockout may be informed to the user.

Since the first rotator 23 and the second rotator 35 are positively rotated at the speed designated by the first control unit 104, when the designated speed is low, a period from the time when the medicine-detecting unit 70 does not detect a medicine to the time when reverse rotation of the second rotator 35 is started (reverse rotation time) or to the time when stockout is determined (determination time) may be set long. For example, when the designated speed is set to the lowest speed, the reverse rotation time may be 3 to 6 seconds, and the determination time may be set to 6 to 11 seconds.

(Drug Bottle-Dispensing Processing)

When the medicine bottle (or the medicine container 1. The same applies hereinafter) is displaced from a dispensing position as a dispensing destination, this displacement is addressed by the medicine bottle-dispensing processing as follows.

Figure 31:
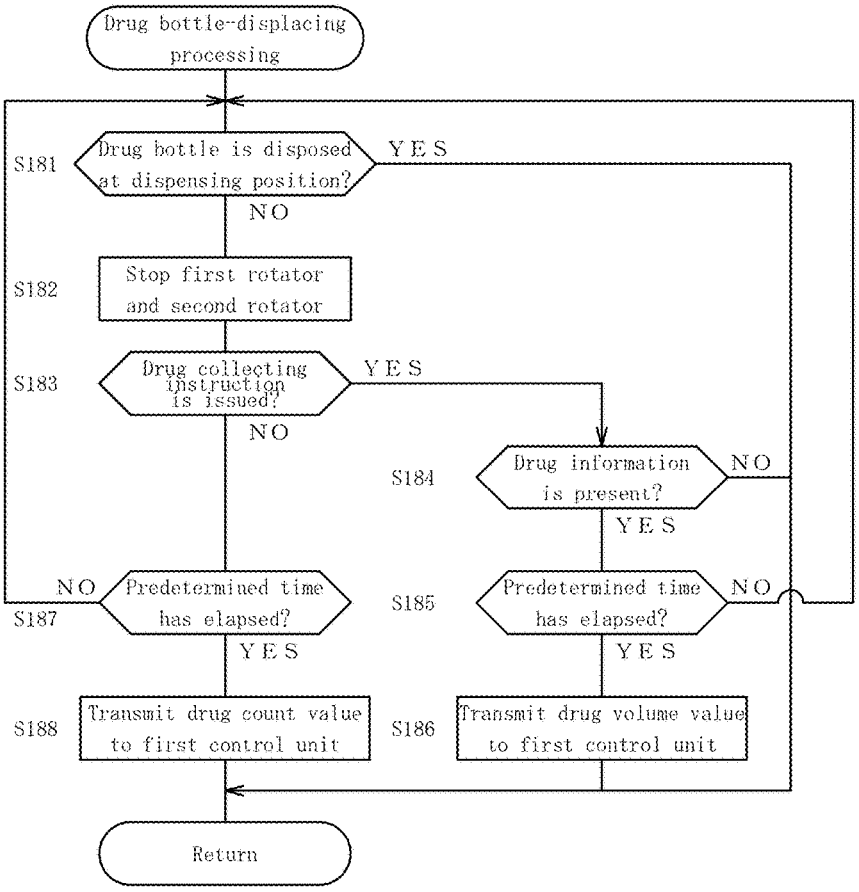
FIG. 31 is a flow chart illustrating medicine bottle-dispensing processing in the medicine-counting device.

A medicine bottle-detecting sensor not shown detects whether or not the medicine bottle is disposed at a proper position that is the dispensing position. In the medicine bottle-dispensing processing, as shown in flow chart of FIG. 31, it is determined whether or not the medicine bottle is disposed at the dispensing position according to a detection signal from the medicine bottle-detecting sensor (not shown) (Step S181). When the detection signal is OFF, it is determined that the medicine bottle is displaced from the dispensing position. At this time, when the medicine counting processing is not completed, and the first rotator 23 and the second rotator 35 are rotating, the positive rotation is forcibly stopped (Step S182). This prevents medicine leakage.

At this time, it is determined whether or not an instruction to collect medicines remaining in the medicine-counting device is made (medicine collecting instruction is issued) (Step S183). The medicine collecting instruction means an instruction to collect all medicines remaining in the medicine-counting device, and is transmitted from the first control unit 104 to the second control unit 105.

When the medicine collecting instruction is issued (Step S183: YES), it is determined whether or not information on the remaining medicines (here, medicine volume) is present (Step S184). The medicine information is an average value of volume measured from the start of counting to counting of a set number, and medicine information is not defined until the count reaches the set number. That is, in this case, the medicine information is not present.

When the medicine information is present (Step S184: YES), if the medicine bottle is not detected for a predetermined time (here, 1 second) (Step S185), the medicine information is transmitted to the first control unit 104 (Step S186) to finish the medicine bottle-dispensing processing. When no medicine information is present (Step S183: NO), the medicine bottle-dispensing processing is finished.

On the contrary, when the medicine collecting instruction is not issued (Step S183: NO), if the medicine bottle is not detected for a predetermined time (here, 1 second) (Step S187), the current medicine count value is transmitted to the first control unit 104 (Step S188) to finish the medicine bottle-dispensing processing.

(Collecting Processing)

When the normal dispensing count mode, the recount mode, or the stock count mode is finished to collect (discharge) medicines remaining in the medicine-supplying device, the first collecting processing is executed if information on the remaining medicines is present, and the second collecting processing is executed if the information on the remaining medicines is not present.

(First Collecting Processing)

Figure 32:
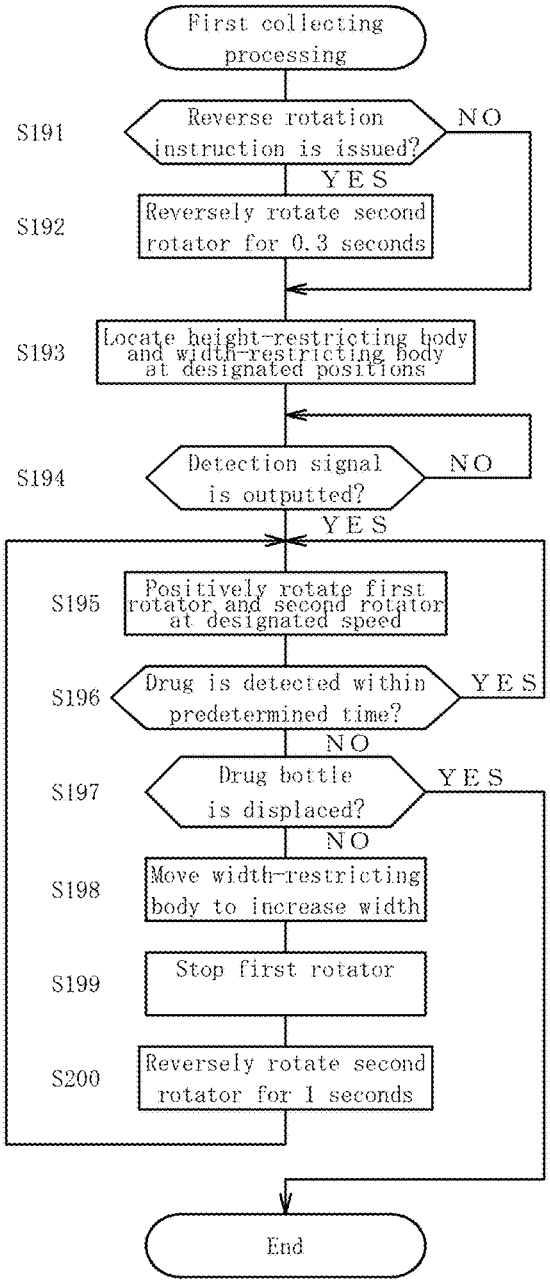
FIG. 32 is a flow chart illustrating first collecting processing in the medicine-counting device.
Figures 41A, 41B, 41C, 41D, 41E, 41F, 41G:
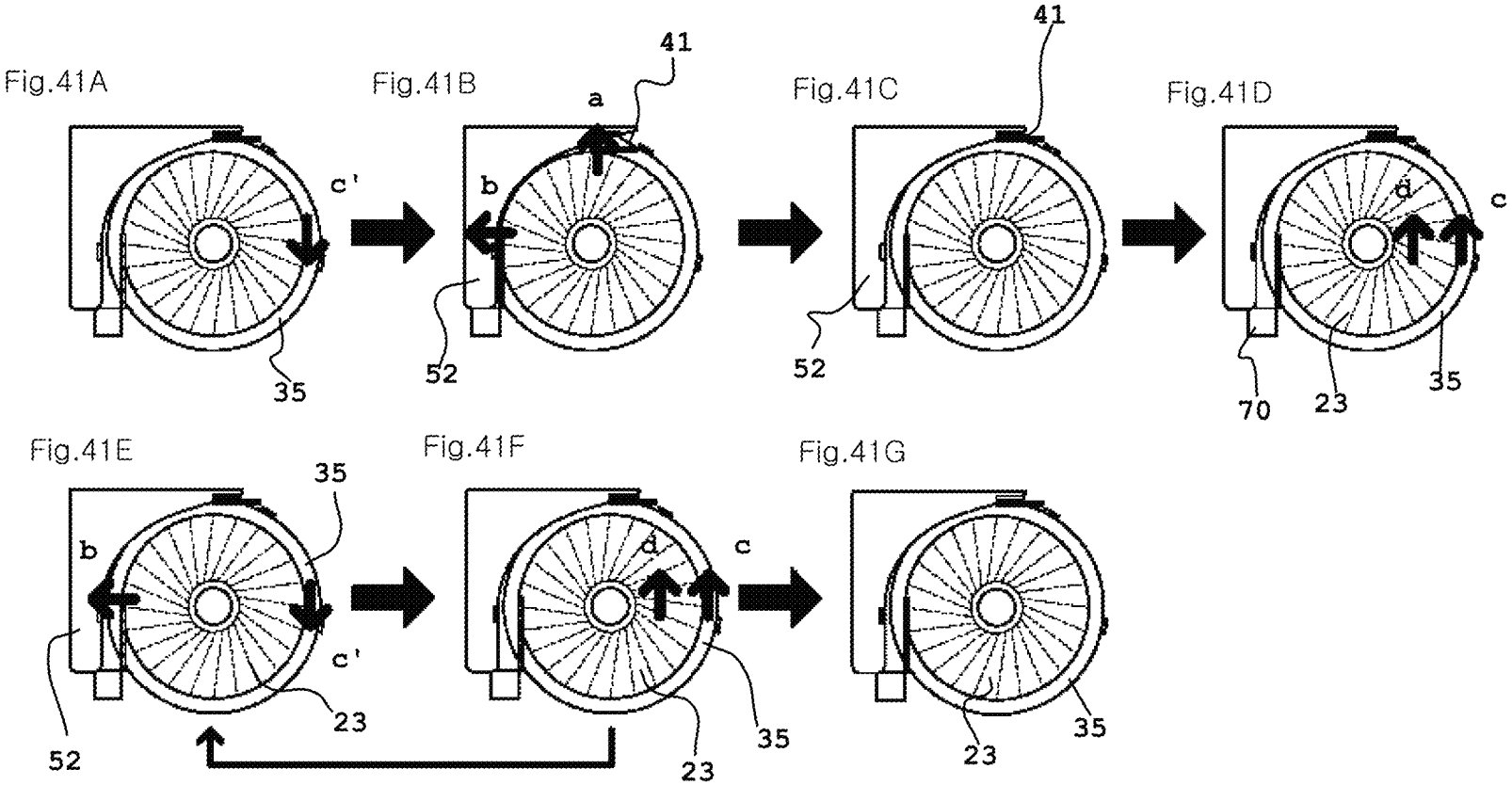
FIG. 41A through FIG. 41G are schematic views illustrating the operation of the rotator and so on in the first collecting processing in FIG. 32.

In the first collecting processing, as shown in flow chart in FIG. 32, the reverse rotation instruction is issued from the first control unit 104 (Step S191), as shown in FIG. 41A, the second rotator 35 is reversely rotated in the direction of the arrow c' for a predetermined time (here, 0.3 seconds) (Step S192). Then, as shown in FIGS. 41B and 41C, the height-restricting body 41 and the width-restricting body 52 are moved in the directions of the arrows a and b, respectively, and are located at the positions designated by the first control unit 104 (Step S193). The movement of the height-restricting body 41 and the width-restricting body 52 is decided depending of the size of the remaining medicines.

When the medicine collecting preparation is made, in response to the detection signal outputted from the medicine bottle-detecting sensor on the basis of setting of the medicine bottle at the dispensing position (Step S194), as shown in FIG. 41D, the first rotator 23 and the second rotator 35 are positively rotated in the directions of the arrows c and d at the speed designated by the first control unit 104 to start the collecting processing (Step S195).

Then, when the medicine-detecting unit 70 can detect any medicine within a predetermined time (here, 3 seconds) (Step S196: YES), the flow returns to Step S195 to continue the collecting processing.

On the contrary, when the medicine-detecting unit 70 cannot detect any medicine within the predetermined time (Step S196: NO), it is determined whether or not the medicine bottle is displaced (Step S197).

When the medicine bottle is not displaced, as shown in FIG. 41E, the width-restricting body 52 is moved in the direction of the arrow b to increase the width (here, 1,2 times) (Step S198). The first rotator 23 is stopped (Step S199), and the second rotator 35 is reversely rotated in the direction of the arrow c' for a predetermined time (here, 1 second) (Step S200). Then, the flow returns to Step S195 to repeat the processing, thereby, as shown in FIG. 41F, positively rotating the first rotator 23 and the second rotator 35 in the directions of the arrows d and c, respectively, at the speed designated by the first control unit 104.

When the medicine bottle is displaced, the first collecting processing is finished.

During the series of first collecting processing, in response to the detection signal from the medicine bottle-detecting sensor, it is determined whether or not the medicine bottle is displaced from the dispensing position at all times. When no detection signal is inputted to determine that the medicine bottle is displaced from the dispensing position, as shown in FIG. 41G, the first rotator 23 and the second rotator 35 are stopped.

(Second Collecting Processing)

Figure 33:
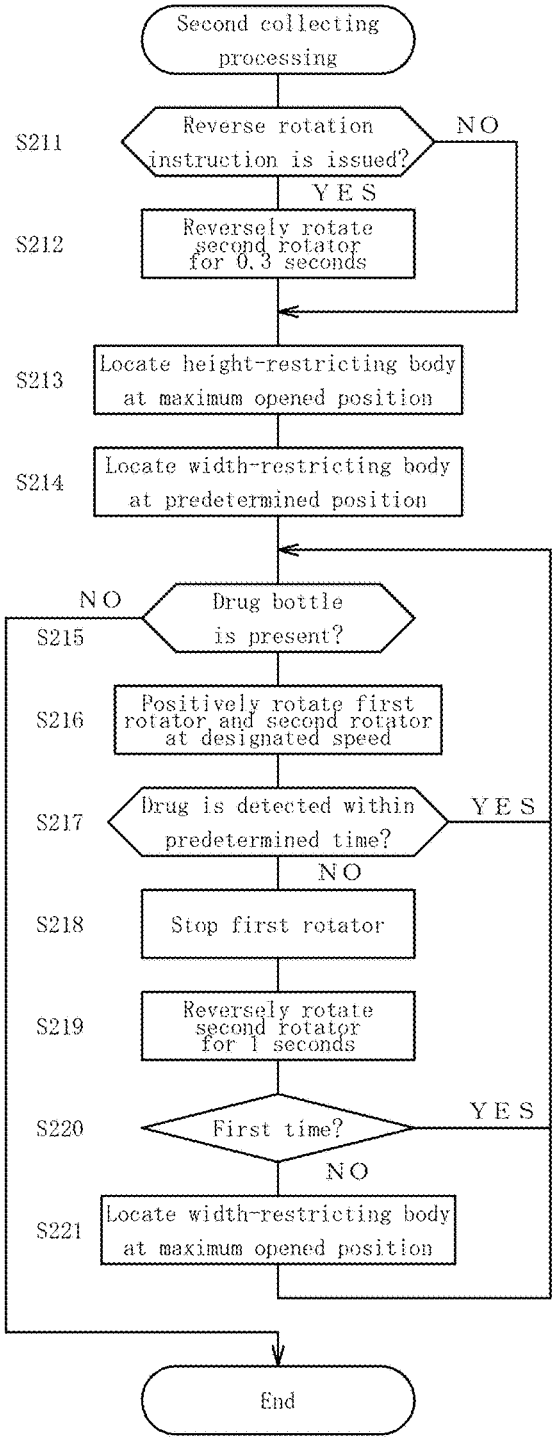
FIG. 33 is a flow chart illustrating second collecting processing in the medicine-counting device.
Figures 42A, 42B, 42C, 42D, 42E, 42F, 42G:
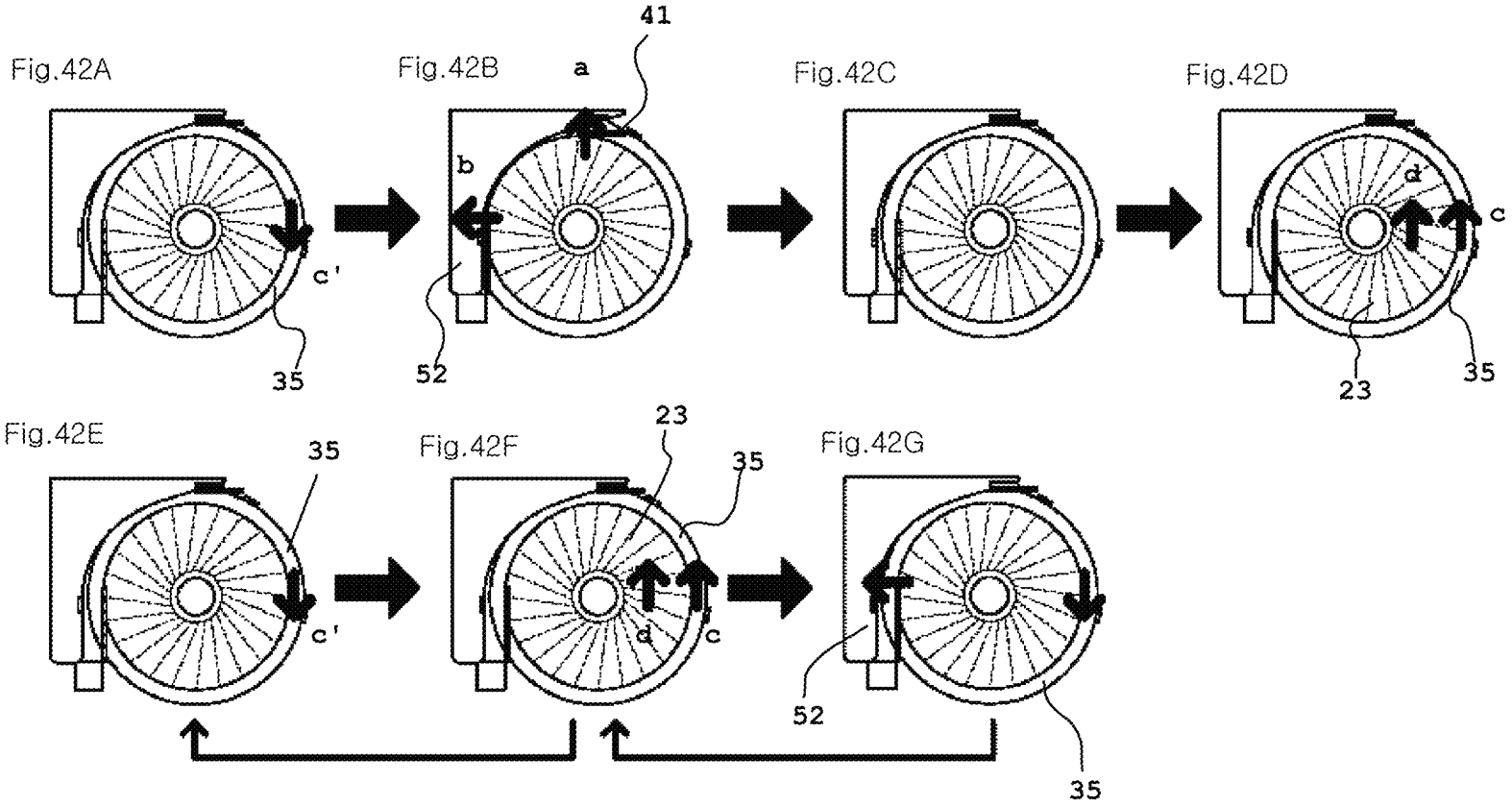
FIG. 42A through FIG. 42G are schematic views illustrating the operation of the rotator and so on in the second collecting processing in FIG. 33.

Also in the second collecting processing like the first collecting processing, as shown in a flow chart of FIG. 33, when the reverse rotation instruction is issued from the first control unit 104 (Step S211: YES), as shown in FIG. 42A, the second rotator 35 is reversely rotated in the direction of the arrow c' for a predetermined time (here, 0.3 seconds) (Step S212). Then, as shown in FIGS. 42B and 42C, the height-restricting body 41 is moved in the direction of the arrow a, and located at the maximum opened position (Step S213). The width-restricting body 52 is moved in the direction of the arrow b, and is located at a predetermined position (here, the position at which the width becomes 8 mm) (Step S214).

When the medicine collecting preparation is made, it is determined whether or not no detection signal of the medicine bottle is inputted from the medicine bottle-detecting sensor (not shown), that is, the medicine bottle is displaced from the dispensing position (Step S215).

When the medicine bottle is not displaced, as shown in FIG. 42D, the first rotator 23 and the second rotator 35 are positively rotated in the directions of the arrows d and c, respectively, at a speed designated by the first control unit 104 (Step S216). When the medicine-detecting unit 70 detects any medicine within a predetermined time (here, 4 seconds) during the collecting processing, Step S216 is continued. On the contrary, when the medicine-detecting unit 70 cannot detect any medicine within the predetermined time (Step S217), as shown in FIG. 42E, the first rotator 23 is stopped (Step S218), and the second rotator 35 is reversely rotated in the direction of the arrow c' for a predetermined time (here, 1 second) (Step S219). This can eliminate the failure that medicines are clogged at the dispensing position.

At this time, it is determined whether or not medicine-detecting unit 70 does not detect any medicine for the first time (Step S220). In the first time, the flow returns to Step S215 to repeat the processing (See FIGS. 42E and 42F). If not so, that is, in the second time, as shown in FIG. 42G, the width-restricting body 52 is moved to the maximum opened position (Step S221) and then, the flow returns to Step S215 to repeat the processing.

When the medicine bottle is displaced, the second collecting processing is finished.

By performing the collecting operation twice at different positions of the width-restricting body 52, all remaining medicines can be dispensed into the medicine bottle.

(Cleaning Mode)

In the case where the type of counted medicines is changed, especially, from medicines that can easily generate powders, a cleaning mode can be performed.

(Liquid Medicine Mode)

For liquid medicine, for example, when the prescription contains liquid medicine, the prescription and a medicine solution bottle storing the related liquid medicine can be imaged together using a below-mentioned side camera 108. In this case, the side camera 108 is pivoted from above to the near side, and images the prescription and the standing medicine solution bottle together. The level of the liquid medicine in the medicine solution bottle can be imaged, and the image along with data on the prescription can be recorded.

(Box Counting Mode)

When a medicine packed in a box is supplied, a bar code reader 89 reads a bar code on the box. Then, photograph data on the medicine corresponding to the read bar code is fetched and displayed on a screen. Thus, the user can visually check whether or not the medicine is proper. The photograph data and the medicine data (name or the like) may be transmitted to the first control unit 104 and stored. In the absence of a bar code, a code number or the like may be manually inputted.

The medicine-counting device in the embodiment may be also configured as follows. In the medicine-counting device in FIG. 35, there is only one medicine-dispensing position. The operation display part 107 is provided on each side of the dispensing position. The operation display part 107 is configured of the dispensing display LED 107*a* and the collecting display LED 107*b*. A following table shows a display pattern of each LED.

TABLE 5

| x | | |
|---|---|---|
| Operating state | Dispensing display LED | Collecting display LED |
| Waiting | Lighting | Lighting |
| Bar code reading | Non-lighting | Non-lighting |
| Dispense | Flash | Non-lighting |
| Division | Flash | Non-lighting |
| Dispensing completion | Non-lighting | Non-lighting |
| Drug collection | Non-lighting | Flash |
| Remaining medicine check | Flash | Flash |
| Side camera imaging | Lighting | lighting |

For example, during check of remaining medicines, both of the dispensing display LED 107*a* and the collecting display LED 107*b* are flashed. Thus, the user can easily recognize that the operating mode of the medicine-counting device is the initial collecting processing merely by viewing the operation display part 107. Although a large space cannot be ensured at the dispensing position due to the presence of the medicine bottle, the current mode can be clearly indicated to the user by merely providing the dispensing display LED 107*a* and the collecting display LED 107*b* and setting various lighting patterns of the LEDs.

Figure 35:
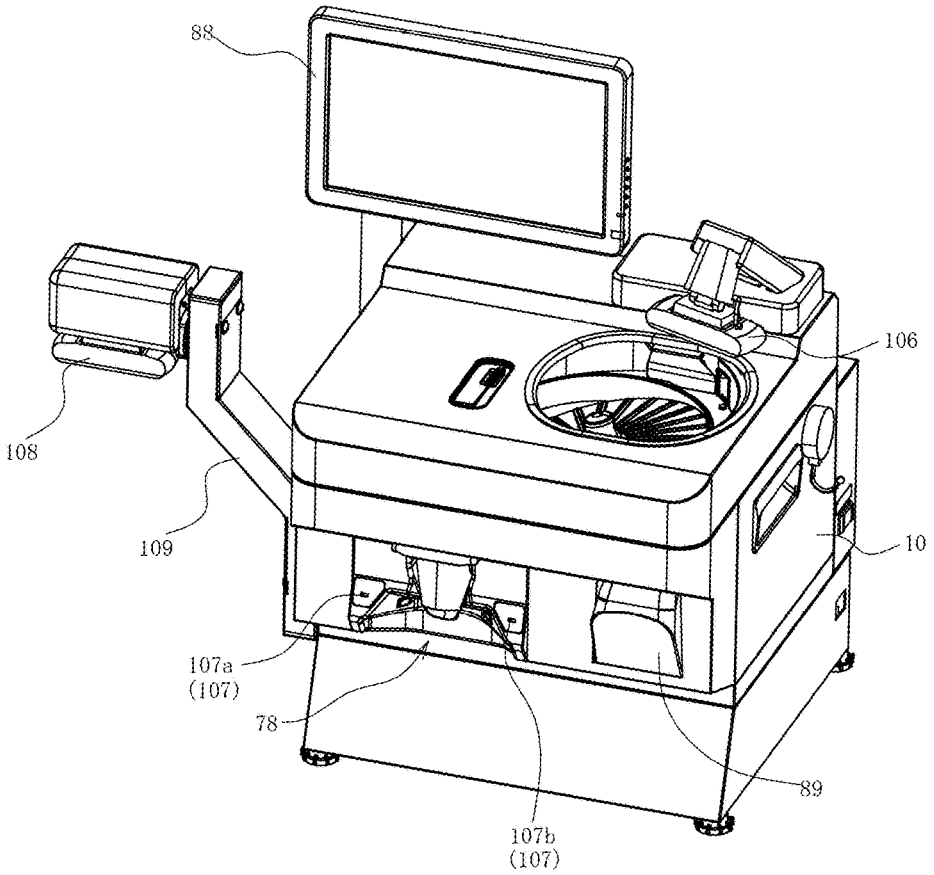
FIG. 35 is a perspective view of the medicine-counting device in accordance with another embodiment.

The medicine-supplying device is provided with the side camera 108 as shown in FIG. 35. The side camera 108 is attached to a front end of an arm 109 provided on a side face of the exterior body 10 to be rotatable about a spindle. A medicine (including liquid medicine and box) disposed lateral to the medicine-supplying device can be imaged with the side camera 108 located above the medicine by rotation of the arm 109. Changing the rotational angle of the arm 109 enables imaging of the medicines at various angles with the side camera 108.

Figure 37:
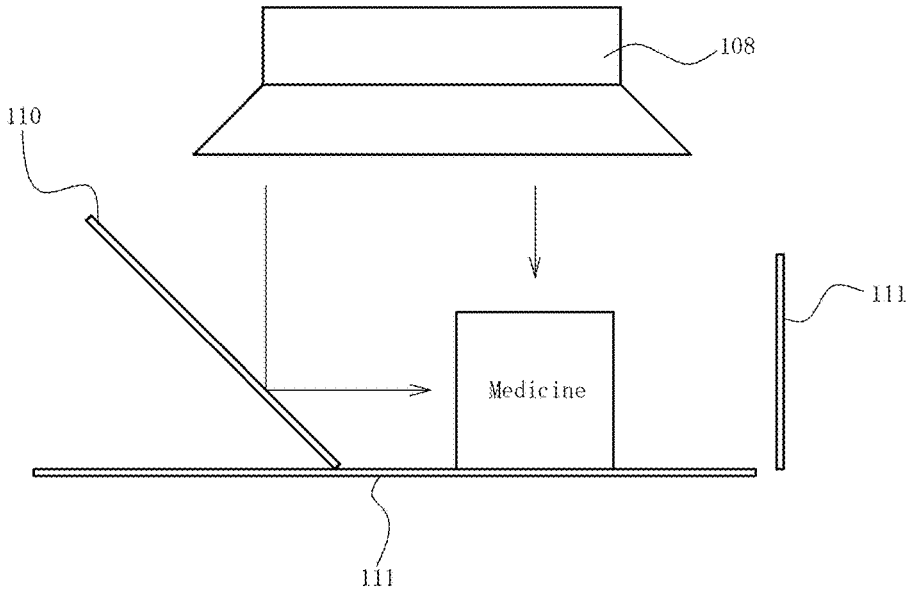
FIG. 37 is a schematic view illustrating the medicine imaging state with a side camera of the medicine-counting device in FIG. 35.

Imaging with the side camera 108 located above may be performed as follows. That is, as shown in FIG. 37, a mirror 110 tilted at 45 degrees is disposed lateral to the medicine. Thereby, one side camera 108 can simultaneously image the upper face and side face of the medicine. Preferably, scales 111 are disposed on a medicine mounting face and at a position lateral to the medicine (position opposite to the mirror 110). This can measure the medicine size as well.

The second rotator 35 in the medicine-supplying device may have a plurality of radially-extending protrusions (or dents) formed at predetermined intervals on its upper face in the circumferential direction. That is, the continuous irregularities on the upper face of the second rotator 35 in the circumferential direction prevents medicine slippage during positive rotation of the second rotator 35, achieving smooth discharging. The upper face of the second rotator 35 is tilted relative to the horizontal plane at a predetermined angle (here, 0.5 to 1 degree, preferably 1 degree). Through the tilt, the discharge port is located at the highest position of the second rotator 35. This can effectively prevent a medicine from being discharged through the discharge port by mistake, especially two medicines from being discharged together.

The height-restricting body 41 and the width-restricting body 52 in the medicine-supplying device can be reversed in position. A configuration for simultaneously restricting height and width can be adopted.

The first control unit 104 in the medicine-supplying device can be connected to another medicine-supplying device via a network. That is, by connecting a plurality of medicine-supplying devices with each other via the network, data acquired by the medicine-supplying device can be centrally administrated. For example, by centrally administrating calibration data such as medicine volume, which is acquired in the counting processing, each medicine-supplying device can be properly controlled.

Figure 45A:
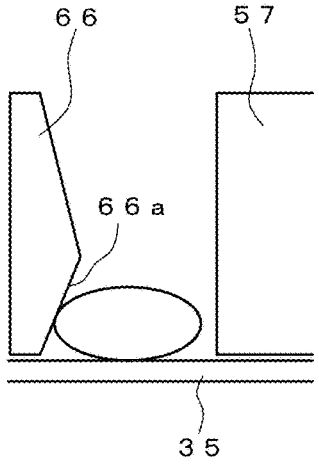
FIG. 45A through FIG. 45C are sectional views taken along A-A in FIG. 7B (end view illustrating an outer guide, an inner guide, and a second rotator).
Figure 45B:
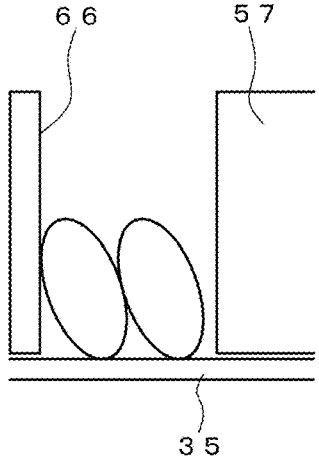
Figure 45C:
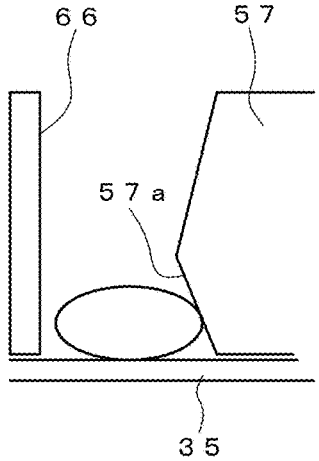

As shown in FIG. 45A, a face of the inner guide 66, which is opposed to the outer guide 57, may have a tilted part 66*a* tilted upward toward the outer guide 57. In the absence of the tilted part 66*a*, as shown in FIG. 45B, during passage of medicines between the inner guide 66 and the outer guide 57, the medicines may stand against the inner guide 66. In such case, two rows of medicines may be aligned and discharged by two, or may be clogged between the inner guide 66 and the outer guide 57. The medicine hardly stands due to the tilted part 66*a*, and discharge of two medicines together and clogging of the medicines are prevented. As shown in FIG. 45C, a face of the outer guide 57, which is opposed to the inner guide 66, may have a tilted part 57*a* tilted upward toward the inner guide 66. As a result, the medicine hardly stands against the outer guide 57, and discharging of two medicines together and clogging of the medicines are prevented.

Figure 46:
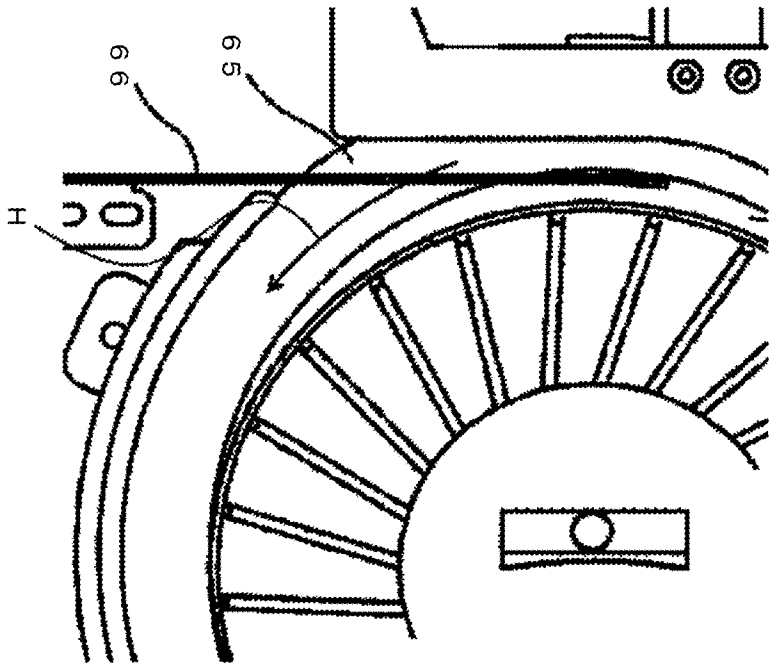
FIG. 46 is an enlarged plan view illustrating the second rotator in the vicinity of the outer guide and the inner guide in FIG. 45A through FIG. 45C.

As represented by an arrow H in FIG. 46, the second rotator 35 rotates between the inner guide 66 and the outer guide 57 such that the outer guide 57 is located on the upstream side in the rotational direction and the inner guide 66 is located on the downstream side in the rotational direction. For this reason, while passing between the inner guide 66 and the outer guide 57, a medicine often stands against the inner guide 66. Accordingly, forming the tilted part 66*a* on the inner guide 66 is more preferable than forming the tilted part 57*a* on the outer guide 57.

In the case of providing the tilted part 57*a* or the tilted part 66*a*, even for spheroidal medicines having the same width, the distance between the inner guide 66 and the outer guide 57 is varied depending on the ratio of a major axis to a minor axis. This is due to that the position where the medicine contacts the inner guide 66 or the outer guide 57 varies according to the ratio. Thus, a width correction coefficient may be decided according to the ratio.

In this embodiment, since the rotational speed of the second rotator 35 is determined depending on the medicine shape, a following problem can be eliminated.

That is, as shown in FIG. 44A, for spheroidal medicines having tapered ends, the medicine Z2 on the downstream side in the medicine conveying direction may enter under the medicine Z1 on the downstream side in the medicine conveying direction, resulting in that a distance L2 between the gravity center of the medicine Z1 and the gravity center of the medicine Z2 is smaller than a medicine size L1. The medicine is discharged from the second rotator 35 when the gravity center of the medicine is shifted from the second rotator 35. Thus, when a medicine enters under another medicine to decrease the distance between the gravity centers of the medicines, the medicine discharge interval tends to be small. The small medicine discharge interval causes the problem that the detection unit 70 recognizes continuously discharged medicines as one medicine. For medicines shaped to cause such problem, by setting the slower rotational speed of the second rotator 35 in the speed table to increase the interval at which the gravity center of the medicine is shifted from the second rotator 35 and in turn, increase the medicine discharge interval, the above-mentioned problem that the detection unit 70 recognizes continuously discharged medicines as one medicine can be prevented.

What is claimed is:

1. A medicine-supplying device comprising:

a rotator having an annular shape and configured to rotate in a circumferential direction and discharge a plurality of medicines on the rotator to an outer diameter direction of the rotator by rotation;

an inner guide configured to guide the medicine discharged to the outer diameter direction of the rotator by rotation, wherein the inner guide has a tilted part whose surface is tilted toward the outer diameter direction of the rotator; and a width restricting body configured to restrict a conveyance width of the medicine and being positioned at an upper stream side of rotation of the rotator with respect to the inner guide.

2. The medicine-supplying device according to claim 1, further comprising an outer guide configured to form a passage where the medicine passes together with the inner guide, wherein the outer guide is positioned at an upper stream side of rotation of the rotator with respect to the inner guide, an interval between the inner guide and the outer guide is adjustable.

3. The medicine-supplying device according to claim 2, wherein the interval is changed by a displacement of the outer guide.

4. The medicine-supplying device according to claim 1, further comprising an outer guide configured to form a passage where the medicine passes together with the inner guide, wherein the outer guide is positioned at the upper stream side of the rotation of the rotator with respect to the inner guide;

an interval between the inner guide and the outer guide is changed by a displacement of the outer guide;

the outer guide and the width restricting body are movable by a single driving motor.

* * * * *